US012384004B2

(12) United States Patent
Martone et al.

(10) Patent No.: US 12,384,004 B2
(45) Date of Patent: Aug. 12, 2025

(54) ABRASIVE ARTICLES AND METHODS OF FORMING SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Anthony Martone, Belmont, MA (US); Hua Fan, Southborough, MA (US); Kelley McNeal, Northborough, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 18/544,685

(22) Filed: Dec. 19, 2023

(65) Prior Publication Data

US 2024/0116153 A1 Apr. 11, 2024

Related U.S. Application Data

(63) Continuation of application No. 18/148,403, filed on Dec. 29, 2022.

(60) Provisional application No. 63/266,269, filed on Dec. 30, 2021.

(51) Int. Cl.

| | |
|---|---|
| ***B24D 11/02*** | (2006.01) |
| ***B24D 3/00*** | (2006.01) |
| ***B24D 11/00*** | (2006.01) |

(52) U.S. Cl.
CPC ..... *B24D 11/02* (2013.01); *B24D 3/00* (2013.01); *B24D 11/005* (2013.01)

(58) Field of Classification Search
CPC ..... B24D 3/00; B24D 11/02; B24D 11/005
See application file for complete search history.

(56) References Cited

U.S. PATENT DOCUMENTS

| | | | |
|---|---|---|---|
| 345,604 | A | 7/1886 | Semper |
| 1,910,444 | A | 5/1933 | Nicholson |
| 2,033,991 | A | 3/1936 | Melton et al. |
| 2,036,903 | A | 4/1936 | Webster |
| 2,049,874 | A | 8/1936 | Sherk |

(Continued)

FOREIGN PATENT DOCUMENTS

| | | | |
|---|---|---|---|
| CA | 743715 | A | 10/1966 |
| CA | 2423788 | A1 | 7/2002 |

(Continued)

OTHER PUBLICATIONS

Torre, "Investigation of Shaped Abrasive Particles vol. 1: Review of U.S. Pat. No. 6,054,093 Apr. 25, 2000" © Apr. 2011.

(Continued)

*Primary Examiner* — Pegah Parvini
(74) *Attorney, Agent, or Firm* — Abel Schillinger, LLP; Arpan Ghosh

(57) ABSTRACT

An abrasive article includes a backing; a make coat overlying the backing; and a plurality of abrasive particles overlying the backing and at least partially contained in the make coat; and a make coat thickness ratio (Tg/Ta) of not greater than 1.5, wherein Tg is the average thickness of the make coat at the sides of the abrasive particles and the Ta is the average thickness of the make coat.

28 Claims, 13 Drawing Sheets

(56) References Cited

U.S. PATENT DOCUMENTS 2,148,400 A 2/1939 Crompton, Jr.
2,248,064 A 7/1941 Carlton et al.
2,248,990 A 7/1941 Heany
2,290,877 A 7/1942 Heany
2,318,360 A 5/1943 Benner et al.
2,376,343 A 5/1945 Carlton
2,563,650 A 8/1951 Heinemann
2,880,080 A 3/1959 Rankin et al.
3,041,156 A 6/1962 Rowse et al.
3,067,551 A 12/1962 Maginnis
3,079,242 A 2/1963 Glasgow
3,079,243 A 2/1963 Ueltz
3,123,948 A 3/1964 Kistler et al.
3,141,271 A 7/1964 Fischer et al.
3,276,852 A 10/1966 Lemelson
3,377,660 A 4/1968 Marshall et al.
3,379,543 A 4/1968 Norwalk
3,387,957 A 6/1968 Howard
3,454,385 A 7/1969 Amero
3,477,180 A 11/1969 Robertson, Jr. et al.
3,480,395 A 11/1969 McMullen et al.
3,481,723 A 12/1969 Kistler et al.
3,491,492 A 1/1970 Ueltz
3,495,359 A 2/1970 Smith et al.
3,536,005 A 10/1970 Derrickson
3,590,799 A 7/1971 Guuchowicz
3,608,050 A 9/1971 Carman et al.
3,608,134 A 9/1971 Cook
3,615,308 A 10/1971 Amero
3,619,151 A 11/1971 Sheets, Jr. et al.
3,637,360 A 1/1972 Ueltz
3,670,467 A 6/1972 Walker
3,672,934 A 6/1972 Larry
3,808,747 A 5/1974 Kenagy
3,819,785 A 6/1974 Argyle et al.
3,859,407 A 1/1975 Blanding et al.
3,874,856 A 4/1975 Leeds
3,909,991 A 10/1975 Coes, Jr.
3,940,276 A 2/1976 Wilson
3,950,148 A 4/1976 Fukuda et al.
3,960,577 A 6/1976 Prochazka
3,977,132 A 8/1976 Sekigawa
3,986,885 A 10/1976 Lankard
3,991,527 A 11/1976 Maran
4,004,934 A 1/1977 Prochazka
4,037,367 A 7/1977 Kruse
4,045,919 A 9/1977 Moritomo
4,055,451 A 10/1977 Cockbain et al.
4,073,096 A 2/1978 Ueltz et al.
4,114,322 A 9/1978 Greenspan
4,150,078 A 4/1979 Miller et al.
4,194,887 A 3/1980 Ueltz et al.
4,252,544 A 2/1981 Takahashi
4,261,706 A 4/1981 Blanding et al.
4,286,905 A 9/1981 Samanta
4,304,576 A 12/1981 Hattori et al.
4,314,827 A 2/1982 Leitheiser et al.
4,341,663 A 7/1982 Derleth et al.
4,393,021 A 7/1983 Eisenberg et al.
4,452,911 A 6/1984 Eccles et al.
4,457,767 A 7/1984 Poon et al.
4,469,758 A 9/1984 Scott
4,505,720 A 3/1985 Gabor et al.
4,541,842 A 9/1985 Rostoker
4,548,617 A 10/1985 Miyatani et al.
4,570,048 A 2/1986 Poole
4,618,349 A 10/1986 Hashimoto et al.
4,623,364 A 11/1986 Cottringer et al.
4,656,330 A 4/1987 Poole
4,657,754 A 4/1987 Bauer et al.
4,659,341 A 4/1987 Ludwig et al.
4,678,560 A 7/1987 Stole et al.
4,711,750 A 12/1987 Scott
4,728,043 A 3/1988 Ersdal et al.
4,744,802 A 5/1988 Schwabel
4,770,671 A 9/1988 Monroe
4,786,292 A 11/1988 Janz et al.
4,797,139 A 1/1989 Bauer
4,797,269 A 1/1989 Bauer et al.
4,799,939 A 1/1989 Bloecher et al.
4,829,027 A 5/1989 Cutler et al.
4,832,706 A 5/1989 Yates
4,848,041 A 7/1989 Kruschke
4,858,527 A 8/1989 Masanao
4,863,573 A 9/1989 Moore et al.
4,876,226 A 10/1989 Fuentes
4,881,951 A 11/1989 Wood et al.
4,917,852 A 4/1990 Poole et al.
4,918,116 A 4/1990 Gardziella et al.
4,925,457 A 5/1990 Dekok et al.
4,925,815 A 5/1990 Tani et al.
4,930,266 A 6/1990 Calhoun et al.
4,942,011 A 7/1990 Bolt et al.
4,954,462 A 9/1990 Wood
4,960,441 A 10/1990 Pellow et al.
4,961,757 A 10/1990 Rhodes et al.
4,963,012 A 10/1990 Tracy
4,964,883 A 10/1990 Morris et al.
4,970,057 A 11/1990 Wilkens et al.
4,997,461 A 3/1991 Markhoff-Matheny et al.
5,000,760 A 3/1991 Ohtsubo et al.
5,008,222 A 4/1991 Kameda
5,009,675 A 4/1991 Kunz et al.
5,009,676 A 4/1991 Rue et al.
5,011,508 A 4/1991 Wald et al.
5,011,510 A 4/1991 Hayakawa et al.
5,014,468 A 5/1991 Ravipati et al.
5,024,795 A 6/1991 Kennedy et al.
5,032,304 A 7/1991 Toyota
5,035,723 A 7/1991 Kalinowski et al.
5,035,724 A 7/1991 Pukari et al.
5,042,991 A 8/1991 Kunz et al.
5,049,165 A 9/1991 Tselesin
5,049,166 A 9/1991 Kirkendall
5,049,645 A 9/1991 Nagaoka et al.
5,053,367 A 10/1991 Newkirk et al.
5,053,369 A 10/1991 Winkler et al.
5,076,991 A 12/1991 Poole et al.
5,078,753 A 1/1992 Broberg et al.
5,081,082 A 1/1992 Hai-Doo et al.
5,085,671 A 2/1992 Martin et al.
5,090,968 A 2/1992 Pellow
5,094,986 A 3/1992 Matsumoto et al.
5,098,740 A 3/1992 Tewari
5,103,598 A 4/1992 Kelly
5,108,963 A 4/1992 Fu et al.
5,114,438 A 5/1992 Leatherman et al.
5,120,327 A 6/1992 Dennis
5,123,935 A 6/1992 Kanamaru et al.
5,129,919 A 7/1992 Kalinowski et al.
5,131,926 A 7/1992 Rostoker et al.
5,132,984 A 7/1992 Simpson
5,139,978 A 8/1992 Wood
5,152,917 A 10/1992 Pieper et al.
5,160,509 A 11/1992 Carman et al.
5,164,744 A 11/1992 Yoshida et al.
5,173,457 A 12/1992 Shorthouse
5,178,849 A 1/1993 Bauer
5,180,630 A 1/1993 Giglia
5,185,012 A 2/1993 Kelly
5,185,299 A 2/1993 Wood et al.
5,190,568 A 3/1993 Tselesin
5,194,072 A 3/1993 Rue et al.
5,201,916 A 4/1993 Berg et al.
5,203,886 A 4/1993 Sheldon et al.
5,213,591 A 5/1993 Celikkaya et al.
5,215,552 A 6/1993 Sung
5,219,462 A 6/1993 Bruxvoort et al.
5,219,806 A 6/1993 Wood
5,221,294 A 6/1993 Carman et al.
5,224,970 A 7/1993 Harakawa et al.
5,227,104 A 7/1993 Bauer
5,244,477 A 9/1993 Rue et al.
5,244,849 A 9/1993 Roy et al.

(56) References Cited

U.S. PATENT DOCUMENTS 5,273,558 A 12/1993 Nelson et al.
5,277,702 A 1/1994 Thibault et al.
5,282,875 A 2/1994 Wood
5,288,297 A 2/1994 Ringwood
5,300,130 A 4/1994 Rostoker
5,304,331 A 4/1994 Leonard et al.
5,312,789 A 5/1994 Wood
5,312,791 A 5/1994 Coblenz et al.
5,314,513 A 5/1994 Miller et al.
5,366,523 A 11/1994 Rowenhorst et al.
5,366,525 A 11/1994 Fujiyama
5,372,620 A 12/1994 Rowse et al.
5,373,786 A 12/1994 Umaba
5,376,598 A 12/1994 Preedy et al.
5,376,602 A 12/1994 Nilsen
5,383,945 A 1/1995 Cottringer et al.
5,395,407 A 3/1995 Cottringer et al.
5,409,645 A 4/1995 Torre, Jr. et al.
5,429,648 A 7/1995 Wu
5,431,967 A 7/1995 Manthiram
5,435,816 A 7/1995 Spurgeon et al.
5,437,754 A 8/1995 Calhoun
5,441,549 A 8/1995 Helmin
5,443,603 A 8/1995 Kirkendall
5,447,894 A 9/1995 Yasuoka et al.
5,453,106 A 9/1995 Roberts
5,454,844 A 10/1995 Hibbard et al.
5,470,806 A 11/1995 Krstic et al.
5,479,873 A 1/1996 Shintani et al.
5,482,756 A 1/1996 Berger et al.
5,486,496 A 1/1996 Talbert et al.
5,489,318 A 2/1996 Erickson et al.
5,496,386 A 3/1996 Broberg et al.
5,498,268 A 3/1996 Gagliardi et al.
5,500,273 A 3/1996 Holmes et al.
5,514,631 A 5/1996 Cottringer et al.
5,516,347 A 5/1996 Garg
5,516,348 A 5/1996 Conwell et al.
5,523,074 A 6/1996 Takahashi et al.
5,525,100 A 6/1996 Kelly et al.
5,527,369 A 6/1996 Garg
5,543,368 A 8/1996 Talbert et al.
5,549,962 A 8/1996 Holmes et al.
5,551,963 A 9/1996 Larmie
5,560,745 A 10/1996 Roberts
5,567,150 A 10/1996 Conwell et al.
5,567,214 A 10/1996 Ashley
5,567,251 A 10/1996 Peker et al.
5,571,297 A 11/1996 Swei et al.
5,576,409 A 11/1996 Mackey
5,578,095 A 11/1996 Bland et al.
5,578,222 A 11/1996 Trischuk et al.
5,582,625 A 12/1996 Wright et al.
5,584,896 A 12/1996 Broberg et al.
5,584,897 A 12/1996 Christianson et al.
5,591,685 A 1/1997 Mitomo et al.
5,593,468 A 1/1997 Khaund et al.
5,599,493 A 2/1997 Ito et al.
5,603,738 A 2/1997 Zeiringer et al.
5,609,706 A 3/1997 Benedict et al.
5,611,829 A 3/1997 Monroe et al.
5,618,221 A 4/1997 Furukawa et al.
5,628,952 A 5/1997 Holmes et al.
5,641,469 A 6/1997 Garg et al.
RE35,570 E 7/1997 Rowenhorst et al.
5,645,619 A 7/1997 Erickson et al.
5,651,925 A 7/1997 Ashley et al.
5,656,217 A 8/1997 Rogers et al.
5,667,542 A 9/1997 Law et al.
5,669,941 A 9/1997 Peterson
5,669,943 A 9/1997 Horton et al.
5,672,097 A 9/1997 Hoopman
5,672,554 A 9/1997 Mohri et al.
5,683,844 A 11/1997 Mammino
5,702,811 A 12/1997 Ho et al.
5,725,162 A 3/1998 Garg et al.
5,736,619 A 4/1998 Kane et al.
5,738,696 A 4/1998 Wu
5,738,697 A 4/1998 Wu et al.
5,751,313 A 5/1998 Miyashita et al.
5,759,481 A 6/1998 Pujari et al.
5,776,214 A 7/1998 Wood
5,779,743 A 7/1998 Wood
5,785,722 A 7/1998 Garg et al.
5,810,587 A 9/1998 Bruns et al.
5,820,450 A 10/1998 Calhoun
5,830,248 A 11/1998 Christianson et al.
5,840,089 A 11/1998 Chesley et al.
5,849,646 A 12/1998 Stout et al.
5,855,997 A 1/1999 Amateau
5,863,306 A 1/1999 Wei et al.
5,866,254 A 2/1999 Peker et al.
5,876,793 A 3/1999 Sherman et al.
5,885,311 A 3/1999 McCutcheon et al.
5,893,935 A 4/1999 Wood
5,902,647 A 5/1999 Venkataramani
5,908,477 A 6/1999 Harmer et al.
5,908,478 A 6/1999 Wood
5,919,549 A 7/1999 Van et al.
5,924,917 A 7/1999 Benedict et al.
5,946,991 A 9/1999 Hoopman
5,975,987 A 11/1999 Hoopman et al.
5,980,678 A 11/1999 Tselesin
5,984,988 A 11/1999 Berg et al.
5,989,301 A 11/1999 Laconto, Sr. et al.
5,997,597 A 12/1999 Hagan
6,016,660 A 1/2000 Abramshe
6,019,805 A 2/2000 Herron
6,024,824 A 2/2000 Krech
6,027,326 A 2/2000 Cesarano, III et al.
6,039,775 A 3/2000 Ho et al.
6,048,577 A 4/2000 Garg
6,053,956 A 4/2000 Wood
6,054,093 A 4/2000 Torre, Jr. et al.
6,080,215 A 6/2000 Stubbs et al.
6,080,216 A 6/2000 Erickson
6,083,622 A 7/2000 Garg et al.
6,096,107 A 8/2000 Caracostas et al.
6,110,241 A 8/2000 Sung
6,129,540 A 10/2000 Hoopman et al.
6,136,288 A 10/2000 Bauer et al.
6,146,247 A 11/2000 Nokubi et al.
6,179,887 B1 1/2001 Barber, Jr. et al.
6,206,942 B1 3/2001 Wood
6,228,134 B1 5/2001 Erickson
6,238,450 B1 5/2001 Garg et al.
6,258,137 B1 7/2001 Garg et al.
6,258,141 B1 7/2001 Sung et al.
6,261,682 B1 7/2001 Law
6,264,710 B1 7/2001 Erickson
6,277,160 B1 8/2001 Stubbs et al.
6,277,161 B1 8/2001 Castro et al.
6,283,997 B1 9/2001 Garg et al.
6,284,690 B1 9/2001 Nakahata et al.
6,287,353 B1 9/2001 Celikkaya
6,306,007 B1 10/2001 Mori et al.
6,312,324 B1 11/2001 Mitsui et al.
6,319,108 B1 11/2001 Adefris et al.
6,331,343 B1 12/2001 Perez et al.
6,371,842 B1 4/2002 Romero
6,391,812 B1 5/2002 Araki et al.
6,398,989 B1 6/2002 Bergstrom
6,401,795 B1 6/2002 Cesarano, III et al.
6,403,001 B1 6/2002 Hayashi
6,406,200 B2 6/2002 Mahoney
6,413,286 B1 7/2002 Swei et al.
6,428,392 B1 8/2002 Sunahara et al.
6,451,076 B1 9/2002 Nevoret et al.
6,475,253 B2 11/2002 Culler et al.
6,500,493 B2 12/2002 Swei et al.
6,511,938 B1 1/2003 Liu
6,524,681 B1 2/2003 Seitz et al.
6,531,423 B1 3/2003 Schwetz et al.
6,537,140 B1 3/2003 Miller et al.

(56) References Cited

U.S. PATENT DOCUMENTS

| | | | |
|---|---|---|---|
| 6,579,819 | B2 | 6/2003 | Hirosaki et al. |
| 6,582,623 | B1 | 6/2003 | Grumbine et al. |
| 6,583,080 | B1 | 6/2003 | Rosenflanz |
| 6,599,177 | B2 | 7/2003 | Nevoret et al. |
| 6,620,214 | B2 | 9/2003 | McArdle |
| 6,646,019 | B2 | 11/2003 | Perez et al. |
| 6,652,361 | B1 | 11/2003 | Gash et al. |
| 6,669,745 | B2 | 12/2003 | Prichard et al. |
| 6,685,755 | B2 | 2/2004 | Ramanath et al. |
| 6,696,258 | B1 | 2/2004 | Wei et al. |
| 6,702,650 | B2 | 3/2004 | Adefris |
| 6,737,378 | B2 | 5/2004 | Hirosaki et al. |
| 6,749,496 | B2 | 6/2004 | Mota et al. |
| 6,750,173 | B2 | 6/2004 | Rizkalla |
| 6,752,700 | B2 | 6/2004 | Duescher |
| 6,755,729 | B2 | 6/2004 | Ramanath et al. |
| 6,802,878 | B1 | 10/2004 | Monroe |
| 6,821,196 | B2 | 11/2004 | Oliver |
| 6,833,014 | B2 | 12/2004 | Welygan et al. |
| 6,843,815 | B1 | 1/2005 | Thurber et al. |
| 6,846,795 | B2 | 1/2005 | Lant et al. |
| 6,878,456 | B2 | 4/2005 | Castro et al. |
| 6,881,483 | B2 | 4/2005 | McArdle et al. |
| 6,888,360 | B1 | 5/2005 | Connell et al. |
| 6,913,824 | B2 | 7/2005 | Culler et al. |
| 6,942,561 | B2 | 9/2005 | Mota et al. |
| 6,949,128 | B2 | 9/2005 | Annen |
| 6,951,504 | B2 | 10/2005 | Adefris et al. |
| 6,974,930 | B2 | 12/2005 | Jense |
| 7,022,179 | B1 | 4/2006 | Dry |
| 7,044,989 | B2 | 5/2006 | Welygan et al. |
| 7,112,621 | B2 | 9/2006 | Rohrbaugh et al. |
| 7,141,522 | B2 | 11/2006 | Rosenflanz et al. |
| 7,168,267 | B2 | 1/2007 | Rosenflanz et al. |
| 7,169,198 | B2 | 1/2007 | Moeltgen et al. |
| 7,267,604 | B2 | 9/2007 | Yoshizawa et al. |
| 7,267,700 | B2 | 9/2007 | Collins et al. |
| 7,294,158 | B2 | 11/2007 | Welygan et al. |
| 7,297,170 | B2 | 11/2007 | Welygan et al. |
| 7,297,402 | B2 | 11/2007 | Evans et al. |
| 7,364,788 | B2 | 4/2008 | Kishbaugh et al. |
| 7,373,887 | B2 | 5/2008 | Jackson |
| 7,384,437 | B2 | 6/2008 | Welygan et al. |
| 7,404,832 | B2 | 7/2008 | Ohtsubo et al. |
| 7,488,544 | B2 | 2/2009 | Schofalvi et al. |
| 7,507,268 | B2 | 3/2009 | Rosenflanz |
| 7,553,346 | B2 | 6/2009 | Welygan et al. |
| 7,556,558 | B2 | 7/2009 | Palmgren |
| 7,560,062 | B2 | 7/2009 | Gould et al. |
| 7,560,139 | B2 | 7/2009 | Thebault et al. |
| 7,563,293 | B2 | 7/2009 | Rosenflanz |
| 7,611,795 | B2 | 11/2009 | Aoyama et al. |
| 7,618,684 | B2 | 11/2009 | Nesbitt |
| 7,632,434 | B2 | 12/2009 | Duescher |
| 7,651,386 | B2 | 1/2010 | Sung |
| 7,662,735 | B2 | 2/2010 | Rosenflanz et al. |
| 7,666,344 | B2 | 2/2010 | Schofalvi et al. |
| 7,666,475 | B2 | 2/2010 | Morrison |
| 7,669,658 | B2 | 3/2010 | Barron et al. |
| 7,670,679 | B2 | 3/2010 | Krishna et al. |
| 7,695,542 | B2 | 4/2010 | Drivdahl et al. |
| 7,858,189 | B2 | 12/2010 | Wagener et al. |
| 7,867,302 | B2 | 1/2011 | Nevoret et al. |
| 7,906,057 | B2 | 3/2011 | Zhang et al. |
| 7,968,147 | B2 | 6/2011 | Fang et al. |
| 7,972,430 | B2 | 7/2011 | Millard et al. |
| 8,021,449 | B2 | 9/2011 | Seth et al. |
| 8,034,137 | B2 | 10/2011 | Erickson et al. |
| 8,049,136 | B2 | 11/2011 | Mase et al. |
| 8,070,556 | B2 | 12/2011 | Kumar et al. |
| 8,123,828 | B2 | 2/2012 | Culler et al. |
| 8,141,484 | B2 | 3/2012 | Ojima et al. |
| 8,142,531 | B2 | 3/2012 | Adefris et al. |
| 8,142,532 | B2 | 3/2012 | Erickson et al. |
| 8,142,891 | B2 | 3/2012 | Culler et al. |
| 8,251,774 | B2 | 8/2012 | Joseph et al. |
| 8,256,091 | B2 | 9/2012 | Duescher |
| 8,333,360 | B2 | 12/2012 | Rule et al. |
| 8,440,602 | B2 | 5/2013 | Gonzales et al. |
| 8,440,603 | B2 | 5/2013 | Gonzales et al. |
| 8,445,422 | B2 | 5/2013 | Gonzales et al. |
| 8,470,759 | B2 | 6/2013 | Gonzales et al. |
| 8,480,772 | B2 | 7/2013 | Welygan et al. |
| 8,530,682 | B2 | 9/2013 | Sachs |
| 8,568,497 | B2 | 10/2013 | Sheridan |
| 8,628,597 | B2 | 1/2014 | Palmgren et al. |
| 8,783,589 | B2 | 7/2014 | Hart et al. |
| 8,852,643 | B2 | 10/2014 | Gonzales et al. |
| 8,920,527 | B2 | 12/2014 | Seider et al. |
| 8,921,687 | B1 | 12/2014 | Welser et al. |
| 9,017,439 | B2 | 4/2015 | Yener et al. |
| 9,079,154 | B2 | 7/2015 | Rosendahl et al. |
| 9,181,477 | B2 | 11/2015 | Collins et al. |
| 9,211,634 | B2 | 12/2015 | Rehrig et al. |
| 9,259,726 | B2 | 2/2016 | Gopal |
| 9,375,826 | B2 | 6/2016 | Tian et al. |
| 9,717,674 | B1 | 8/2017 | Guskey et al. |
| 9,758,724 | B2 | 9/2017 | Collins et al. |
| 9,982,175 | B2 | 5/2018 | Sarangi et al. |
| D849,066 | S | 5/2019 | Hanschen et al. |
| D849,067 | S | 5/2019 | Hanschen et al. |
| 10,351,745 | B2 | 7/2019 | Josseaux et al. |
| 10,364,383 | B2 | 7/2019 | Yener et al. |
| D862,538 | S | 10/2019 | Hanschen et al. |
| D870,782 | S | 12/2019 | Hanschen et al. |
| 10,556,323 | B2 | 2/2020 | Alkhas et al. |
| 10,557,068 | B2 | 2/2020 | Oldenkotte et al. |
| 10,563,105 | B2 | 2/2020 | Cotter et al. |
| 10,655,038 | B2 | 5/2020 | Martinez et al. |
| 10,710,211 | B2 | 7/2020 | Lehuu et al. |
| 10,717,908 | B2 | 7/2020 | Hejtmann et al. |
| 2001/0027623 | A1 | 10/2001 | Rosenflanz |
| 2002/0026752 | A1 | 3/2002 | Culler et al. |
| 2002/0068518 | A1 | 6/2002 | Cesena et al. |
| 2002/0084290 | A1 | 7/2002 | Materna |
| 2002/0090891 | A1 | 7/2002 | Adefris et al. |
| 2002/0151265 | A1 | 10/2002 | Adefris |
| 2002/0170236 | A1 | 11/2002 | Larson et al. |
| 2002/0174935 | A1 | 11/2002 | Burdon et al. |
| 2002/0177391 | A1 | 11/2002 | Fritz et al. |
| 2003/0008933 | A1 | 1/2003 | Perez et al. |
| 2003/0022961 | A1 | 1/2003 | Kusaka et al. |
| 2003/0029094 | A1 | 2/2003 | Moeltgen et al. |
| 2003/0085204 | A1 | 5/2003 | Lagos |
| 2003/0109371 | A1 | 6/2003 | Pujari et al. |
| 2003/0110707 | A1 | 6/2003 | Rosenflanz et al. |
| 2003/0126800 | A1 | 7/2003 | Seth et al. |
| 2003/0228738 | A1 | 12/2003 | Beaudoin |
| 2004/0003895 | A1 | 1/2004 | Amano et al. |
| 2004/0148868 | A1 | 8/2004 | Anderson et al. |
| 2004/0148967 | A1 | 8/2004 | Celikkaya et al. |
| 2004/0202844 | A1 | 10/2004 | Wong |
| 2004/0224125 | A1 | 11/2004 | Yamada et al. |
| 2004/0235406 | A1 | 11/2004 | Duescher |
| 2004/0244675 | A1 | 12/2004 | Kishimoto et al. |
| 2005/0020190 | A1 | 1/2005 | Schutz et al. |
| 2005/0060941 | A1 | 3/2005 | Provow et al. |
| 2005/0060947 | A1 | 3/2005 | McArdle et al. |
| 2005/0064805 | A1 | 3/2005 | Culler et al. |
| 2005/0081455 | A1 | 4/2005 | Welygan et al. |
| 2005/0118939 | A1 | 6/2005 | Duescher |
| 2005/0132655 | A1 | 6/2005 | Anderson et al. |
| 2005/0218565 | A1 | 10/2005 | DiChiara, Jr. |
| 2005/0223649 | A1 | 10/2005 | O'Gary et al. |
| 2005/0232853 | A1 | 10/2005 | Evans et al. |
| 2005/0245179 | A1 | 11/2005 | Luedeke |
| 2005/0255801 | A1 | 11/2005 | Pollasky |
| 2005/0266221 | A1 | 12/2005 | Karam et al. |
| 2005/0271795 | A1 | 12/2005 | Moini et al. |
| 2005/0284029 | A1 | 12/2005 | Bourlier et al. |
| 2006/0049540 | A1 | 3/2006 | Hui et al. |
| 2006/0126265 | A1 | 6/2006 | Crespi et al. |
| 2006/0135050 | A1 | 6/2006 | Petersen et al. |
| 2006/0177488 | A1 | 8/2006 | Caruso et al. |

(56) References Cited

U.S. PATENT DOCUMENTS

2006/0185256 A1 8/2006 Nevoret et al.
2007/0011951 A1 1/2007 Gaeta et al.
2007/0020457 A1 1/2007 Adefris
2007/0051355 A1 3/2007 Sung
2007/0072527 A1 3/2007 Palmgren
2007/0074456 A1 4/2007 Orlhac et al.
2007/0087928 A1 4/2007 Rosenflanz et al.
2007/0234646 A1 10/2007 Can et al.
2008/0017053 A1 1/2008 Araumi et al.
2008/0072500 A1 3/2008 Klett et al.
2008/0098659 A1 5/2008 Sung
2008/0121124 A1 5/2008 Sato
2008/0172951 A1 7/2008 Starling
2008/0176075 A1 7/2008 Bauer et al.
2008/0179783 A1 7/2008 Liu et al.
2008/0230951 A1 9/2008 Dannoux et al.
2008/0233845 A1 9/2008 Annen et al.
2008/0262577 A1 10/2008 Altshuler et al.
2008/0271384 A1 11/2008 Puthanangady et al.
2008/0286590 A1 11/2008 Besida et al.
2008/0299875 A1 12/2008 Duescher
2009/0016916 A1 1/2009 Rosenzweig et al.
2009/0017276 A1 1/2009 Hoglund et al.
2009/0017736 A1 1/2009 Block et al.
2009/0098365 A1 4/2009 Moeltgen
2009/0165394 A1 7/2009 Culler et al.
2009/0165661 A1 7/2009 Koenig et al.
2009/0169816 A1 7/2009 Erickson et al.
2009/0208734 A1 8/2009 Macfie et al.
2009/0246464 A1 10/2009 Watanabe et al.
2010/0000159 A1 1/2010 Walia et al.
2010/0003900 A1 1/2010 Sakaguchi et al.
2010/0003904 A1 1/2010 Duescher
2010/0040767 A1 2/2010 Uibel et al.
2010/0056816 A1 3/2010 Wallin et al.
2010/0064594 A1 3/2010 Pakalapati et al.
2010/0068974 A1 3/2010 Dumm
2010/0146867 A1 6/2010 Boden et al.
2010/0151195 A1 6/2010 Culler et al.
2010/0151196 A1 6/2010 Adefris et al.
2010/0151201 A1 6/2010 Erickson et al.
2010/0190424 A1 7/2010 Francois et al.
2010/0201018 A1 8/2010 Yoshioka et al.
2010/0251625 A1 10/2010 Gaeta
2010/0292428 A1 11/2010 Meador et al.
2010/0307067 A1 12/2010 Sigalas et al.
2010/0319269 A1 12/2010 Erickson
2010/0330886 A1 12/2010 Wu et al.
2011/0008604 A1 1/2011 Boylan
2011/0081848 A1 4/2011 Chen
2011/0092137 A1 4/2011 Ohishi et al.
2011/0111563 A1 5/2011 Yanagi et al.
2011/0124483 A1 5/2011 Shah et al.
2011/0136659 A1 6/2011 Allen et al.
2011/0146509 A1 6/2011 Welygan et al.
2011/0152548 A1 6/2011 Sachs
2011/0160104 A1 6/2011 Wu et al.
2011/0244769 A1 10/2011 David et al.
2011/0289854 A1 12/2011 Moren et al.
2011/0314746 A1 12/2011 Erickson et al.
2012/0000135 A1 1/2012 Eilers et al.
2012/0034847 A1 2/2012 Besse et al.
2012/0055098 A1 3/2012 Ramanath et al.
2012/0100366 A1 4/2012 Dumm et al.
2012/0137597 A1 6/2012 Adefris et al.
2012/0142259 A1 6/2012 Hamilton
2012/0144754 A1 6/2012 Culler et al.
2012/0144755 A1 6/2012 Erickson et al.
2012/0153547 A1 6/2012 Bauer et al.
2012/0167481 A1 7/2012 Yener et al.
2012/0168979 A1 7/2012 Bauer et al.
2012/0227333 A1 9/2012 Adefris et al.
2012/0231711 A1 9/2012 Keipert et al.
2012/0308837 A1 12/2012 Schlechtriemen et al.
2012/0321567 A1 12/2012 Gonzales et al.
2013/0000212 A1 1/2013 Wang et al.
2013/0000216 A1 1/2013 Wang et al.
2013/0009484 A1 1/2013 Yu
2013/0036402 A1 2/2013 Mutisya et al.
2013/0045251 A1 2/2013 Cen et al.
2013/0067669 A1 3/2013 Gonzales et al.
2013/0072417 A1 3/2013 Perez-Prat et al.
2013/0074418 A1 3/2013 Panzarella et al.
2013/0125477 A1 5/2013 Adefris
2013/0180180 A1 7/2013 Yener et al.
2013/0186005 A1 7/2013 Kavanaugh
2013/0186006 A1 7/2013 Kavanaugh et al.
2013/0199105 A1 8/2013 Braun et al.
2013/0203328 A1 8/2013 Givot et al.
2013/0212952 A1 8/2013 Welygan et al.
2013/0236725 A1 9/2013 Yener et al.
2013/0255162 A1 10/2013 Welygan et al.
2013/0260656 A1 10/2013 Seth et al.
2013/0267150 A1 10/2013 Seider et al.
2013/0283705 A1 10/2013 Fischer et al.
2013/0296587 A1 11/2013 Rosendahl
2013/0305614 A1 11/2013 Gaeta et al.
2013/0337262 A1 12/2013 Bauer et al.
2013/0337725 A1 12/2013 Monroe
2013/0344786 A1 12/2013 Keipert
2014/0000176 A1 1/2014 Moren et al.
2014/0007518 A1 1/2014 Yener et al.
2014/0080393 A1 3/2014 Ludwig
2014/0106126 A1 4/2014 Gaeta et al.
2014/0107356 A1 4/2014 Gopal
2014/0182216 A1 7/2014 Panzarella et al.
2014/0182217 A1 7/2014 Yener et al.
2014/0186585 A1 7/2014 Field, III et al.
2014/0250797 A1 9/2014 Yener et al.
2014/0256238 A1 9/2014 Van et al.
2014/0287658 A1 9/2014 Flaschberger et al.
2014/0290147 A1 10/2014 Seth et al.
2014/0325917 A1 11/2014 Czerepinski et al.
2014/0345204 A1 11/2014 Wang et al.
2014/0345205 A1 11/2014 Kavanaugh et al.
2014/0352721 A1 12/2014 Gonzales et al.
2014/0352722 A1 12/2014 Gonzales et al.
2014/0357544 A1 12/2014 Gonzales et al.
2014/0378036 A1 12/2014 Cichowlas et al.
2015/0000209 A1 1/2015 Louapre et al.
2015/0000210 A1 1/2015 Breder et al.
2015/0007399 A1 1/2015 Gonzales et al.
2015/0007400 A1 1/2015 Gonzales et al.
2015/0068130 A1 3/2015 Louapre et al.
2015/0089881 A1 4/2015 Stevenson et al.
2015/0126098 A1 5/2015 Eilers et al.
2015/0128505 A1 5/2015 Wang et al.
2015/0183089 A1 7/2015 Iyengar et al.
2015/0209932 A1 7/2015 Lehuu et al.
2015/0218430 A1 8/2015 Yener et al.
2015/0232727 A1 8/2015 Erickson
2015/0267099 A1 9/2015 Panzarella et al.
2015/0291865 A1 10/2015 Breder et al.
2015/0291866 A1 10/2015 Arcona et al.
2015/0291867 A1 10/2015 Breder et al.
2015/0343603 A1 12/2015 Breder et al.
2016/0053151 A1 2/2016 Bauer et al.
2016/0090516 A1 3/2016 Yener et al.
2016/0107290 A1 4/2016 Bajaj et al.
2016/0177152 A1 6/2016 Braun
2016/0177153 A1 6/2016 Josseaux
2016/0177154 A1 6/2016 Josseaux et al.
2016/0186028 A1 6/2016 Louapre et al.
2016/0214903 A1 7/2016 Humpal et al.
2016/0289520 A1 10/2016 Bujnowski et al.
2016/0289521 A1 10/2016 Colet et al.
2016/0298013 A1 10/2016 Bock et al.
2016/0303704 A1 10/2016 Chou et al.
2016/0303705 A1 10/2016 Chou et al.
2016/0304760 A1 10/2016 Bock et al.
2016/0311081 A1 10/2016 Culler et al.
2016/0311084 A1 10/2016 Culler et al.
2016/0326416 A1 11/2016 Bauer et al.
2016/0340564 A1 11/2016 Louapre et al.

(56) References Cited

U.S. PATENT DOCUMENTS

2016/0354898 A1 12/2016 Nienaber et al.
2016/0362589 A1 12/2016 Bauer et al.
2016/0375556 A1 12/2016 Seth et al.
2017/0015886 A1 1/2017 Czerepinski et al.
2017/0028531 A1 2/2017 Gaeta et al.
2017/0050293 A1 2/2017 Gaeta et al.
2017/0066099 A1 3/2017 Nakamura
2017/0114260 A1 4/2017 Bock et al.
2017/0129075 A1 5/2017 Thurber et al.
2017/0145274 A1 5/2017 Yener et al.
2017/0158930 A1 6/2017 Iyengar
2017/0225299 A1 8/2017 Keipert et al.
2017/0247592 A1 8/2017 Bauer et al.
2017/0335155 A1 11/2017 Czerepinski et al.
2017/0335156 A1 11/2017 Bauer et al.
2017/0342303 A1 11/2017 Stevenson et al.
2017/0349797 A1 12/2017 Yener et al.
2018/0002584 A1 1/2018 Yener et al.
2018/0086957 A1 3/2018 Sahlin et al.
2018/0155592 A1 6/2018 Josseaux et al.
2018/0161960 A1 6/2018 Wilson et al.
2018/0169837 A1 6/2018 Liu
2018/0187057 A1 7/2018 Bujnowski et al.
2018/0215975 A1 8/2018 Marazano et al.
2018/0215976 A1 8/2018 Cotter et al.
2018/0237675 A1 8/2018 Yener et al.
2018/0318983 A1 11/2018 Wilson et al.
2018/0327644 A1 11/2018 Bauer et al.
2018/0370857 A1 12/2018 Marlin et al.
2019/0022826 A1 1/2019 Franke et al.
2019/0030684 A1 1/2019 Van et al.
2019/0091835 A1 3/2019 Culler et al.
2019/0119540 A1 4/2019 Colet et al.
2019/0126436 A1 5/2019 Westberg et al.
2019/0160630 A1 5/2019 Jiang et al.
2019/0217442 A1 7/2019 Gaeta et al.
2019/0217444 A1* 7/2019 Zhang ..... B24D 11/02
2019/0249052 A1 8/2019 Eckel et al.
2019/0270182 A1 9/2019 Eckel et al.
2019/0284461 A1 9/2019 Josseaux et al.
2019/0309201 A1 10/2019 Dumont et al.
2019/0322915 A1 10/2019 Jiwpanich et al.
2019/0330505 A1 10/2019 Bujnowski et al.
2019/0337124 A1 11/2019 Liu et al.
2019/0338172 A1 11/2019 Erickson et al.
2019/0338173 A1 11/2019 Yener et al.
2019/0351531 A1 11/2019 Nelson et al.
2019/0358776 A1 11/2019 Seth et al.
2019/0366511 A1 12/2019 Huber
2019/0382637 A1 12/2019 Braun et al.
2020/0139512 A1 5/2020 Culler et al.
2020/0148927 A1 5/2020 Arcona et al.
2020/0156215 A1 5/2020 Jusuf et al.
2020/0157396 A1 5/2020 Cotter et al.
2020/0157397 A1 5/2020 Stevenson et al.
2020/0199426 A1 6/2020 Yener et al.
2020/0262031 A1 8/2020 Seth et al.
2020/0308462 A1 10/2020 Bauer et al.
2020/0391354 A1 12/2020 Marazano et al.
2021/0024798 A1 1/2021 Czerepinski et al.
2021/0087444 A1 3/2021 Stevenson et al.
2021/0087445 A1 3/2021 Cotter et al.
2021/0108117 A1 4/2021 Bauer et al.
2021/0108118 A1 4/2021 Yener et al.
2021/0130667 A1 5/2021 Arcona et al.
2021/0197339 A1 7/2021 Marlin et al.
2021/0198544 A1 7/2021 Marlin et al.
2021/0198545 A1 7/2021 Marlin et al.
2021/0332278 A1 10/2021 Iyengar
2021/0395587 A1 12/2021 Yener et al.
2022/0001512 A1 1/2022 Gaeta et al.
2022/0025237 A1 1/2022 Sahlin et al.
2023/0061952 A1 3/2023 Lentz et al.
2023/0065541 A1 3/2023 Colet et al.
2023/0096577 A1 3/2023 Cotter et al.
2023/0135441 A1 5/2023 Seth et al.
2023/0193100 A1 6/2023 Josseaux et al.
2023/0211466 A1 7/2023 Martone et al.
2023/0211467 A1* 7/2023 Martone ..... B24D 11/001
451/539
2023/0211468 A1 7/2023 Martone et al.
2023/0220255 A1 7/2023 Yuyang et al.
2023/0220256 A1 7/2023 Bujnowski et al.
2023/0265326 A1 8/2023 Adefris
2023/0272254 A1 8/2023 Yener et al.
2023/0294247 A1 9/2023 Liu et al.
2023/0332030 A1 10/2023 Bauer et al.
2023/0357617 A9 11/2023 Yener et al.
2024/0116153 A1 4/2024 Martone et al.
2024/0123574 A1 4/2024 Martone et al.
2024/0141219 A1 5/2024 Bauer et al.
2024/0198488 A1 6/2024 Marlin et al.

FOREIGN PATENT DOCUMENTS

CH 685051 A5 3/1995
CN 1229007 A 7/2005
CN 1774488 A 5/2006
CN 101389466 A 3/2009
CN 101970347 A 2/2011
CN 101980836 A 2/2011
CN 102281992 A 12/2011
CN 103189164 A 7/2013
CN 103842132 A 6/2014
CN 102123837 B 7/2014
CN 104125875 A 10/2014
CN 104994995 A 10/2015
CN 105622071 A 6/2016
CN 105713568 A 6/2016
DE 3923671 C2 2/1998
DE 102012023688 A1 4/2014
DE 202014101739 U1 6/2014
DE 202014101741 U1 6/2014
DE 102013202204 A1 8/2014
DE 102013210158 A1 12/2014
DE 102013210716 A1 12/2014
DE 102013212598 A1 12/2014
DE 102013212622 A1 12/2014
DE 102013212634 A1 12/2014
DE 102013212639 A1 12/2014
DE 102013212644 A1 12/2014
DE 102013212653 A1 12/2014
DE 102013212654 A1 12/2014
DE 102013212661 A1 12/2014
DE 102013212666 A1 12/2014
DE 102013212677 A1 12/2014
DE 102013212680 A1 12/2014
DE 102013212687 A1 12/2014
DE 102013212690 A1 12/2014
DE 102013212700 A1 12/2014
DE 102014210836 A1 12/2014
EP 0078896 A2 5/1983
EP 0152768 A2 8/1985
EP 0293163 A2 11/1988
EP 0480133 A2 4/1992
EP 0652919 A1 5/1995
EP 0662110 A1 7/1995
EP 0500369 B1 1/1996
EP 0609864 B1 11/1996
EP 0771769 5/1997
EP 0812456 B1 12/1997
EP 0651778 B1 5/1998
EP 0614861 B1 5/2001
EP 0931032 B1 7/2001
EP 0833803 8/2001
EP 1207015 A2 5/2002
EP 1356152 A2 10/2003
EP 1371451 A1 12/2003
EP 1383631 A1 1/2004
EP 1015181 B1 3/2004
EP 1492845 A1 1/2005
EP 1851007 11/2007
EP 1960157 A1 8/2008
EP 2176031 A1 4/2010

(56) References Cited

FOREIGN PATENT DOCUMENTS

| | | | |
|---|---|---|---|
| EP | 2184134 | A1 | 5/2010 |
| EP | 2242618 | A2 | 10/2010 |
| EP | 2390056 | A2 | 11/2011 |
| EP | 1800801 | B1 | 3/2012 |
| EP | 2445982 | A2 | 5/2012 |
| EP | 2507016 | A2 | 10/2012 |
| EP | 2537917 | A1 | 12/2012 |
| EP | 2567784 | A1 | 3/2013 |
| EP | 2631286 | A1 | 8/2013 |
| EP | 2692813 | A1 | 2/2014 |
| EP | 2692814 | A1 | 2/2014 |
| EP | 2692815 | A1 | 2/2014 |
| EP | 2692816 | A1 | 2/2014 |
| EP | 2692817 | A1 | 2/2014 |
| EP | 2692818 | A1 | 2/2014 |
| EP | 2692819 | A1 | 2/2014 |
| EP | 2692820 | A1 | 2/2014 |
| EP | 2692821 | A1 | 2/2014 |
| EP | 2719752 | A1 | 4/2014 |
| EP | 2012972 | B1 | 6/2014 |
| EP | 2720676 | B1 | 1/2018 |
| EP | 3319758 | A1 | 5/2018 |
| EP | 3342839 | A1 | 7/2018 |
| EP | 3444313 | B1 | 7/2020 |
| EP | 3830211 | A1 | 6/2021 |
| FR | 2354373 | A1 | 1/1978 |
| GB | 986847 | A | 3/1965 |
| GB | 1456765 | A | 11/1976 |
| GB | 1466054 | | 3/1977 |
| JP | 53064890 | A | 6/1978 |
| JP | 60-006356 | U | 1/1985 |
| JP | 62002946 | B | 1/1987 |
| JP | 63036905 | B | 7/1988 |
| JP | 03079277 | A | 4/1991 |
| JP | 03-287687 | | 12/1991 |
| JP | 05285833 | A | 11/1993 |
| JP | 06114739 | A | 4/1994 |
| JP | 07008474 | B2 | 2/1995 |
| JP | 3030861 | U | 8/1996 |
| JP | 10113875 | A | 5/1998 |
| JP | 2779252 | B2 | 7/1998 |
| JP | 10330734 | A | 12/1998 |
| JP | H10315142 | A | 12/1998 |
| JP | 2957492 | B2 | 10/1999 |
| JP | 2000091280 | A | 3/2000 |
| JP | 2000-336344 | A | 12/2000 |
| JP | 2000354967 | A | 12/2000 |
| JP | 3160084 | B2 | 4/2001 |
| JP | 2001162541 | A | 6/2001 |
| JP | 3194269 | B2 | 7/2001 |
| JP | 2001180930 | A | 7/2001 |
| JP | 2001207160 | A | 7/2001 |
| JP | 2001516652 | A | 10/2001 |
| JP | 2002-038131 | A | 2/2002 |
| JP | 2002210659 | A | 7/2002 |
| JP | 2003-049158 | A | 2/2003 |
| JP | 2004-510873 | A | 4/2004 |
| JP | 2004209624 | A | 7/2004 |
| JP | 2006130586 | A | 5/2006 |
| JP | 2006130636 | A | 5/2006 |
| JP | 2006159402 | A | 6/2006 |
| JP | 2006-192540 | A | 7/2006 |
| JP | 2006224201 | A | 8/2006 |
| JP | 2007-537891 | A | 12/2007 |
| JP | 2008132560 | A | 6/2008 |
| JP | 2008194761 | A | 8/2008 |
| JP | 2008531305 | A | 8/2008 |
| JP | 2012512046 | A | 5/2012 |
| JP | 2012512047 | A | 5/2012 |
| JP | 2012512048 | A | 5/2012 |
| JP | 2012530615 | A | 12/2012 |
| JP | 5238725 | B2 | 7/2013 |
| JP | 5238726 | B2 | 7/2013 |
| JP | 2014503367 | A | 2/2014 |
| JP | 2017518889 | A | 7/2017 |
| JP | 2017538588 | A | 12/2017 |
| JP | 2018510073 | A | 4/2018 |
| KR | 1019890014409 | A | 10/1989 |
| KR | 1020020042840 | A | 6/2002 |
| KR | 20140106713 | A | 9/2014 |
| NL | 171464 | B1 | 11/1982 |
| WO | 94/02559 | A1 | 2/1994 |
| WO | 95/03370 | | 2/1995 |
| WO | 1995016756 | A1 | 6/1995 |
| WO | 1995017287 | A1 | 6/1995 |
| WO | 95/18192 | A1 | 7/1995 |
| WO | 95/20469 | A1 | 8/1995 |
| WO | 1996012776 | A1 | 5/1996 |
| WO | 1996014964 | A1 | 5/1996 |
| WO | 96/27189 | A1 | 9/1996 |
| WO | 9711484 | A1 | 3/1997 |
| WO | 97/14536 | A1 | 4/1997 |
| WO | 99/06500 | A1 | 2/1999 |
| WO | 99/14016 | A1 | 3/1999 |
| WO | 99/38817 | A1 | 8/1999 |
| WO | 1999038817 | A1 | 8/1999 |
| WO | 99/54424 | A1 | 10/1999 |
| WO | 0064630 | A1 | 11/2000 |
| WO | 0114494 | A1 | 3/2001 |
| WO | 0123323 | A1 | 4/2001 |
| WO | 02097150 | A2 | 12/2002 |
| WO | 03087236 | A1 | 10/2003 |
| WO | 2005080624 | A1 | 9/2005 |
| WO | 2005112601 | A2 | 12/2005 |
| WO | 2006027593 | A3 | 3/2006 |
| WO | 2006062597 | A1 | 6/2006 |
| WO | 2007041538 | A1 | 4/2007 |
| WO | 2009085578 | A2 | 7/2009 |
| WO | 2009085841 | A2 | 7/2009 |
| WO | 2009098017 | A1 | 8/2009 |
| WO | 2010077509 | A1 | 7/2010 |
| WO | 2010085587 | A1 | 7/2010 |
| WO | 2010118440 | A2 | 10/2010 |
| WO | 2010151201 | A1 | 12/2010 |
| WO | 2011005425 | A2 | 1/2011 |
| WO | 2011019188 | A1 | 2/2011 |
| WO | 2011068714 | A2 | 6/2011 |
| WO | 2011068724 | A2 | 6/2011 |
| WO | 2011087649 | A2 | 7/2011 |
| WO | 2011109188 | A2 | 9/2011 |
| WO | 2011133438 | A1 | 10/2011 |
| WO | 2011139562 | A2 | 11/2011 |
| WO | 2011149625 | A2 | 12/2011 |
| WO | 2012018903 | A2 | 2/2012 |
| WO | 2012061016 | A1 | 5/2012 |
| WO | 2012061033 | A2 | 5/2012 |
| WO | 2012092590 | A2 | 7/2012 |
| WO | 2012092605 | A3 | 7/2012 |
| WO | 2010070294 | A1 | 8/2012 |
| WO | 2012112305 | A2 | 8/2012 |
| WO | 2012112322 | A2 | 8/2012 |
| WO | 2012092590 | A3 | 10/2012 |
| WO | 2012140617 | A1 | 10/2012 |
| WO | 2012141905 | A2 | 10/2012 |
| WO | 2013003830 | A2 | 1/2013 |
| WO | 2013003831 | A2 | 1/2013 |
| WO | 2013009484 | A2 | 1/2013 |
| WO | 2013036402 | A1 | 3/2013 |
| WO | 2013040423 | A2 | 3/2013 |
| WO | 2013045251 | A1 | 4/2013 |
| WO | 2013049239 | A1 | 4/2013 |
| WO | 2013070576 | A2 | 5/2013 |
| WO | 2013101575 | A1 | 7/2013 |
| WO | 2013102170 | A1 | 7/2013 |
| WO | 2013102176 | A1 | 7/2013 |
| WO | 2013102177 | A1 | 7/2013 |
| WO | 2013106597 | A1 | 7/2013 |
| WO | 2013106602 | A1 | 7/2013 |
| WO | 2013149209 | A1 | 10/2013 |
| WO | 2013151745 | A1 | 10/2013 |
| WO | 2013177446 | A1 | 11/2013 |
| WO | 2013186146 | A1 | 12/2013 |
| WO | 2013188038 | A1 | 12/2013 |
| WO | 2014005120 | A1 | 1/2014 |

(56) References Cited

FOREIGN PATENT DOCUMENTS

| | | | |
|---|---|---|---|
| WO | 2014020068 | A1 | 2/2014 |
| WO | 2014020075 | A1 | 2/2014 |
| WO | 2014022453 | A1 | 2/2014 |
| WO | 2014022462 | A1 | 2/2014 |
| WO | 2014022465 | A1 | 2/2014 |
| WO | 2014161001 | A1 | 2/2014 |
| WO | 2014057273 | A1 | 4/2014 |
| WO | 2014062701 | A1 | 4/2014 |
| WO | 2014070468 | A1 | 5/2014 |
| WO | 2014106173 | A1 | 7/2014 |
| WO | 2014106211 | A1 | 7/2014 |
| WO | 2014124554 | A1 | 8/2014 |
| WO | 2014137972 | A1 | 9/2014 |
| WO | 2014140689 | A1 | 9/2014 |
| WO | 2014165390 | A1 | 10/2014 |
| WO | 2014176108 | A1 | 10/2014 |
| WO | 2014206739 | A1 | 12/2014 |
| WO | 2014206890 | A1 | 12/2014 |
| WO | 2014206967 | A1 | 12/2014 |
| WO | 2014209567 | A1 | 12/2014 |
| WO | 2014210160 | A1 | 12/2014 |
| WO | 2014210442 | A1 | 12/2014 |
| WO | 2014210532 | A1 | 12/2014 |
| WO | 2014210568 | A1 | 12/2014 |
| WO | 2015050781 | A1 | 4/2015 |
| WO | 2015073346 | A1 | 5/2015 |
| WO | 2015048768 | A9 | 6/2015 |
| WO | 2015088953 | A1 | 6/2015 |
| WO | 2015089527 | A1 | 6/2015 |
| WO | 2015089528 | A1 | 6/2015 |
| WO | 2015089529 | A1 | 6/2015 |
| WO | 2015100018 | A1 | 7/2015 |
| WO | 2015100020 | A1 | 7/2015 |
| WO | 2015100220 | A1 | 7/2015 |
| WO | 2015102992 | A1 | 7/2015 |
| WO | 2015112379 | A1 | 7/2015 |
| WO | 2015130487 | A1 | 9/2015 |
| WO | 2015143461 | A1 | 10/2015 |
| WO | 2015158009 | A1 | 10/2015 |
| WO | 2015160854 | A1 | 10/2015 |
| WO | 2015160855 | A1 | 10/2015 |
| WO | 2015160857 | A1 | 10/2015 |
| WO | 2015164211 | A1 | 10/2015 |
| WO | 2015165122 | A1 | 11/2015 |
| WO | 2015167910 | A1 | 11/2015 |
| WO | 2015179335 | A1 | 11/2015 |
| WO | 2015180005 | A1 | 12/2015 |
| WO | 2015184355 | A1 | 12/2015 |
| WO | 2016028683 | A1 | 2/2016 |
| WO | 2016044158 | A1 | 3/2016 |
| WO | 2016064726 | A1 | 4/2016 |
| WO | 2016089675 | A1 | 6/2016 |
| WO | 2016105469 | A1 | 6/2016 |
| WO | 2016105474 | A1 | 6/2016 |
| WO | 2016160357 | A1 | 10/2016 |
| WO | 2016161157 | A1 | 10/2016 |
| WO | 2016161170 | A1 | 10/2016 |
| WO | 2016167967 | A1 | 10/2016 |
| WO | 2016187570 | A1 | 11/2016 |
| WO | 2016196795 | A1 | 12/2016 |
| WO | 2016201104 | A1 | 12/2016 |
| WO | 2016205133 | A1 | 12/2016 |
| WO | 2016205267 | A1 | 12/2016 |
| WO | 2016210057 | A1 | 12/2016 |
| WO | 2017007703 | A1 | 1/2017 |
| WO | 2017007714 | A1 | 1/2017 |
| WO | 2017062482 | A1 | 4/2017 |
| WO | 2017083249 | A1 | 5/2017 |
| WO | 2017083255 | A1 | 5/2017 |
| WO | 2016105543 | A9 | 9/2017 |
| WO | 2017151498 | A1 | 9/2017 |
| WO | 2017197002 | A1 | 11/2017 |
| WO | 2017197006 | A1 | 11/2017 |
| WO | 2018010730 | A2 | 1/2018 |
| WO | 2018026669 | A1 | 2/2018 |
| WO | 2018057465 | A1 | 3/2018 |
| WO | 2018057558 | A1 | 3/2018 |
| WO | 2018063902 | A1 | 4/2018 |
| WO | 2018063958 | A1 | 4/2018 |
| WO | 2018063960 | A1 | 4/2018 |
| WO | 2018063962 | A1 | 4/2018 |
| WO | 2018064642 | A1 | 4/2018 |
| WO | 2018080703 | A1 | 5/2018 |
| WO | 2018080704 | A1 | 5/2018 |
| WO | 2018080705 | A1 | 5/2018 |
| WO | 2018080755 | A1 | 5/2018 |
| WO | 2018080756 | A1 | 5/2018 |
| WO | 2018080765 | A1 | 5/2018 |
| WO | 2018080778 | A1 | 5/2018 |
| WO | 2018080784 | A1 | 5/2018 |
| WO | 2018081246 | A1 | 5/2018 |
| WO | 2018118688 | A1 | 6/2018 |
| WO | 2018118690 | A1 | 6/2018 |
| WO | 2018118695 | A1 | 6/2018 |
| WO | 2018118699 | A1 | 6/2018 |
| WO | 2018134732 | A1 | 7/2018 |
| WO | 2018136268 | A1 | 7/2018 |
| WO | 2018136269 | A1 | 7/2018 |
| WO | 2018136271 | A1 | 7/2018 |
| WO | 2018172193 | A1 | 9/2018 |
| WO | 2018207145 | A1 | 11/2018 |
| WO | 2018226912 | A1 | 12/2018 |
| WO | 2018236989 | A1 | 12/2018 |
| WO | 2019001908 | A1 | 1/2019 |
| WO | 2019069157 | A1 | 4/2019 |
| WO | 2019102312 | A1 | 5/2019 |
| WO | 2019102328 | A1 | 5/2019 |
| WO | 2019102329 | A1 | 5/2019 |
| WO | 2019102330 | A1 | 5/2019 |
| WO | 2019102331 | A1 | 5/2019 |
| WO | 2019108805 | A2 | 6/2019 |
| WO | 2021161129 | A1 | 8/2019 |
| WO | 2019167022 | A1 | 9/2019 |
| WO | 2019197948 | A1 | 10/2019 |
| WO | 2019207415 | A1 | 10/2019 |
| WO | 2019207416 | A1 | 10/2019 |
| WO | 2019207417 | A1 | 10/2019 |
| WO | 2019207423 | A1 | 10/2019 |
| WO | 2019215571 | A1 | 11/2019 |
| WO | 2020025270 | A1 | 2/2020 |
| WO | 2020035764 | A1 | 2/2020 |
| WO | 2020075005 | A1 | 4/2020 |
| WO | 2020079522 | A1 | 4/2020 |
| WO | 2020084382 | A1 | 4/2020 |
| WO | 2020084483 | A1 | 4/2020 |
| WO | 2020089741 | A1 | 5/2020 |
| WO | 2020115685 | A1 | 6/2020 |
| WO | 2020128708 | A1 | 6/2020 |
| WO | 2020128716 | A1 | 6/2020 |
| WO | 2020128717 | A1 | 6/2020 |
| WO | 2020128719 | A1 | 6/2020 |
| WO | 2020128720 | A2 | 6/2020 |
| WO | 2020128752 | A1 | 6/2020 |
| WO | 2020128779 | A2 | 6/2020 |
| WO | 2020128780 | A1 | 6/2020 |
| WO | 2020128781 | A1 | 6/2020 |
| WO | 2020128783 | A1 | 6/2020 |
| WO | 2020128787 | A1 | 6/2020 |
| WO | 2020128794 | A1 | 6/2020 |
| WO | 2020128833 | A1 | 6/2020 |
| WO | 2020128838 | A1 | 6/2020 |
| WO | 2020128842 | A1 | 6/2020 |
| WO | 2020128844 | A1 | 6/2020 |
| WO | 2020128845 | A1 | 6/2020 |
| WO | 2020128852 | A1 | 6/2020 |
| WO | 2020128853 | A1 | 6/2020 |
| WO | 2020128856 | A1 | 6/2020 |
| WO | 2020212788 | A1 | 10/2020 |
| WO | 2021009600 | A1 | 1/2021 |
| WO | 2021014271 | A1 | 1/2021 |
| WO | 2021074756 | A1 | 4/2021 |
| WO | 2021074768 | A1 | 4/2021 |
| WO | 2021079331 | A1 | 4/2021 |
| WO | 2021081571 | A1 | 5/2021 |

(56) References Cited

FOREIGN PATENT DOCUMENTS

| | | | |
|---|---|---|---|
| WO | 2021105030 | A1 | 6/2021 |
| WO | 2021116883 | A1 | 6/2021 |
| WO | 2021133876 | A1 | 7/2021 |
| WO | 2021133888 | A1 | 7/2021 |
| WO | 2021133901 | A1 | 7/2021 |
| WO | 2021137092 | A1 | 7/2021 |
| WO | 2021179025 | A1 | 9/2021 |
| WO | 2021186326 | A1 | 9/2021 |
| WO | 2021214576 | A1 | 10/2021 |
| WO | 2021214605 | A1 | 10/2021 |
| WO | 2021234540 | A1 | 11/2021 |
| WO | 2022022905 | A1 | 2/2022 |
| WO | 2022022906 | A1 | 2/2022 |
| WO | 2022229744 | A1 | 11/2022 |
| WO | 2023130051 | A1 | 7/2023 |
| WO | 2023130052 | A1 | 7/2023 |
| WO | 2023130053 | A1 | 7/2023 |
| WO | 2023209518 | A1 | 11/2023 |
| WO | 2024127255 | A1 | 6/2024 |

OTHER PUBLICATIONS

Austin, Benson M., "Thick-Film Screen Printing," Solid State Technology, Jun. 1969, pp. 53-58.
Avril, Nicolas Joseph "Manufacturing Glass-Fiber Reinforcement for Grinding Wheels" Massachusetts Institute of Technology, Feb. 1996, 105 pages.
Bacher, Rudolph J., "High Resolution Thick Film Printing," E.I. du Pont de Nemours & Company, Inc., Proceedings of the International Symposium on Microelectronics, 1986, pp. 576-581.
Besse, John R., "Understanding and controlling wheel truing and dressing forces when rotary plunge dressing," Cutting Tool Engineering, Jun. 2012, vol. 64, Issue 6, 4 pages.
Ciccotti, M. et al., "Complex dynamics in the peeling of an adhesive tape," International Journal of Adhesion & Adhesives 24 (2004) pp. 143-151.
Dupont, "Kevlar Aramid Pulp", Copyright 2011, DuPont, Accessed: Sep. 18, 2013, 2 pages.
Wu, J. et al., "Friction and Wear Properties of Kevlar Pulp Reinforced Epoxy Composite under Dry Sliding Condition", Tribology Letters, vol. 22, No. 3, Jun. 2006, pp. 259-263, Abstract only.
J. European Ceramic Society 31 (2011) 2073-2081, Abstract only.
Riemer, Dietrich E., "Analytical Engineering Model of the Screen Printing Process: Part II," Solid State Technology, Sep. 1988, pp. 85-90.
Miller, L.F., "Paste Transfer in the Screening Process," Solid State Technology, Jun. 1969, pp. 46-52.
Morgan, P. et al., "Ceramic Composites of Monazite and Alumina," J. Am. Ceram. Soc., 78, 1995, 1553-63.
Riemer, Dietrich E., "Analytical Engineering Model of the Screen Printing Process: Part I," Solid State Technology, Aug. 1988, pp. 107-111.
Winter Catalogue No. 5, Dressing tools, Winter diamond tools for dressing grinding wheels, Edition Year: 2010, 140 pages.
Badger, Jeffrey, "Evaluation of Triangular, Engineered-Shape Ceramic Abrasive in Cutting Discs," Supplement to the Welding Journal, Apr. 2014, vol. 93, pp. 107-s to 115-s.
3M Cubitron II Abrasive Belts Brochure, Shaping the Future, Jan. 2011, 6 pages.
Vanstrum et al., Precisely Shaped Grain (PSG): 3M's Innovation in Abrasive Grain Technology, date unknown, 1 page.
Graf, "Cubitron II: Precision-Shaped Grain (PSG) Turns the Concept of Gear Grinding Upside Down," gearsolutions.com, May 2014, pp. 36-44.
Dow Machine Tool Accessories, Grinding & Surface Finishing, www.1mta.com, Nov. 2014, 72 pages.
VSM Actirox Fibre Discs, The Latest Generation of Abrasives for Maximum Stock Removal [PDF] VSM Abrasives Ltd., Apr. 2019 [retrieved on May 15, 2019], 8 pages. Retrieved from https://uk.vsmabrasives.com/fileadmin/user_upload/ACTIROX/VSM-ACTIROX-EN.pdf.
Kumar et al., "Composites by rapid prototyping technology", Material & Design, Feb. 2010, vol. 31, Issue 2, pp. 850-856.
Lewis et al., "Direct Ink Writing of Three-Dimensional Ceramic Structures", Journal of the American Ceramic Society, US, Nov. 30, 2006, vol. 89, Issue 12, pp. 3599-3609.
International Search Report with regard to International application No. PCT/US2017/031998, dated Aug. 21, 2017.
International Search Report with regard to International application No. PCT/US2017/031992, dated Aug. 21, 2017.
International Search Report and Written Opinion for Application No. PCT/US2016/036701, dated Sep. 1, 2016, 12 pages.
Brewer, L. et al., Journal of Materials Research, 1999, vol. 14, No. 10, pp. 3907-3912, Abstract only.
Lewis et al., "Direct Ink Writing of 3D Functional Materials", Advanced Functional Materials, 2006, 16, pp. 2193-2204.
International Search Report and Written Opinion for Application No. PCT/US2020/066817, mailed Apr. 15, 2021, 11 pages.
International Search Report and Written Opinion for Application No. PCT/US2014/058378, mailed Jan. 29, 2015, 18 pages.
International Search Report and Written Opinion for Application No. PCT/US2015/025825) mailed Jul. 16, 2015, 13 pages.
International Search Report and Written Opinion for PCT/US2022/082599 dated Apr. 25, 2023, 12 pages.

* cited by examiner

ABRASIVE ARTICLES AND METHODS OF FORMING SAME

CROSS-REFERENCE TO RELATED APPLICATION(S)

This application is a continuation application of and claims priority under 35 U.S.C. § 120 to U.S. patent application Ser. No. 18/148,403, entitled "ABRASIVE ARTICLES AND METHODS OF FORMING SAME," by Anthony MARTONE et al., filed Dec. 29, 2022, which claims priority under 35 U.S.C. § 119(e) to U.S. Provisional Patent Application No. 63/266,269, entitled "ABRASIVE ARTICLES AND METHODS OF FORMING SAME," by Anthony MARTONE et al., filed Dec. 30, 2021, both of which are assigned to the current assignees hereof and incorporated herein by reference in their entirety.

BACKGROUND

Field of the Disclosure

The following is directed to abrasive articles, and, in particular, coated abrasive articles and methods of forming coated abrasive articles.

SUMMARY

According to one aspect, an abrasive article includes a backing; a make coat overlying the backing; and a plurality of abrasive particles overlying the backing and at least partially contained in the make coat; and a make coat thickness ratio (Tg/Ta) of not greater than 1.5, wherein Tg is the average thickness of the make coat at the sides of the abrasive particles and the Ta is the average thickness of the make coat.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is directed to methods of forming abrasive articles, such as fixed abrasive articles, and more particularly, coated abrasive articles. The abrasive articles may be used in a variety of material removal operations for a variety of work pieces.

Figure 1:
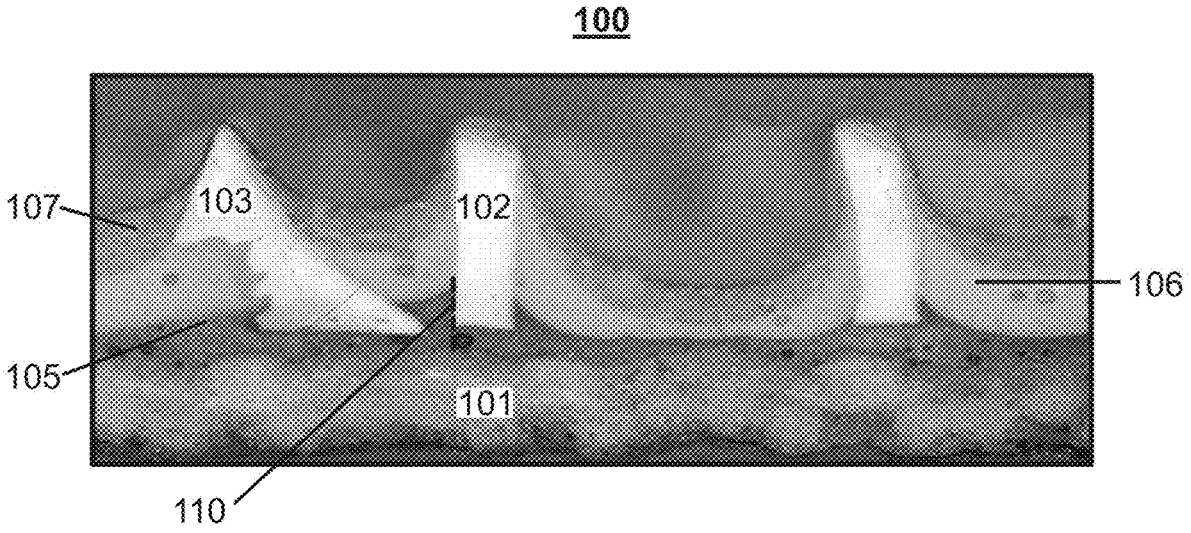
FIG. 1 includes a cross sectional image of a section of an abrasive article according to an embodiment.

FIG. 1 includes an image of a coated abrasive article 100 according to an embodiment. As shown in FIG. 1, the coated abrasive article 100 can include a backing 101. The coated abrasive article 100 can also include an adhesive layer such as make coat 105 overlying the backing. The coated abrasive article 100 can further include a plurality of abrasive particles 102 and 103. The coated abrasive article can also include a size coat 106 and a super size coat 107. The make coat 105 can have an average thickness, Ta. The make coat 105 can also include an average thickness at the sides of the abrasive particles, Tg. An example make coat thickness at the side of the abrasive particles can be seen as dotted line 110 in FIG. 1.

In an embodiment, the make coat can comprise a particular material that may facilitate improved manufacturing or performance of the abrasive article. In an embodiment, the make coat can include Wollastonite, PF resin, water, or a combination thereof.

In an embodiment, the make coat can have a particular viscosity that may facilitate improved manufacturing or performance of the abrasive article. In an embodiment, the viscosity can be at least 3500 cps or at least 3750 cps or at least 4000 cps or at least 4250 cps or at least 4500 cps or at least 4750 cps or at least 5000 cps or at least 5250 cps. In an embodiment, the viscosity can be no greater than 7000 cps or no greater than 6750 cps or no greater than 6500 cps or no greater than 6250 cps or no greater than 6000 cps or no greater than 5750. It will be appreciated that the make coat viscosity can be between any of the above mentioned minimum and maximum values noted above, including, for example, but not limited to, at least 3500 cps and not greater than 7000 cps or at least 5000 cps and not greater than 6000 cps.

Figure 10:
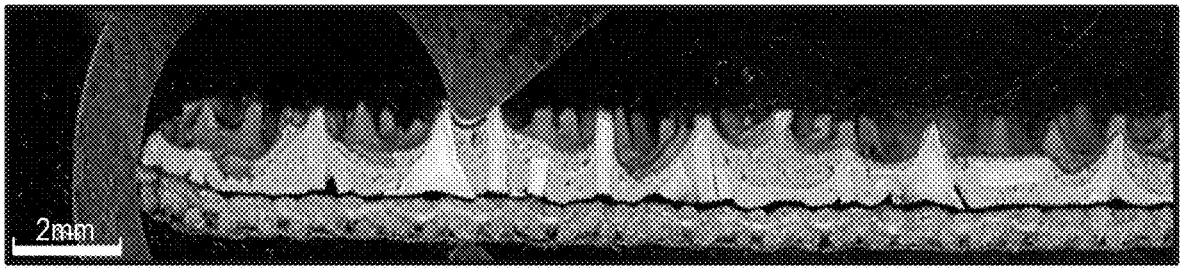
FIG. 10 includes an image of an abrasive article with a colored make layer.

Average make coat thickness can be measured according to the following procedure. Abrasive articles are cut through the middle to reveal a cross section. The articles are then cut into 2-inch segments and mounted on an epoxy puck. Two 2-inch segments are then imaged, and the make layer is identified by coloring in the layer using the imaging software. FIG. 10 includes an example image of an abrasive article include a colored make layer. Image analysis is used to overlay vertical gridlines, and the line segments overlapping the make layer are identified and isolated. Each line segment corresponds to a make coat thickness measurement. The average of all segments is taken. Approximately 150-200 overlapping line segments were made per two-inch sample segment, resulting in over 300 measurements for each sample.

Average make coat thickness near standing grains can be measured according to the following procedure. The same cross-sectional images for average make coat thickness can also be used for average make coat thickness near standing grains. Only standing grains showing their cross-sectional rectangular area with their short side in contact with the make coat are considered. For example, in FIG. 1, grain 102 would be considered but grain 103 would not. Additionally, only isolated grains were considered. Standing grains in contact with another grain were not considered for average make coat thickness near standing grains measurements. Measurements were made from the highest point of make contacting the grain side down to the lowest point of make contacting the backing on both sides of grain. The line of measurement is made perpendicular to the backing plane.

In an embodiment, the coated abrasive article can have a make coat of a particular average thickness that may facilitate improved performance and/or manufacturing of the abrasive article. In an embodiment, the average thickness of the make coat, Ta, can be at least 50 microns or at least 60 microns or at least 70 microns or at least 80 microns or at least 90 microns or at least 100 microns or at least 110 microns or at least 120 microns or at least 130 microns or at least 140 microns or at least 150 microns or at least 160 microns. In another embodiment, the average thickness of the make coat, Ta, can be not greater than 1 mm or not greater than 800 microns or not greater than 700 microns or not greater than 600 microns or not greater than 500 microns or not greater than 400 microns or not greater than 300 microns or not greater than 275 microns or not greater than 250 microns or not greater than 225 microns or not greater than 200 microns. It will be appreciated that Ta can be between any of the minimum and maximum values noted above, including, for example, but not limited to, at least 50 microns, and no greater than 800 microns, or at least 80 microns and no greater than 300 microns.

In an embodiment, the coated abrasive article can have a make coat of a particular average thickness at the sides of the abrasive particles, Tg, that may facilitate improved performance and/or manufacturing of the abrasive article. In an embodiment, Tg can be at least 50 microns or at least 60 microns or at least 70 microns or at least 80 microns or at least 90 microns or at least 100 microns or at least 110 microns or at least 120 microns or at least 130 microns or at least 140 microns or at least 150 microns. In another embodiment, Tg can be not greater than 1 mm or not greater than 800 microns or not greater than 700 microns or not greater than 600 microns or not greater than 500 microns or not greater than 400 microns or not greater than 300 microns. It will be appreciated that Tg can be between any of the minimum and maximum values noted above, including, for example, but not limited to, at least 50 microns, and no greater than 800 microns, or at least 80 microns and no greater than 300 microns.

In an embodiment, the coated abrasive article can have a make coat of a particular thickness standard deviation at the sides of the abrasive particles, STDTg, that may facilitate improved performance and/or manufacturing of the abrasive article. In an embodiment, STDTg can be at least 1 micron or at least 5 microns or at least 10 microns or at least 15 microns or at least 20 microns or at least 25 microns or at least 30 microns. In another embodiment, STDTg can be not greater than 100 microns or not greater than 90 microns or not greater than 85 microns or not greater than 80 microns or not greater than 75 microns or not greater than 70 microns or not greater than 65 microns or not greater than 60 microns or not greater than 55 microns or not greater than 50 microns or not greater than 45 microns or not greater than 40 microns or not greater than 35 microns or not greater than 30 microns. It will be appreciated that STDTg can be between any of the minimum and maximum values noted above, including, for example, but not limited to, at least 5 microns, and no greater than 100 microns, or at least 10 microns and no greater than 45 microns.

In an embodiment, the coated abrasive article can have a make coat of a particular thickness ratio, Tg/Ta, that may facilitate improved performance and/or manufacturing of the abrasive article. In an embodiment, Tg/Ta can be not greater than 1.45 or not greater than 1.43 or not greater than 1.40 or not greater than 1.38 or not greater than 1.35 or not greater than 1.33 or not greater than 1.30 or not greater than 1.28 or not greater than 1.25 or not greater than 1.23 or not greater than 1.20 or not greater than 1.18 or not greater than 1.15 or not greater than 1.13 or not greater than 1.10 or not greater than 1.08 or not greater than 1.05 or not greater than 1.03. In another embodiment, Tg/Ta can be at least 0.70 or at least 0.80 or at least 0.90 or at least 0.98 or at least 1.00 or at least 1.03 or at least 1.05 or at least 1.08. It will be appreciated that Tg/Ta can be between any of the minimum and maximum values noted above, including, for example, but not limited to, at least 0.8, and no greater than 1.45, or at least 0.98 and no greater than 1.20.

Figure 2A:
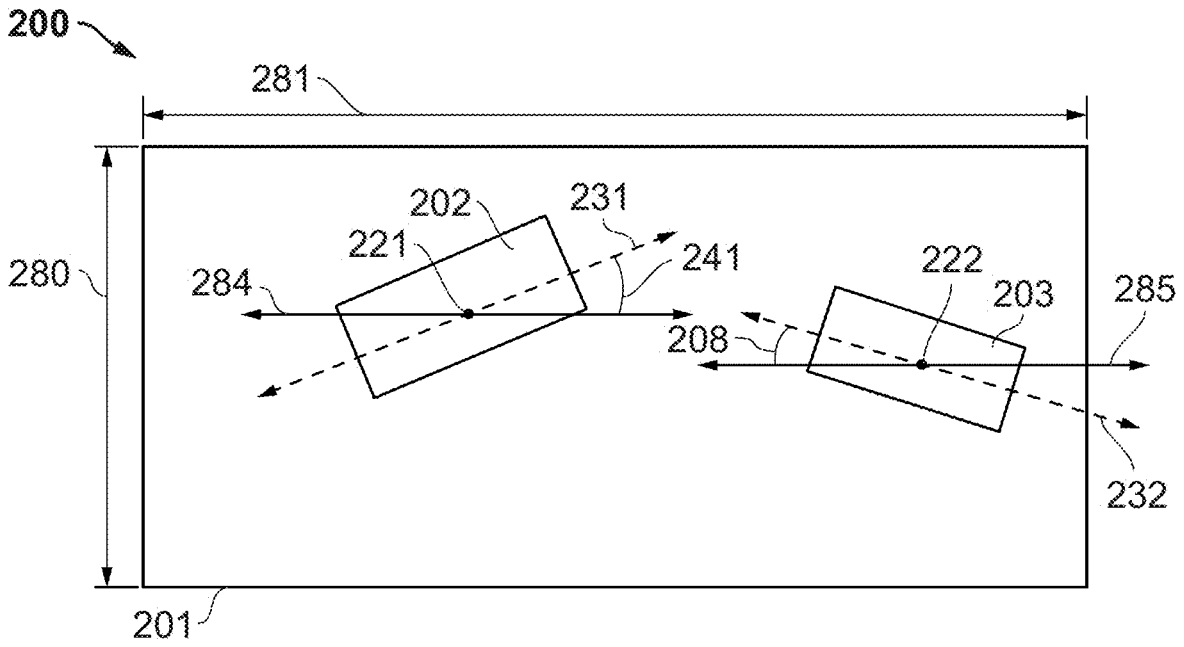
FIG. 2A includes a top-view illustration of a portion of a coated abrasive article according to an embodiment.
Figure 2B:
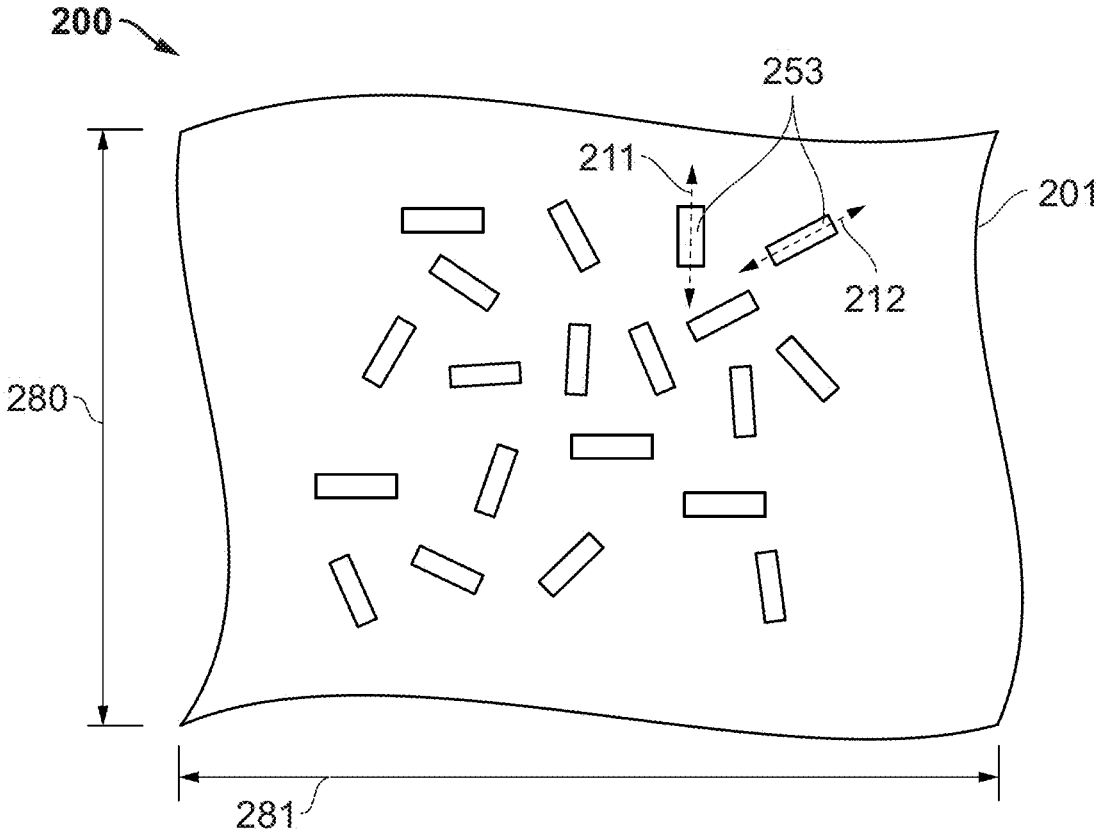
FIG. 2B includes a top-view illustration of a portion of a coated abrasive article according to an embodiment.

FIG. 2A includes an illustration of a portion of a coated abrasive article 200 according to an embodiment. As shown in FIG. 2, the coated abrasive article 200 can include a backing 201 having a longitudinal axis 280 and a lateral axis 281. The abrasive article 200 can include a backing 201 having a major surface and an abrasive layer forming an abrasive surface overlying the major surface of the backing. The abrasive layer can form a single layer of abrasive particles 202 and 203 adhered to the major surface of the backing. FIG. 2B also includes an illustration of a portion of a coated abrasive with abrasive particles 202 and 203.

In an embodiment, the abrasive particles may have a random rotational orientation relative to each other. The randomness of the rotational orientation is evaluated by creating a histogram or distribution of measured orientations from randomly sampled areas from a given abrasive article. The process for measuring the rotational orientation of particles on a substrate is started by obtaining a coated abrasive sample that does not include overlying layers on the particles or cleaning the coated abrasive sample to expose the particles, such that the particles are clearly visible. If a coated abrasive article includes layers overlying the particles (e.g., size coat, supersize coat, etc.) a gentle sandblasting operation can be conducted to selectively remove the overlying layers and expose the underlying abrasive particles. Care should be taken during the sandblasting operation to ensure that the particles are not damaged or moved. The selective removal operation may be conducted in stages to ensure that only the overlying layers are removed but the underlying particles are not damaged or altered.

Figure 3:
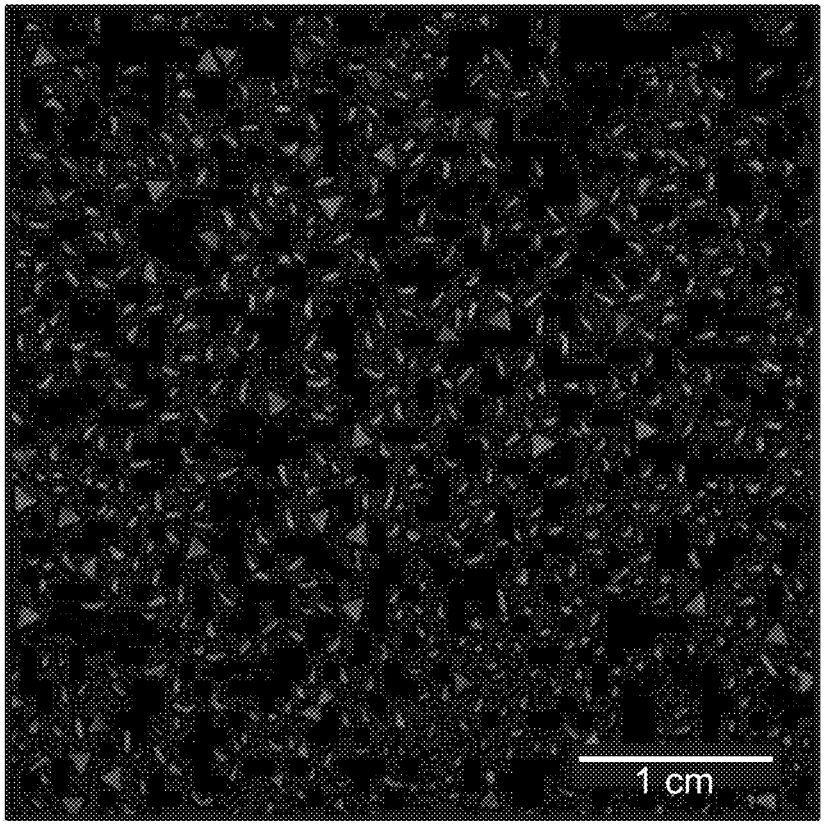
FIG. 3 includes an exemplary image of a portion of an abrasive article having abrasive particles in a random orientation.

After obtaining a sample with the particles exposed, at least two randomly selected regions of the sample are imaged using a suitable device, such as a Cannon Powershot S110 camera with a resolution of 338 pixels/cm. From these images, the location and orientation of each particle relative to the edge of the sample are cataloged using MATLAB image analysis software. The orientation of the particle is based on the angle of the major axis of the abrasive particles as viewed top-down relative to an edge of the coated abrasive. The same axis should be used to evaluate all sample images. The orientation of each particle is defined by an orientation angle between −90 degrees and +90 degrees. The orientation angles are then plotted in a plot of orientation angle (x-axis) versus frequency (y-axis) to create a histogram of the orientation angles. If the histogram has an essentially flat profile, such that the frequency for any given orientation angle is nearly the same as the frequency for any other orientation angle, the histogram demonstrates that the particles generally have no primary orientation mode, and therefore, the particles have a random orientation. FIG. 3 includes an exemplary image of a portion of an abrasive article having abrasive particles in a random orientation.

It should be noted that while certain embodiments herein can have particles arranged in a random orientation, other embodiments may include particles arranged in a non-random or controlled distribution.

According to one embodiment, an abrasive particle 202 can be overlying the backing 201 in a first position having a first rotational orientation relative to a lateral axis 281 defining the width of the backing 201 and perpendicular to a longitudinal axis 280. In particular, the abrasive particle 202 can have a predetermined rotational orientation defined by a first rotational angle between a lateral axis 284 parallel to the lateral axis 281 and a dimension of the abrasive particle 202. Notably, reference herein to a dimension can be a reference to a bisecting axis 231 of the abrasive particle 202 extending through a center point 221 of the abrasive particle 202 as viewed top-down. Moreover, the predetermined rotational orientation can be defined as the smallest angle 241 with the lateral axis 284 extending through the center point 221. As illustrated in FIG. 2A, the abrasive particle 202 can have a predetermined rotational angle defined as the smallest angle 241 between the bisecting axis 231 and the lateral axis 284, wherein the lateral axis is parallel to the lateral axis 281. It will be appreciated that the lateral axis 281 may also be a radial axis where the backing 201 has a circular or elliptical shape. In accordance with an embodiment, the angle 241 defining the rotational orientation of the abrasive particle 202 relative to the lateral axis 284 can be any value within a range between at least 0 degrees and not greater than 90 degrees.

As further illustrated in FIG. 2A, the abrasive particle 203 can be at a second position overlying the backing 201 and having a predetermined rotational orientation. Notably, the predetermined rotational orientation of the abrasive particle 203 can be characterized as the smallest angle between the lateral axis 285 parallel to the lateral axis 281 of the backing and a bisecting axis 232 of the abrasive particle 203 extending through a center point 222 of the abrasive particle 203. In accordance with an embodiment, the rotational angle 208 can be any value within a range of at least 0 degrees to 90 degrees.

In accordance with an embodiment, the abrasive particle 202 can have a predetermined rotational orientation as defined by the rotational angle 241 that is different than the predetermined rotational orientation of the abrasive particle 203 as defined by the rotational angle 208. In particular, the difference between the rotational angle 241 and rotational angle 208 for the abrasive particles 202 and 203 can define a predetermined rotational orientation difference. In particular instances, the predetermined rotational orientation difference can be any value within a range of at least 0 degrees and not greater than 90 degrees.

FIG. 2B includes a top-view illustration of a portion of a coated abrasive article according to an embodiment. As illustrated, the abrasive article 200 can include a plurality of abrasive particles arranged at different positions on the backing 201, wherein the abrasive particles 253 define a random distribution of the particles on the backing. Moreover, the abrasive particles 253 have a random rotational orientation with respect to each other, such that the rotational orientation of the abrasive particles 253 varies from particle-to-particle in a random manner According to one aspect, the random rotational orientation of the abrasive particles is such that the rotational angle of one abrasive particle in the group cannot be used to predict the rotational orientation of any of the immediately adjacent particles. Thus, a group of abrasive particles having a random rotational orientation lack any short-range (i.e., immediately adjacent) or long-range order with respect to their rotational angles. It will be appreciated that any particles attached to the backing using the systems and processes of the embodiments herein can have a random rotational orientation with respect to each other.

The coated abrasive articles of the embodiments herein can have at least a majority of the total content (weight or number) of abrasive particles having a random rotational orientation on the backing. In still other instances, at least 10% of the total number of shaped abrasive particles or at least 20% or at least 30% or at least 40% or at least 50% or at least 60% or at least 70% or at least 80% or at least 90% or essentially all of the shaped abrasive particles have a random rotational orientation. In one embodiment, all of the abrasive particles on the backing have a random rotational orientation.

Figure 4A:
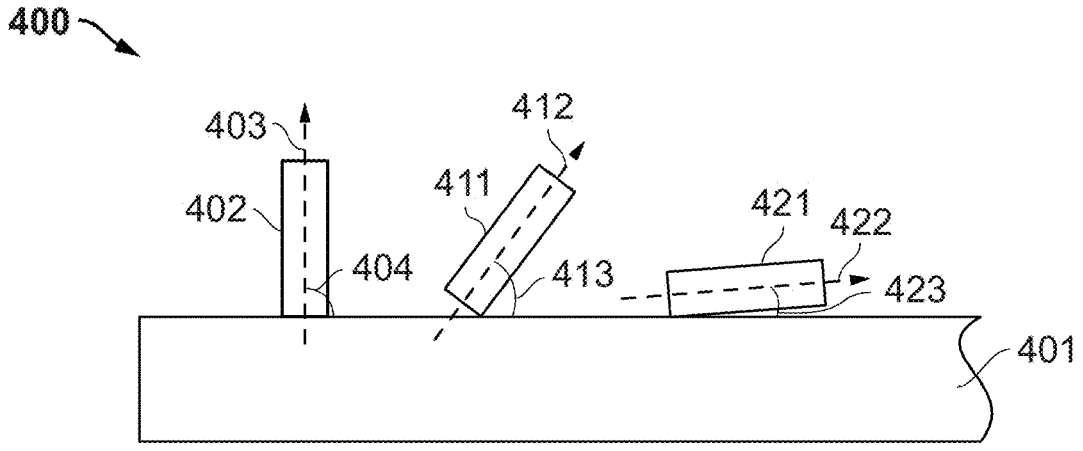
FIG. 4A includes a side-view illustration of abrasive particles on a backing according to an embodiment.
Figure 4B:
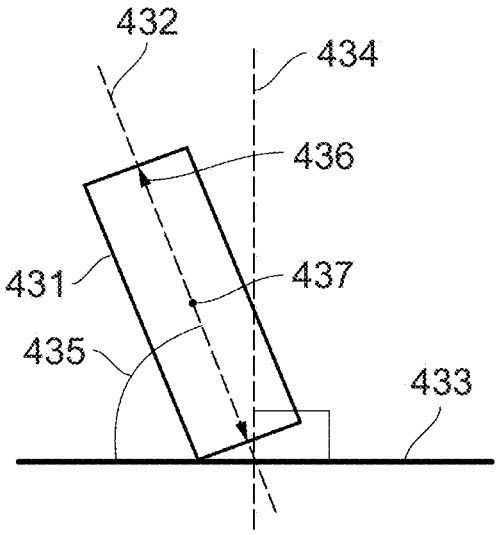
FIG. 4B includes a side-view illustration of a particle on a backing having a tilt angle according to an embodiment.

FIG. 4A includes a side-view illustration of abrasive particles on a backing according to an embodiment. The methods disclosed in the embodiments herein can facilitate the formation of coated abrasive articles having a particular distribution and orientation of abrasive particles. Notably, without wishing to be tied to a particular theory, it is noted that the projection rate and efficiency of the process disclosed herein may facilitate improved control of the tilt angle of the abrasive particles adhered to the backing. To better understand these features, FIG. 4A provides a side-view illustration of three abrasive particles in various orientations. It will be appreciated that the coated abrasive articles of the embodiments herein can have various contents of particles in the depicted orientations as described in more detail herein. The first particle 402 can have a particle axis 403 extending at a particular tilt angle 404 relative to the surface of the backing 401. The particle axis 403 can be parallel to the longitudinal axis of the first particle 402 that defines the length of the first particle 402. The first particle 402 is representative of a particle in a standing orientation having a tilt angle 404 within a range of greater than 65 degrees to 90 degrees. The second particle 411 can have a particle axis 412 extending at a particular tilt angle 413 relative to the surface of the backing 401. The particle axis 412 can be parallel to a longitudinal axis of the second particle 411 that defines the length of the second particle 411. The second particle 411 is representative of a particle in a slanted orientation having a tilt angle 413 within a range of greater than 5 degrees to 65 degrees. The third particle 421 can have a particle axis 422 extending at a particular tilt angle 423 relative to the surface of the backing 401. The particle axis 422 can be parallel to a longitudinal axis of the third particle 421 that defines the length of the third particle 421. The third particle 421 is representative of a particle in a flat orientation having a tilt angle 423 within a range of 0 degrees to not greater than 5 degrees (i.e., not greater than 5 degrees). FIG. 4B includes a side-view illustration of a particle on a backing having a particular tilt angle according to an embodiment. As illustrated, the particle 431 can be a shaped abrasive particle as described in embodiments herein. The particle 431 can have a longitudinal axis 436 as defined later in this application. The backing 433 can define a substantially planar surface and have an axis 434 extending normal to the substantially planar surface of the backing 433. The tilt angle 435 is the smallest angle between the planar surface of the backing 433 and an axis 432, which extends parallel to the longitudinal axis 436 of the particle 431. Certain particles can have longitudinal axes along various surfaces, which may result in different tilt angles. In such instances, the axis defining the largest angle is the tilt angle.

Figure 4C:
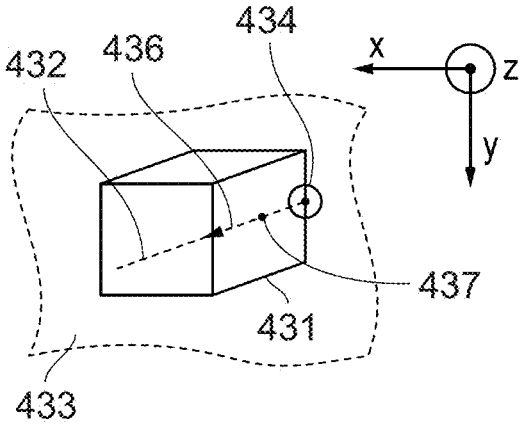
FIG. 4C includes a top-down illustration of the particle of FIG. 4B.

FIG. 4C includes a top-down illustration of the particle of FIG. 4B. In certain instances, a top-down view may provide a suitable vantage for identifying the direction of the tilt and thus can be suitable for measuring the tilt angle.

Figure 4D:
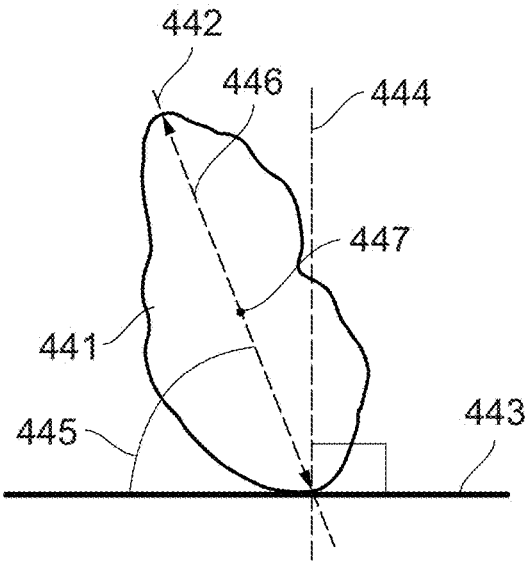
FIG. 4D includes a side-view illustration of a particle on a backing having a tilt angle according to an embodiment.

FIG. 4D includes a side-view illustration of a particle on a backing having a particular tilt angle according to an embodiment. As illustrated, the particle 441 can have a longitudinal axis 446 as defined later in this application. The particle 441 can be an abrasive particle, and more particularly, can be a non-shaped abrasive particle. The backing 443 can define a substantially planar surface and have an axis 444 extending normal to the substantially planar surface of the backing 443. The tilt angle 445 can be the smallest angle between an axis 442, which extends parallel to the longitudinal axis 446 and the surface of the backing 443. It will be appreciated that certain particles, such as equiaxed particles, will not have a tilt angle.

Figure 4E:
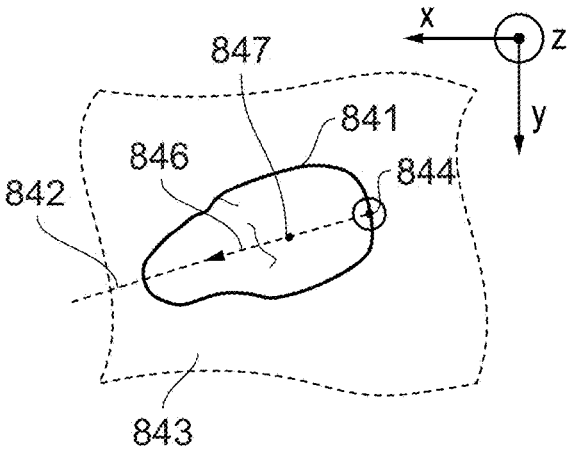
FIG. 4E includes a top-down illustration of the particle of FIG. 4D.

FIG. 4E includes a top-down illustration of the particle of FIG. 4D. The top-down view may be used to evaluate the tilt angle of the particle. As depicted, the top-down view may be the best view for evaluating the tilt angle as a side-view may not necessarily ensure the smallest angle is identified. A combination of top-down and side-view illustrations may be suitable for identifying and evaluating the tilt angle 445.

In one aspect, a coated abrasive article may include a plurality of abrasive particles, wherein the tilt angle of the abrasive particles is controlled, which may facilitate improved performance of the coated abrasive. For example, at least a portion of the shaped abrasive particles have a tilt angle greater than 45 degrees. In further aspects, a portion includes at least 10% of the total number of shaped abrasive particles or at least 20% or at least 30% or at least 40% or at least 50% or at least 60% or at least 70% or at least 80% or at least 90% or essentially all the shaped abrasive particles have a tilt angle greater than 45 degrees.

In an embodiment, the coated abrasive article may have a particular percentage of standing particles that may facilitate improved performance and/or manufacturing of the abrasive article. Standing particles can be defined as particles having a tilt angle of 65 to 90 degrees. In an embodiment, the standing abrasive particles can include at least 10% of the total number of the abrasive particles or at least 20% or at least 30% or at least 40% or at least 50% or at least 55% or at least 57% or at least 60% or at least 62% or at least 65% or at least 67% or at least 70% or at least 72% or at least 75% or at least 77% or at least 80% or at least 82% or at least 85% or at least 87% or at least 90% of the total number of the abrasive particles. In another embodiment, the standing abrasive particles can include not greater than 99.9% of the total number of the abrasive particles or not greater than 99% or not greater than 98% or not greater than 97% or not greater than 96% or not greater than 95% of the total number of the abrasive particles. It will be appreciated that the percentage of standing particles can be between any of the minimum and maximum values noted above, including, for example, but not limited to, at least 20% and not greater than 99% or at least 50% and not greater than 95%.

In an embodiment, the coated abrasive article may have a particular percentage of slanted particles that may facilitate improved performance and/or manufacturing of the abrasive article. Slanted particles can be defined as particles having a tilt angle of 5 to 65 degrees. In an embodiment, the slanted abrasive particles can include at least 1% of the total number of the abrasive particles or at least 2% or at least 3% or at least 4% or at least 5% or at least 6% or at least 7% or at least 8% or at least 9% or at least 10% or at least 11% or at least 12% or at least 13% or at least 14% or at least 15% or at least 16% or at least 17% or at least 18% or at least 20% or at least 25% of the total number of the abrasive particles. In another embodiment, the slanted abrasive particles can include not greater than 90% of the total number of the abrasive particles or not greater than 85% or not greater than 80% or not greater than 75% or not greater than 70% or not greater than 65% or not greater than 60% or not greater than 55% or not greater than 50% or not greater than 45% or not greater than 40% or not greater than 35% or not greater than 30% or not greater than 25% or not greater than 20% or not greater than 18% or not greater than 15% or not greater than 12% or not greater than 10% of the total number of the abrasive particles. It will be appreciated that the percentage of slanted particles can be between any of the minimum and maximum values noted above, including, for example, but not limited to, at least 5% and not greater than 80% or at least 15% and not greater than 35%.

In an embodiment, the coated abrasive article may have a particular percentage of well oriented particles that may facilitate improved performance and/or manufacturing of the abrasive article. Well oriented particles can be defined as particles having a tilt angle of 5 to 90 degrees and include slanted and standing particles. In an embodiment, the well oriented abrasive particles can include at least 60% of the total number of the abrasive particles or at least 62% or at least 65% or at least 67% or at least 70% or at least 72% or at least 75% or at least 77% or at least 80% or at least 82% or at least 85% or at least 87% or at least 90% or at least 92% or at least 95% of the total number of the abrasive particles. In another embodiment, the well oriented abrasive particles can be not greater than 99.9% of the total number of the abrasive particles or not greater than 99% or not greater than 98% or not greater than 97% or not greater than 96% or not greater than 95%. It will be appreciated that the percentage of well oriented particles can be between any of the minimum and maximum values noted above, including, for example, but not limited to, at least 5% and not greater than 80% or at least 15% and not greater than 35%.

In an embodiment, the coated abrasive article may have a particular percentage of fallen particles that may facilitate improved performance and/or manufacturing of the abrasive article. Fallen particles can be defined as particles having a tilt angle of 0 to 5 degrees. In an embodiment, the fallen abrasive particles at least 0.1% of the total number of the abrasive particles or at least 0.2% or at least 0.4% or at least 0.6% or at least 0.8% or at least 1% or at least 1.5% or at least 2% or at least 2.5% or at least 3% or at least 3.5% or at least 4% or at least 4.5% or at least 5% of the total number of the abrasive particles. In another embodiment, the fallen abrasive particles can include not greater than 20% of the total number of the abrasive particles or not greater than 18% or not greater than 15% or not greater than 12% or not greater than 10% or not greater than 9% or not greater than 8% or not greater than 7% or not greater than 6% or not greater than 5% of the total number of the abrasive particles. It will be appreciated that the percentage of fallen particles can be between any of the minimum and maximum values noted above, including, for example, but not limited to, at least 0.2% and not greater than 15% or at least 1% and not greater than 9%.

In an embodiment, the coated abrasive article may have a particular percentage of inverted particles that may facilitate improved performance and/or manufacturing of the abrasive article. Inverted particles can be defined as particles having a tilt angle of 5 to 90 degrees as well as having a tip, corner, or point extending into the make coat, and a planar surface or surfaces such as a base, opposite the tip on the other end of the abrasive particle. Only particles having a tip on one end of its longitudinal axis and at least one planar surface on the opposite end of the longitudinal axis can be inverted. Exemplary particle shapes that can be in an inverted orientation include triangles, 3-PT (3-PT) stars, pentagons, and pyramids. Particles having planar surfaces on both ends of their longitudinal axis (e.g., rods or cylinders, rectangular prisms,) and particles having points on both ends of their longitudinal axis [e.g., toothpick-shaped, diamond-shaped, 4-pointed (4-PT) stars] cannot be in an inverted orientation. Inverted particles are not standing, slanted, fallen, or well oriented. In an embodiment, the inverted abrasive particles make up at least 0.1% of the total number of the abrasive particles or at least 0.2% or at least 0.4% or at least 0.6% or at least 0.8% or at least 1% or at least 1.5% or at least 2% or at least 2.5% or at least 3% or at least 3.5% or at least 4% or at least 4.5% or at least 5% of the total number of the abrasive particles. In another embodiment, the inverted abrasive particles can include not greater than 20% of the total number of the abrasive particles or not greater than 18% or not greater than 15% or not greater than 12% or not greater than 10% or not greater than 9% or not greater than 8% or not greater than 7% or not greater than 6% or not greater than 5% of the total number of the abrasive particles. It will be appreciated that the percentage of inverted particles can be between any of the minimum and maximum values noted above, including, for example, but not limited to, at least 0.2% and not greater than 15% or at least 1% and not greater than 9%.

In an embodiment, the coated abrasive particle may have a particular ratio (Pst/Psl) of standing particles (Pst) to slanted particles (Psl) that may facilitate improved performance and/or manufacturing of the abrasive article. In an embodiment, Pst/Psl can be at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6. In another embodiment, Pst/Psl can be not greater than 100 or not greater than 95 or not greater than 90 or not greater than 80 or not greater than 70 or not greater than 60 or not greater than 50 or not greater than 40 or not greater than 30 or not greater than 20 or not greater than 10. It will be appreciated that Pst/Psl can be between any of the minimum and maximum values noted above, including, for example, but not limited to, at least 1.2 and not greater than 95 or at least 2.0 and not greater than 40.

In an embodiment, the coated abrasive particle may have a particular ratio (Pst/Pf) of standing particles (Pst) to fallen particles (Pt) that may facilitate improved performance and/or manufacturing of the abrasive article. In an embodiment, Pst/Pf can be at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6 or at least 5.8 or at least 6.0 or at least 6.2 or at least 6.4 or at least 6.6 or at least 6.8 or at least 7.0 or at least 7.2 or at least 7.4 or at least 7.6 or at least 7.8 or at least 8.0. In another embodiment, Pst/Pf can be not greater than 1000 or not greater than 800 or not greater than 500 or not greater than 200 or not greater than 100 or not greater than 95. It will be appreciated that Pst/Pf can be between any of the minimum and maximum values noted above, including, for example, but not limited to, at least 2.0 and not greater than 500 or at least 2.6 and not greater than 95.

In an embodiment, the coated abrasive particle may have a particular ratio (Psl/Pt) of slanted particles (Psl) to fallen particles (Pt) that may facilitate improved performance and/or manufacturing of the abrasive article. In an embodiment, Psl/Pf can be at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6. In another embodiment, Psl/Pf can be not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6. It will be appreciated that Psl/Pf can be between any of the minimum and maximum values noted above, including, for example, but not limited to, at least 2.0 and not greater than 95 or at least 2.6 and not greater than 70.

In an embodiment, the coated abrasive particle may have a particular ratio (Pst/Pi) of standing particles (Pst) to inverted particles (Pi) that may facilitate improved performance and/or manufacturing of the abrasive article. In an embodiment, Pst/Pi can be at least 1 or at least 2.0 or at least 3.0 or at least 4.0 or at least 5.0 or at least 6 or at least 7 or at least 8 or at least 9 or at least 10 or at least 12 or at least 15 or at least 18 or at least 20 or at least 25 or at least 30 or at least 40 or at least 50. In another embodiment, Pst/Pi can be not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6. It will be appreciated that Pst/Pi can be between any of the minimum and maximum values noted above, including, for example, but not limited to, at least 2.0 and not greater than 80 or at least 6 and not greater than 20.

In an embodiment, the coated abrasive particle may have a particular ratio (Psl/Pi) of slanted particles (Psl) to inverted particles (Pi) that may facilitate improved performance and/or manufacturing of the abrasive article. In an embodiment, Psl/Pi can be at least 0.6 or at least 0.7 or at least 0.8 or at least 0.9 or at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6. In another embodiment, Psl/Pi can be not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6 or not greater than 4 or not greater than 3 or not greater than 2 or not greater than 1.5. It will be appreciated that Psl/Pi can be between any of the minimum and maximum values noted above, including, for example, but not limited to, at least 2.0 and not greater than 95 or at least 2.6 and not greater than 70.

In an embodiment, the coated abrasive particle may have a particular ratio (Pf/Pi) of fallen particles (Pt) to inverted particles (Pi) that may facilitate improved performance and/or manufacturing of the abrasive article. In an embodiment, Pf/Pi can be at least 0.6 or at least 0.7 or at least 0.8 or at least 0.9 or at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0. In another embodiment, Pf/Pi can be not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6 or not greater than 4 or not greater than 3 or not greater than 2 or not greater than 1.5. It will be appreciated that Pf/Pi can be between any of the minimum and maximum values noted above, including, for example, but not limited to, at least 2.0 and not greater than 95 or at least 2.6 and not greater than 70.

Figure 5A:
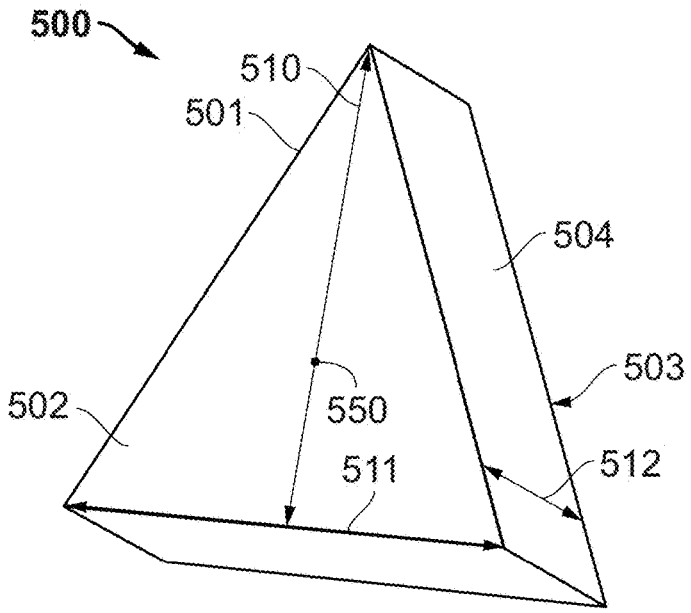
FIG. 5A includes a perspective view illustration of a shaped abrasive particle according to an embodiment.

Embodiments herein have referred to particles, which can include abrasive particles, secondary particles, or any combination thereof. Various types of abrasive particles and/or secondary particles can be used with abrasive articles described in the embodiments herein. FIG. 5A includes a perspective view illustration of a shaped abrasive particle in accordance with an embodiment. The shaped abrasive particle 500 can include a body 501 including a major surface 502, a major surface 503, and a side surface 504 extending between the major surfaces 502 and 503. As illustrated in FIG. 5A, the body 501 of the shaped abrasive particle 500 can be a thin-shaped body, wherein the major surfaces 502 and 503 are larger than the side surface 504. Moreover, the body 501 can include a longitudinal axis 510 extending from a point to a base and through the midpoint 550 on a major surface 502 or 503. The longitudinal axis 510 can define the longest dimension of the body along a major surface and through the midpoint 550 of the major surface 502.

Figure 5B:
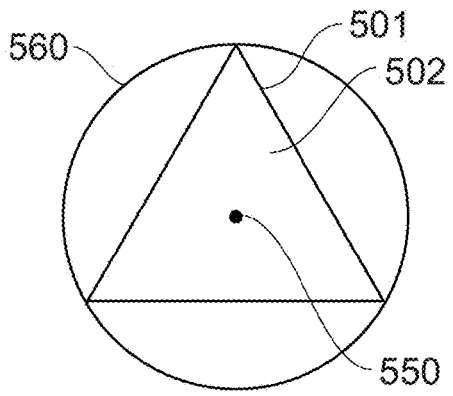
FIG. 5B includes a top-down view illustration of a shaped abrasive particle according to an embodiment.

In certain particles, if the midpoint of a major surface of the body is not readily apparent, one may view the major surface top-down, draw a closest-fit circle around the two-dimensional shape of the major surface and use the center of the circle as the midpoint of the major surface. FIG. 5B includes a top-down illustration of the shaped abrasive particle of FIG. 5A. Notably, the body 501 includes a major surface 502 having a triangular two-dimensional shape. The circle 560 is drawn around the triangular shape to facilitate the location of the midpoint 550 on the major surface 502.

Referring again to FIG. 5A, the body 501 can further include a lateral axis 511 defining a width of the body 501 extending generally perpendicular to the longitudinal axis 510 on the same major surface 502. Finally, as illustrated, the body 501 can include a vertical axis 512, which in the context of thin-shaped bodies can define a height (or thickness) of the body 501. For thin-shaped bodies, the length of the longitudinal axis 510 is greater than the vertical axis 512. As illustrated, the thickness 512 can extend along the side surface 504 between the major surfaces 502 and 503 and perpendicular to the plane defined by the longitudinal axis 510 and lateral axis 511. It will be appreciated that reference herein to length, width, and height of the abrasive particles may be reference to average values taken from a suitable sampling size of abrasive particles of a larger group, including, for example, a group of abrasive particles affixed to a fixed abrasive.

FIG. 5A includes an illustration of a shaped abrasive particle having a two-dimensional shape as defined by the plane of the upper major surface 502 or major surface 503, which has a generally triangular two-dimensional shape. It will be appreciated that the shaped abrasive particles of the embodiments herein are not so limited and can include other two-dimensional shapes. For example, the shaped abrasive particles of the embodiment herein can include particles having a body with a two-dimensional shape as defined by a major surface of the body from the group of shapes including polygons, regular polygons, irregular polygons, irregular polygons including arcuate or curved sides or portions of sides, ellipsoids, numerals, Greek alphabet characters, Latin alphabet characters, Russian alphabet characters, Kanji characters, complex shapes having a combination of polygons shapes, shapes including a central region and a plurality of arms (e.g., at least three arms) extending from a central region (e.g., star shapes), and a combination thereof. Particular polygonal shapes include rectangular, trapezoidal, quadrilateral, pentagonal, hexagonal, heptagonal, octagonal, nonagonal, decagonal, and any combination thereof. In another instance, the finally formed shaped abrasive particles can have a body having a two-dimensional shape such as an irregular quadrilateral, an irregular rectangle, an irregular trapezoid, an irregular pentagon, an irregular hexagon, an irregular heptagon, an irregular octagon, an irregular nonagon, an irregular decagon, and a combination thereof. An irregular polygonal shape is one where at least one of the sides defining the polygonal shape is different in dimension (e.g., length) with respect to another side. As illustrated in other embodiments herein, the two-dimensional shape of certain shaped abrasive particles can have a particular number of exterior points or external corners. For example, the body of the shaped abrasive particles can have a two-dimensional polygonal shape as viewed in a plane defined by a length and width, wherein the body comprises a two-dimensional shape having at least 4 exterior points (e.g., a quadrilateral), at least 5 exterior points (e.g., a pentagon), at least 6 exterior points (e.g., a hexagon), at least 7 exterior points (e.g., a heptagon), at least 8 exterior points (e.g., an octagon), at least 9 exterior points (e.g., a nonagon), and the like.

Figure 7:
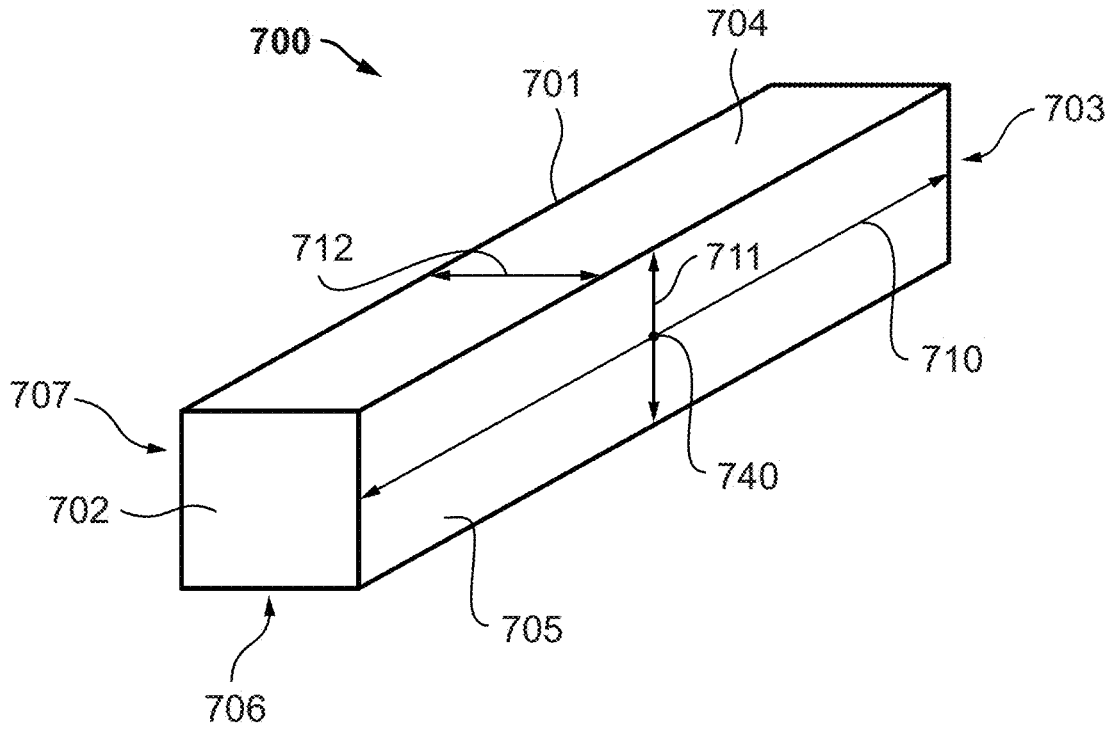
FIG. 7 includes a perspective view illustration of a shaped abrasive particle according to an embodiment.

FIG. 7 includes a perspective view illustration of a shaped abrasive particle according to another embodiment. Notably, the shaped abrasive particle 700 can include a body 701 including a surface 702 and a surface 703, which may be referred to as end surfaces 702 and 703. The body can further include major surfaces 704, 705, 706, 707 extending between and coupled to the end surfaces 702 and 703. The shaped abrasive particle of FIG. 7 is an elongated shaped abrasive particle having a longitudinal axis 710 that extends along the major surface 705 and through the midpoint 740 between the end surfaces 702 and 703. For particles having an identifiable two-dimensional shape, such as the shaped abrasive particles of FIGS. 5 and 7, the longitudinal axis is the dimension that would be readily understood to define the length of the body through the midpoint on a major surface. For example, in FIG. 7, the longitudinal axis 710 of the shaped abrasive particle 700 extends between the end surfaces 702 and 703 parallel to the edges defining the major surface as shown. Such a longitudinal axis is consistent with how one would define the length of a rod. Notably, the longitudinal axis 710 does not extend diagonally between the corners joining the end surfaces 702 and 703 and the edges defining the major surface 705, even though such a line may define the dimension of greatest length. To the extent that a major surface has undulations or minor imperfections from a perfectly planar surface, the longitudinal axis can be determined using a top-down, two-dimensional image that ignores the undulations.

It will be appreciated that the surface 705 is selected for illustrating the longitudinal axis 710 because the body 701 has a generally square cross-sectional contour as defined by the end surfaces 702 and 703. As such, the surfaces 704, 705, 706, and 707 can be approximately the same size relative to each other. However, in the context of other elongated abrasive particles, the surfaces 702 and 703 can have a different shape, for example, a rectangular shape, and as such, at least one of the surfaces 704, 705, 706, and 707 may be larger relative to the others. In such instances, the largest surface can define the major surface and the longitudinal axis would extend along the largest of those surfaces through the midpoint 740 and may extend parallel to the edges defining the major surface. As further illustrated, the body 701 can include a lateral axis 711 extending perpendicular to the longitudinal axis 710 within the same plane defined by the surface 705. As further illustrated, the body 701 can further include a vertical axis 712 defining a height of the abrasive particle, wherein the vertical axis 712 extends in a direction perpendicular to the plane defined by the longitudinal axis 710 and lateral axis 711 of the surface 705.

It will be appreciated that like the thin-shaped abrasive particle of FIG. 5, the elongated shaped abrasive particle of FIG. 7 can have various two-dimensional shapes, such as those defined with respect to the shaped abrasive particle of FIG. 5. The two-dimensional shape of the body 701 can be defined by the shape of the perimeter of the end surfaces 702 and 703. The elongated shaped abrasive particle 700 can have any of the attributes of the shaped abrasive particles of the embodiments herein.

Figure 8A:
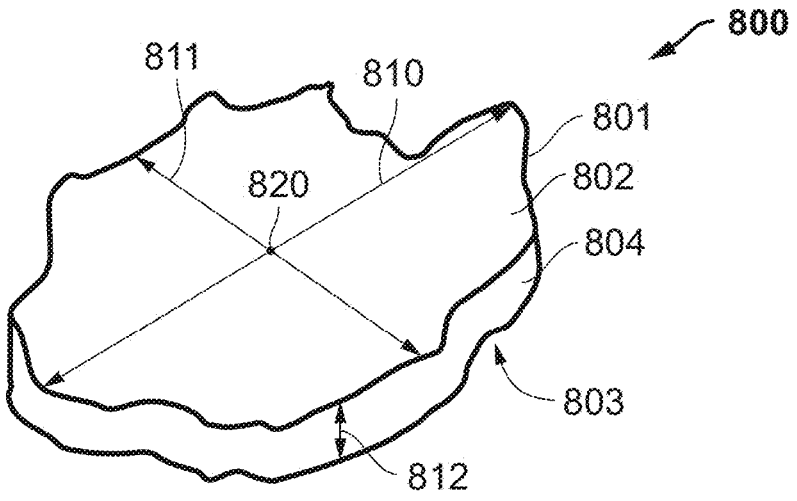
FIG. 8A includes a perspective view illustration of a controlled height abrasive particle according to an embodiment.

FIG. 8A includes a perspective view illustration of a controlled height abrasive particle according (CHAP) to an embodiment. As illustrated, the CHAP 800 can include a body 801 including a first major surface 802, a second major surface 803, and a side surface 804 extending between the first and second major surfaces 802 and 803. As illustrated in FIG. 8A, the body 801 can have a thin, relatively planar shape, wherein the first and second major surfaces 802 and 803 are larger than the side surface 804 and substantially parallel to each other. Moreover, the body 801 can include a longitudinal axis 810 extending through the midpoint 820 and defining a length of the body 801. The body 801 can further include a lateral axis 811 on the first major surface 802, which extends through the midpoint 820 of the first major surface 802, perpendicular to the longitudinal axis 810, and defining a width of the body 801.

The body 801 can further include a vertical axis 812, which can define a height (or thickness) of the body 801. As illustrated, the vertical axis 812 can extend along the side surface 804 between the first and second major surfaces 802 and 803 in a direction generally perpendicular to the plane defined by the axes 810 and 811 on the first major surface. For thin-shaped bodies, such as the CHAP illustrated in FIG. 8A, the length can be equal to or greater than the width and the length can be greater than the height. It will be appreciated that reference herein to length, width, and height of the abrasive particles may be referenced to average values taken from a suitable sampling size of abrasive particles of a batch of abrasive particles.

Unlike the shaped abrasive particles of FIGS. 5A, 5B, and 7, the CHAP of FIG. 8A does not have a readily identifiable two-dimensional shape based on the perimeter of the first or second major surfaces 802 and 803. Such abrasive particles may be formed in a variety of ways, including but not limited to, fracturing of a thin layer of material to form abrasive particles having a controlled height but with irregularly formed, planar, major surfaces. For such particles, the longitudinal axis is defined as the longest dimension on the major surface that extends through a midpoint on the surface. To the extent that the major surface has undulations, the longitudinal axis can be determined using a top-down, two-dimensional image that ignores the undulations. Moreover, as noted above in FIG. 5B, a closest-fit circle may be used to identify the midpoint of the major surface and identification of the longitudinal and lateral axes.

Figure 8B:
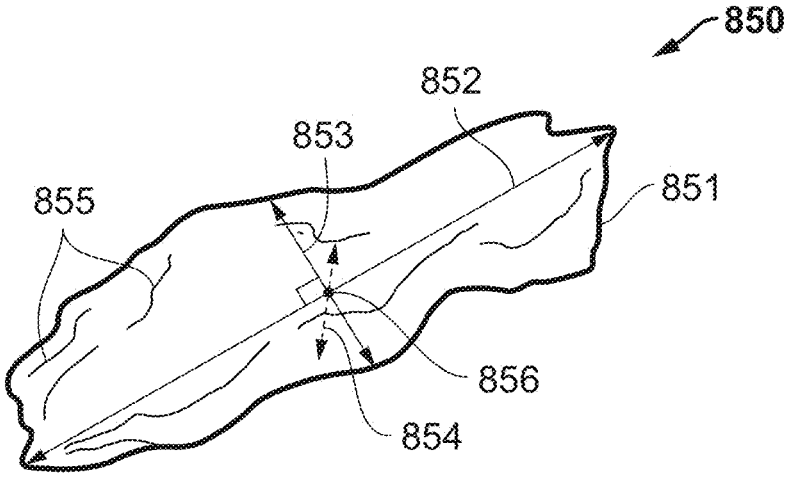
FIG. 8B includes a perspective view illustration of a non-shaped particle according to an embodiment.

FIG. 8B includes an illustration of a non-shaped particle, which may be an elongated, non-shaped abrasive particle or a secondary particle, such as a diluent grain, a filler, an agglomerate, or the like. Shaped abrasive particles may be formed through particular processes, including molding, printing, casting, extrusion, and the like. Shaped abrasive particles can be formed such that each particle has substantially the same arrangement of surfaces and edges relative to each other. For example, a group of shaped abrasive particles generally have the same arrangement and orientation and or two-dimensional shape of the surfaces and edges relative to each other. As such, the shaped abrasive particles have a relatively high shape fidelity and consistency in the arrangement of the surfaces and edges relative to each other. Moreover, constant height abrasive particles (CHAPs) can also be formed through particular processes that facilitate the formation of thin-shaped bodies that can have irregular two-dimensional shapes when viewing the major surface top-down. CHAPs can have less shape fidelity than shaped abrasive particles but can have substantially planar and parallel major surfaces separated by a side surface.

By contrast, non-shaped particles can be formed through different processes and have different shape attributes compared to shaped abrasive particles and CHAPs. For example, non-shaped particles are typically formed by a comminution process wherein a mass of material is formed and then crushed and sieved to obtain abrasive particles of a certain size. However, a non-shaped particle will have a generally random arrangement of surfaces and edges, and generally will lack any recognizable two-dimensional or three-dimensional shape in the arrangement of the surfaces and edges. Moreover, non-shaped particles do not necessarily have a consistent shape with respect to each other, and therefore have a significantly lower shape fidelity compared to shaped abrasive particles or CHAPs. The non-shaped particles generally are defined by a random arrangement of surfaces and edges for each particle and with respect to other non-shaped particles.

FIG. 8B includes a perspective view illustration of a non-shaped particle. The non-shaped particle 850 can have a body 851 including a generally random arrangement of edges 855 extending along the exterior surface of the body 851. The body can further include a longitudinal axis 852 defining the longest dimension of the particle. The longitudinal axis 852 defines the longest dimension of the body as viewed in two-dimensions. Thus, unlike shaped abrasive particles and CHAPs, where the longitudinal axis is measured on the major surface, the longitudinal axis of a non-shaped particle is defined by the points on the body furthest from each other as the particle is viewed in two-dimensions using an image or vantage that provides a view of the particle's longest dimension. That is, an elongated particle, but non-shaped particles, such as illustrated in FIG. 8B, should be viewed in a perspective that makes the longest dimension apparent to properly evaluate the longitudinal axis. The body 851 can further include a lateral axis 853 extending perpendicular to the longitudinal axis 852 and defining a width of the particle. The lateral axis 853 can extend perpendicular to the longitudinal axis 852 through the midpoint 856 of the longitudinal axis in the same plane used to identify the longitudinal axis 852. The abrasive particle may have a height (or thickness) as defined by the vertical axis 854. The vertical axis 854 can extend through the midpoint 856 but in a direction perpendicular to the plane used to define the longitudinal axis 852 and lateral axis 853. To evaluate the height, one may have to change the perspective of view of the abrasive particle to look at the particle from a different vantage than is used to evaluate the length and width.

In an embodiment, the plurality of abrasive particles 102 and 103 of the coated abrasive article can include shaped abrasive particles. In an embodiment, the shaped abrasive particles can be 3-PT star-shaped abrasive particles. The abrasive particles can have a length (l), a width (w), and a thickness (t), wherein the width≥thickness and the length≥thickness. The particles can have a primary aspect ratio based on the length:width of the body. The particles can have a secondary aspect ratio based on the length:thickness of the body. The particles can also have a tertiary aspect ratio, based on the width:thickness of the body. The particles 102 and 103 can be an elongated abrasive particle, having a primary aspect ratio greater than 1.1:1.

In an embodiment, the plurality of shaped abrasive particles can include a plurality of shaped abrasive particles having a 3-PT star two-dimensional shape as viewed in a plane of a length and width of the body. The body can include at least 3 exterior corners and at least 4 side surface sections, or at least 5 side surface sections or at least 6 side surface sections. In an embodiment, the plurality of shaped abrasive particles can include a body having at least 3 exterior corners, where the sum of the angles of the exterior corners is less than 180 degrees. In an embodiment, the plurality of shaped abrasive particles can include a body having at least 3 exterior corners, where each of the exterior corners defines an angle less than 60 degrees or less than 59 degrees or less than 58 degrees or less than 57 degrees or less than 56 degrees or less than 55 degrees. In an embodiment, the plurality of shaped abrasive particles can include comprises a body having at least 3 exterior corners and at least 3 interior corners, where each of the interior corners have an interior corner angle value greater than any of the exterior corner values of any of the at least 3 exterior corners.

Exterior corners can be identified using the "rubber band test". If a rubber band were to be stretched around the body of the abrasive particle, the corners that contact the rubber band and cause deflection of the rubber band would be exterior corners.

Figure 6A:
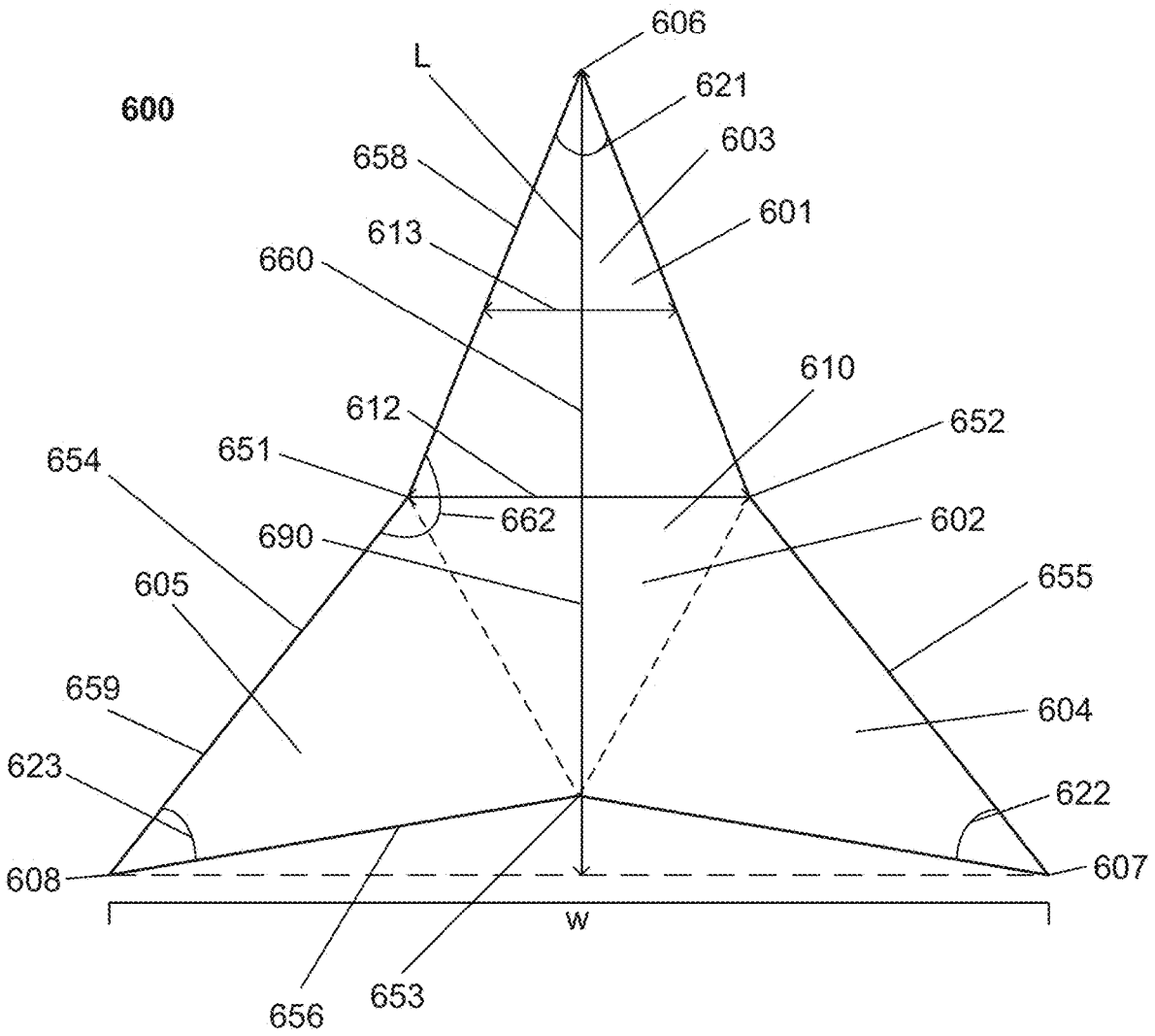
FIG. 6A includes an image of a 3-PT star-shaped abrasive particle.
Figure 6B:
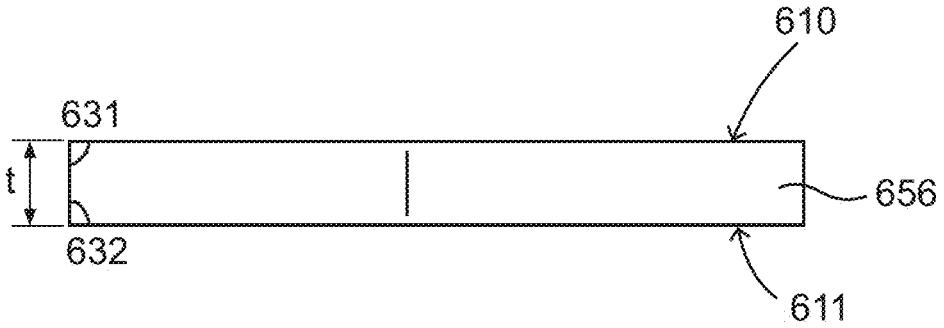
FIG. 6B includes an illustration of a side view of the shaped abrasive particle of FIG. 6A.

FIG. 6A includes a top view image of a 3-PT star-shaped abrasive particle according to a particular embodiment. As illustrated, the shaped abrasive particle 600 can define a star-shaped body, as viewed in two dimensions. In particular, the shaped abrasive particle 600 can include a body 601 having a central portion 602 and a first arm 603, a second arm 604, and a third arm 605 extending from the central portion 602. The body 601 can have a length (l) measured as the longest dimension along a side of the particle and a width (w), measured as the longest dimension of the particle between a midpoint 653 of a side through the midpoint 690 of the body 601 to a first tip 606 of the first arm 603. The width can extend in a direction perpendicular to the dimension of the length. The body 601 can have a thickness (t), extending in a direction perpendicular to the upper surface or first major surface 610 of the body 601 defining the third side surface 656 between the upper surface or first major surface 610 and the base surface 611 as illustrated in FIG. 6B, which is a side view illustration of the image of the particle of FIG. 6A.

The shaped abrasive particle 600 can have a body 601 in the form of a 3-PT star defined by the first arm 603, second arm 604, and the third arm 605 extending from the central portion 602. According to one particular embodiment, at least one of the arms, including, for example, the first arm 603, can have a midpoint width 613 that is less than a central portion width 612. The central portion 602 can be defined as a region between the midpoints 651, 652, and 653 of the first side surface 654, second side surface 655, and third side surface 656, respectively. The central portion width 612 of the first arm 603 can be the width of the dimension between the midpoints 651 and 652. The midpoint width 613 can be the width of the line at a midpoint between the line of the central portion width 612 and the tip 606 of the first arm 603 along a first axis 660. In certain instances, the midpoint width 613 can be not greater than about 90% of the central portion width 612, such as not greater than about 80%, not greater than about 70%, not greater than about 5%, or even not greater than about 60%. Still, the midpoint width 613 can be at least about 10%, such as at least about 20%, at least about 30%, or even at least about 40% of the central portion width 612. It will be appreciated that the midpoint width 613 can have a width relative to the central portion width 612 within a range between any of the above minimum and maximum percentages.

Moreover, the body 601 can have at least one arm, such as the first arm 603, having a tip width at the tip 606 of the first arm 603 that is less than a midpoint width 613. In such instances wherein the tip 606 is sharply formed, the tip width may be considered 0. In instances wherein the tip 606 has a radius of curvature, the tip width may be considered the diameter of the circle defined by the radius of curvature. According to one embodiment, the tip width 614 can be not greater than about 90% of the midpoint width 613, such as not greater than about 80%, not greater than about 70%, not greater than about 60%, not greater than about 50%, not greater than about 40%, not greater than about 30%, not greater than about 20%, or even not greater than about 10%. Still, in certain non-limiting embodiments, the tip width 614 can be at least about 1%, such as at least about 2%, at least about 3%, at least about 5%, or even at least about 10% of the midpoint width 613. It will be appreciated that the tip width 614 can have a width relative to the midpoint width 613 within a range between any of the above minimum and maximum percentages.

As further illustrated, the body 601 can have a first arm 603 including a first tip 606 defining a first tip angle 621 between the first side surface 654 and the second side surface 655. According to an embodiment, the first tip angle can be less than about 60 degrees, such as not greater than about 55 degrees, not greater than about 50 degrees, not greater than about 45 degrees, or even not greater than about 40 degrees. Still, the first tip angle can be at least about 5 degrees, such as at least about 8 degrees, at least about 10 degrees, at least about 15 degrees, at least about 20 degrees, at least about 25 degrees, or even at least about 30 degrees. The first tip angle can be within a range between any of the minimum and maximum values noted above.

The body 601 can include a second arm 604 having a second tip 607 defining a second tip angle 622 between the second side surface 655 and third side surface 656. The second tip angle can be substantially the same as the first tip angle, such as within 5% of the angle numerical value. Alternatively, the second tip angle can be substantially different relative to the first tip angle.

The body 601 can include a third arm 605 having a third tip 608 defining a third tip angle 623 between the first side surface 654 and third side surface 656. The third tip angle can be substantially the same as the first tip angle or second tip angle, such as within 5% of the angle numerical value. Alternatively, the third tip angle can be substantially different relative to the first tip angle or the second tip angle.

The body 601 can have a total angle, which is a sum of the value of the first tip angle, second tip angle, and third tip angle which can be less than about 180 degrees. In other embodiments, the total angle can be not greater than about 175 degrees, such as not greater than about 170 degrees, not greater than about 15 degrees, not greater than about 150 degrees, such as not greater than about 140 degrees, not greater than about 130 degrees, not greater than about 125 degrees, or even not greater than about 120 degrees. Still, in one non-limiting embodiment, the body 601 can have a total angle of at least about 60 degrees, such as at least about 70 degrees, at least about 80 degrees, at least about 90 degrees, such as at least about 95 degrees, at least about 100 degrees, or even at least about 105 degrees. It will be appreciated that the total sum angle can be within a range between any of the minimum and maximum values noted above.

Figure 6C:
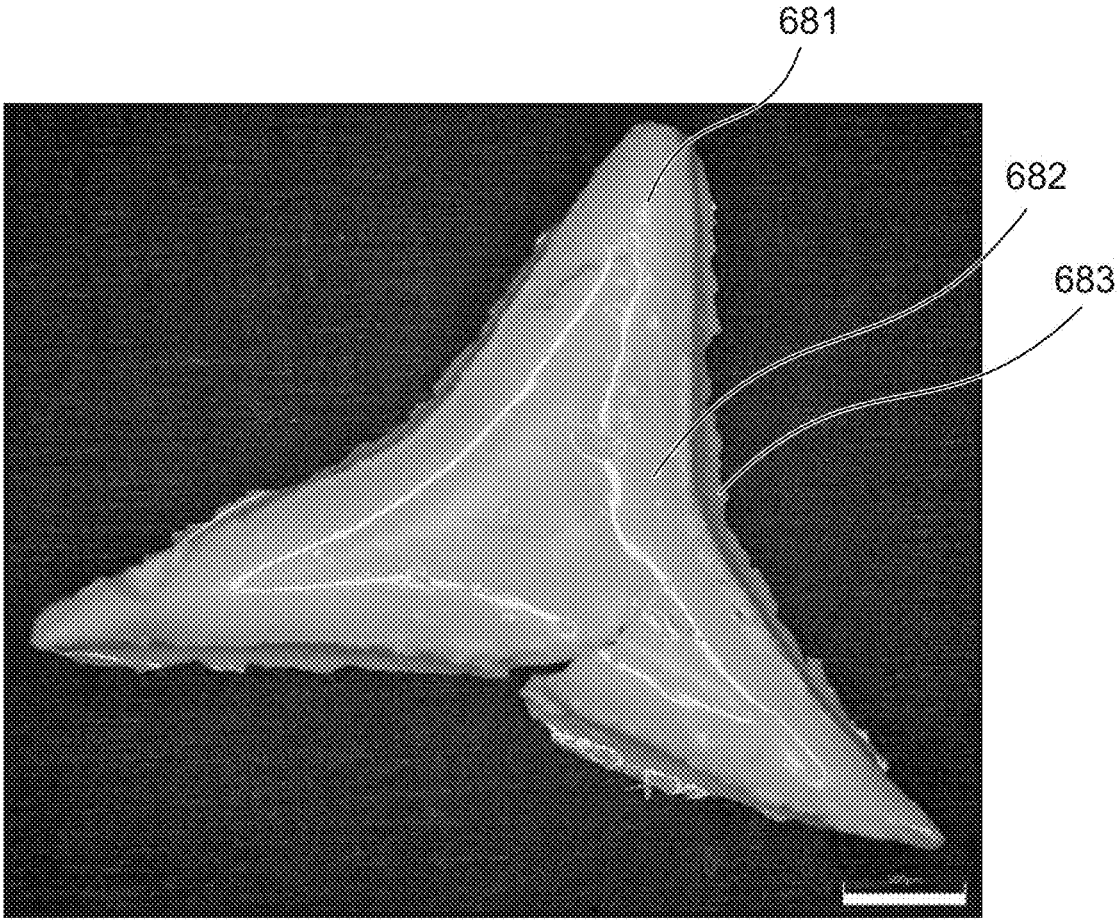
FIG. 6C includes an image of 3-PT star-shaped abrasive particle.

As noted herein, the body 601 can have a first side surface 654 extending between the first arm 606 and the third arm 608. In certain instances, the first side surface 654 can have an arcuate contour. For example, turning briefly to FIG. 6C, a top view image of a shaped abrasive particle according to an embodiment is provided. Notably, the shaped abrasive particle of FIG. 6C can include a 3-PT star having a body 681 and an arcuate side surface 682 extending between two points. In particular instances, the side surface 682 can have a concave contour defining a curved portion extending inward toward the central portion 683 of the body 681.

Referring again to FIG. 6A, the body 601 can have a first side surface 654 having a first side section 658 and a second side section 659. The first side section 658 can extend between the first tip 606 and the midpoint 651 and the second side section 659 can extend between the third tip 608 and the midpoint 651. The first side section 658 and second side section 659 can define an interior angle 662 that can be obtuse. For example, the interior angle 662 can be greater than about 90 degrees, such as greater than about 95 degrees, greater than about 100 degrees, greater than about 110 degrees, or even greater than about 120 degrees. Still, in one non-limiting embodiment, the interior angle 662 can be not greater than about 320 degrees, such as not greater than about 300 degrees, or even not greater than about 270 degrees. It will be appreciated that the interior angle can be within a range between any of the minimum and maximum values noted above.

The first side section 658 can extend for a significant portion of the length of the first side surface 654. For example, the first side section 658 can extend for at least about 20%, such as at least about 25%, at least about 30%, at least about 35%, or even at least about 40% of a total length of the first side surface 654. Still, in one non-limiting embodiment, the first side section 658 can have a length (ls1) between the midpoint 651 and the first tip 606 of not greater than about 80%, such as not greater than about 75%, not greater than about 70%, or even not greater than about 5% of the total length of the side surface 654. It will be appreciated that the length of the first side section 658 can be within a range between any of the minimum and maximum percentages noted above.

The second side section 659 can extend for a significant portion of the length of the first side surface 654. For example, the second side section 659 can extend for at least about 20%, such as at least about 25%, at least about 30%, at least about 35%, or even at least about 40% of a total length of the first side surface 654. Still, in one non-limiting embodiment, the second side section 659 can have a length (ls2) between the midpoint 651 and the third tip 608 of not greater than about 80%, such as not greater than about 75%, not greater than about 70%, or even not greater than about 5% of the total length of the side surface 654 as a straight line between the first tip 606 and the third tip 608. It will be appreciated that the length of the second side section 659 can be within a range between any of the minimum and maximum percentages noted above.

The body 601 can include a first average side surface angle 631 between the side surfaces 654, 655, and 656 and the upper surface or first major surface 610. The body can also include a second side surface angle 632 between the side surfaces 654, 655, and 656 and the second major surface or base surface 612.

In an embodiment, the abrasive particles may include a particular first side surface angle that may facilitate improved performance and/or manufacturing of the abrasive particles. In an embodiment, the first side surface angle can be within a range of at least 70 degrees and not greater than 94 degrees or within a range of at least 80 degrees and not greater than 93 degrees or within a range of at least 83 degrees and not greater than 92 degrees or within a range of at least 85 degrees and not greater than 91 degrees.

In an embodiment, the abrasive particles may include a particular second side surface angle that may facilitate improved performance and/or manufacturing of the abrasive particles. In an embodiment, the second side surface angle can be within a range of at least 70 degrees and not greater than 94 degrees or within a range of at least 80 degrees and not greater than 93 degrees or within a range of at least 83 degrees and not greater than 92 degrees or within a range of at least 85 degrees and not greater than 91 degrees.

While the foregoing body 601 of the 3-PT star has been shown to have an upper surface 610 having a two-dimensional shape, as viewed in the plane of the length and width of the body, that is substantially the same as the two-dimensional shape of the base surface or second major surface 611 of the body 601, other shapes are contemplated. For example, in one embodiment, the cross-sectional shape of the body at the base surface can define a base surface shape from the group consisting of a 3-PT star, a 4-PT star, a cross-shape, a polygon, ellipsoids, numerals, Greek alphabet characters, Latin alphabet characters, Russian alphabet characters, complex shapes having a combination of polygonal shapes, and a combination thereof. Moreover, the cross-sectional shape of the body at the upper surface can define an upper surface shape, which can be different than the base surface shape and selected from the group of a 3-PT star, a 4-PT star, a cross-shape, a polygon, ellipsoids, numerals, Greek alphabet characters, Latin alphabet characters, Russian alphabet characters, complex shapes having a combination of polygonal shapes, and a combination thereof.

In particular instances, the upper surface shape can have an arcuate form of the base surface shape. For example, the upper surface shape can define an arcuate 3-PT two-dimensional shape, wherein the arcuate 3-PT two-dimensional shape defines arms having rounded ends. In particular, the arms as defined at the base surface can have a smaller radius of curvature at the tip as compared to the radius of curvature of the corresponding tip at the upper surface.

As described in other embodiments herein, it will be appreciated that at least one of the arms of the body 601 may be formed to have a twist, such that the arm twists around a central axis. For example, the first arm 603 may twist around the axis 660. Moreover, the body 601 can be formed such that at least one arm extends in an arcuate path from the central region.

In an embodiment, the plurality of shaped abrasive particles may define a first group of abrasive particles. In an embodiment, the first group of abrasive particles may include at least two different types of shaped abrasive particles, wherein the two different types of shaped abrasive particles are different from each other based on at least one characteristic selected from the group of particle size, two-dimensional shape, three-dimensional shape, composition, hardness, toughness, friability, density, grain size, agglomeration state, lateral position, longitudinal position, rotational orientation, or any combination thereof.

In an embodiment, the abrasive article may include a second group of abrasive particles different than the first group of abrasive particles. The second group of abrasive particles can be different from the first group of abrasive particles based on at least one characteristic selected from the group of particle size, two-dimensional shape, three-dimensional shape, composition, hardness, toughness, friability, density, grain size, agglomeration state, lateral position, longitudinal position, rotational orientation, or any combination thereof. In a further embodiment, the second group of abrasive particles comprises diluent abrasive particles. In another embodiment, the second group of particles can include randomly shaped or non-shaped abrasive particles.

Shaped abrasive particles may be formed through particular processes, including molding, printing, casting, extrusion, and the like. Shaped abrasive particles can be formed such that each particle has substantially the same arrangement of surfaces and edges relative to each other. For example, a group of shaped abrasive particles generally have the same arrangement and orientation and or two-dimensional shape of the surfaces and edges relative to each other. As such, the shaped abrasive particles have a relatively high shape fidelity and consistency in the arrangement of the surfaces and edges relative to each other. By contrast, non-shaped particles can be formed through different processes and have different shape attributes compared to shaped abrasive particles/For example, non-shaped particles are typically formed by a comminution process wherein a mass of material is formed and then crushed and sieved to obtain abrasive particles of a certain size. However, a non-shaped particle will have a generally random arrangement of surfaces and edges, and generally will lack any recognizable two-dimensional or three-dimensional shape in the arrangement of the surfaces and edges. Moreover, non-shaped particles do not necessarily have a consistent shape with respect to each other, and therefore have a significantly lower shape fidelity compared to shaped abrasive particles. The non-shaped particles generally are defined by a random arrangement of surfaces and edges for each particle and with respect to other non-shaped particles.

In an embodiment, the abrasive article can include a certain percentage of cracked abrasive particles that may facilitate improved performance or manufacturing of the abrasive article. As defined herein, cracks in the plurality of shaped abrasive particles include cracks visible with a magnification such that the width of the particle is equal to 50% to 95% of the field of view. In an embodiment, the abrasive article can include a plurality of shaped abrasive particles having at least 3 interior corners where not greater than 50% of the total number of shaped abrasive particles have a crack at an interior corner on the first major surface or not greater than 45% or not greater than 40% or not greater than 35% or not greater than 30% or not greater than 25% or not greater than 20% or not greater than 18% or not greater than 16% or not greater than 14% or not greater than 12% or not greater than 10% or not greater than 9% or not greater than 8% or not greater than 7% or not greater than 6% or not greater than 5% or not greater than 4% or not greater than 3% or not greater than 2% or not greater than 1%. In an embodiment, the abrasive article can include a plurality of shaped abrasive particles having at least 3 interior corners where not greater than 50% of the total number of shaped abrasive particles have a crack at an interior corner on the first major surface or not greater than 45% or not greater than 40% or not greater than 35% or not greater than 30% or not greater than 25% or not greater than 20% or not greater than 18% or not greater than 16% or not greater than 14% or not greater than 12% or not greater than 10% or not greater than 9% or not greater than 8% or not greater than 7% or not greater than 6% or not greater than 5% or not greater than 4% or not greater than 3% or not greater than 2% or not greater than 1%. In an embodiment, the abrasive article can include a plurality of shaped abrasive particles having a body having at least 3 interior corners, and wherein at least 0.01% of the total number of shaped abrasive particles have a crack at an interior corner on the first major surface or at least 0.5% or at least 1% or at least 2% or at least 3% or at least 4% or at least 5% or at least 8% or at least 10%. In an embodiment, the abrasive article can include a plurality of shaped abrasive particles having a body having at least 3 interior corners, and wherein at least 0.01% of the total number of shaped abrasive particles have a crack at an interior corner on the second major surface or at least 0.5% or at least 1% or at least 2% or at least 3% or at least 4% or at least 5% or at least 8% or at least 10%. It will be appreciated that the percentage of the plurality of shaped abrasive particles having a crack at an interior corner may be between any of the minimum and maximum values noted above, including, for example, but not limited to at least 0.5% and not greater than 50% or at least 5% and not greater than 30%.

In an embodiment, the abrasive article may include a plurality of shaped abrasive particles of a particular material that may facilitate improved manufacturing or performance of the abrasive article. In an embodiment, the abrasive article may include a plurality of shaped abrasive particles including a ceramic material. In an embodiment, the abrasive article may include a plurality of shaped abrasive particles including at least one of a nitride, oxide, carbide, boride, oxynitride, oxyboride, diamond, carbon-containing material, or any combination thereof. In an embodiment, the abrasive article may include a plurality of shaped abrasive particles including an oxide compound or complex, such as aluminum oxide, zirconium oxide, titanium oxide, yttrium oxide, chromium oxide, strontium oxide, silicon oxide, magnesium oxide, rare-earth oxides, or any combination thereof.

In an embodiment, the plurality of shaped abrasive particles can include a particular percentage of alumina that may facilitate improved performance and/or manufacturing of the abrasive article. In an embodiment, the shaped abrasives particles can include at least 80 wt. % alumina or at least 90 wt. % alumina or at least 91 wt. % alumina or at least 92 wt. % alumina or at least 93 wt. % alumina or at least 94 wt. % alumina or at least 95 wt. % alumina or at least 96 wt. % alumina or at least 97 wt. % alumina. In an embodiment, the shaped abrasive particles can include not greater than 99.5 wt. % alumina or not greater than 99 wt. % alumina or not greater than 98.5 wt. % alumina or not greater than 97.5 wt. % alumina or not greater than 97 wt. % alumina not greater than 96 wt. % alumina or not greater than 94 wt. % alumina. It will be appreciated that the percentage of alumina in the plurality of shaped abrasive particles may be between any of the minimum and maximum values noted above, including, for example, but not limited to, at least 80 wt. % and no greater than 99 wt. % or at least 93 wt. % and no greater than 97 wt. %.

In an embodiment, each shaped abrasive particle of the plurality of shaped abrasive particles can have a particular density that may facilitate improved manufacturing and/or performance of the abrasive article. In an embodiment, each shaped abrasive particle of the plurality of shaped abrasive particles can have a density of at least 95% theoretical density.

In an embodiment, each shaped abrasive particle of the plurality of shaped abrasive particles may have a particular grain size that may facilitate improved manufacturing and/or performance of the abrasive particles. In an embodiment, each shaped abrasive particle of the plurality of shaped abrasive particles may have an average grain (crystallite) size of not greater than 1 micron or not greater than 0.8 microns or not greater than 0.6 microns or not greater than 0.4 microns or not greater than 0.2 microns as measured according to the uncorrected intercept method. In an embodiment, each shaped abrasive particle of the plurality of shaped abrasive particles may have an average grain (crystallite) size of at least 0.01 microns or at least 0.05 microns. It will be appreciated that the grain size of the plurality of shaped abrasive particles may be between any of the minimum and maximum values noted above, including, for example, but not limited to, at least 0.01 microns and no greater than 1 micron or at least 0.05 microns and no greater than 0.8 microns.

In an embodiment, the abrasive article can include a particular density of shaped abrasive particles that may facilitate improved performance and/or manufacturing of the abrasive article. In an embodiment, the density of the plurality of shaped abrasive particle per square centimeter of the abrasive article may be not greater than about 70 particles/cm$^2$ or not greater than 65 particles/cm$^2$ or not greater than 60 particles/cm$^2$ or not greater than 55 particles/cm$^2$ or not greater than about 50 particles/cm$^2$. In an embodiment, the density of the plurality of shaped abrasive particles per square centimeter of the abrasive article is at least 5 particles/cm$^2$ or at least 10 particles/cm$^2$. It will be appreciated that the density of the plurality of shaped abrasive particles may be between any of the minimum and maximum values noted above, including, for example, but not limited to, at least 5 particles/cm$^2$ and no greater than 60 particles/cm$^2$ or at least 10 particles/cm$^2$ and no greater than 50 particles/cm$^2$.

In an embodiment, the abrasive article can include a particular density of well oriented abrasive particles that may facilitate improved performance and/or manufacturing of the abrasive article. In an embodiment, the density of well oriented abrasive particle per square centimeter of the abrasive article may be at least 42 grains/cm$^2$ or at least 43 grains/cm$^2$ or at least 44 grains/cm$^2$ or at least 45 grains/cm$^2$ or at least 46 grains/cm$^2$ or at least 47 grains/cm$^2$ or at least 48 grains/cm$^2$ or at least 49 grains/cm$^2$ or at least 50 grains/cm$^2$ or at least 51 grains/cm$^2$ or at least 52 grains/cm$^2$ or at least 53 grains/cm$^2$ or at least 54 grains/cm$^2$. In an embodiment, the density of well oriented abrasive particles per square centimeter of the abrasive can be not greater than 100 grains/cm$^2$ or not greater than 95 grains/cm$^2$ or not greater than 90 grains/cm$^2$ or not greater than 85 grains/cm$^2$ or not greater than 80 grains/cm$^2$ or not greater than 75 grains/cm$^2$ or not greater than 70 grains/cm$^2$ or not greater than 65 grains/cm$^2$ or not greater than 60 grains/cm$^2$. It will be appreciated that the density of well oriented abrasive particles may be between any of the minimum and maximum values noted above, including, for example, but not limited to, at least 42 particles/cm$^2$ and no greater than 60 particles/cm$^2$ or at least 49 particles/cm$^2$ and no greater than 70 particles/cm$^2$.

In an embodiment, the abrasive article can include a particular weight of make coat that may facilitate improved performance and/or manufacturing of the abrasive article. In an embodiment, the abrasive article can include at least than 1 lbs./rm or at least 2 lbs./rm or at least 3 lbs./rm or at least 4 lbs./rm or at least 5 lbs./rm or at least 6 lbs./rm or at least 7 lbs./rm or at least 8 lbs./rm or at least 9 lbs./rm or at least 10 lbs./rm or at least 11 lbs./rm or at least 12 lbs./rm or at least 13 lbs./rm or at least 14 lbs./rm or at least 15 lbs./rm or at least 16 lbs./rm. In another embodiment, the abrasive article can include not greater than 20 lbs./rm or not greater than 19.5 lbs./rm or not greater than 19 lbs./rm or not greater than 18.5 lbs./rm or not greater than 18 lbs./rm or not greater than 17.5 lbs./rm or not greater than 17 lbs./rm. It will be appreciated that the weight of make coat can be between any of the minimum and maximum values noted above, including, for example, at least 9 lbs./rm and not greater than 20 lbs./rm or at least 12 lbs./rm and not greater than 18.5 lbs/rm.

In an embodiment, the coated abrasive article can include an abrasive surface including the abrasive particles. In an embodiment, a certain percentage of total surface area of the abrasive surface can include the plurality of shaped abrasive particles. In an embodiment, not greater than 90% of a total surface area of the abrasive surface comprises the plurality of shaped abrasive particles or not greater than 80% or not greater than 70% or not greater than 60% or not greater than 50% or not greater than 40% or not greater than 30% or not greater than 20%. In an embodiment, at least 1% of the total surface area of the abrasive surface comprises the plurality of shaped abrasive particles or at least 5% or at least 8% or at least 10% or at least 15% or at least 20% or at least 25% or at least 30% or at least 35% or at least 40% or at least 45% or at least 50%. It will be appreciated that the percentage of total surface area of the abrasive surface including the plurality of shaped abrasive particles may be between any of the minimum and maximum values noted above, including for example, but not limited to, at least 5% and no greater than 50% or at least 15% and no greater than 80%.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1. An abrasive article comprising:

a backing;

a make coat overlying the backing;

a plurality of abrasive particles overlying the backing and at least partially contained in the make coat; and a make coat thickness ratio (Tg/Ta) of not greater than 1.5, wherein Tg is the average thickness of the make coat at the sides of the abrasive particles and the Ta is the average thickness of the make coat.

Embodiment 2. The abrasive article of embodiment 1, wherein the abrasive particles comprise shaped abrasive particles and/or elongated abrasive particles.

Embodiment 3. The abrasive article of embodiment 1, wherein the thickness ratio (Tg/Ta) is not greater than 1.45 or not greater than 1.43 or not greater than 1.40 or not greater than 1.38 or not greater than 1.35 or not greater than 1.33 or not greater than 1.30 or not greater than 1.28 or not greater than 1.25 or not greater than 1.23 or not greater than 1.20 or not greater than 1.18 or not greater than 1.15 or not greater than 1.13 or not greater than 1.10 or not greater than 1.08 or not greater than 1.05 or not greater than 1.03.

Embodiment 4. The abrasive article of embodiment 1, wherein the thickness ratio (Tg/Ta) is at least 0.70 or at least 0.80 or at least 0.90 or at least 0.98 or at least 1.00 or at least 1.03 or at least 1.05 or at least 1.08.

Embodiment 5. The abrasive article of embodiment 1, wherein the average thickness of the make coat at the sides of the grains (Tg) is at least 50 microns or at least 60 microns or at least 70 microns or at least 80 microns or at least 90 microns or at least 100 microns or at least 110 microns or at least 120 microns or at least 130 microns or at least 140 microns or at least 150 microns.

Embodiment 6. The abrasive article of embodiment 1, wherein the average thickness of the make coat at the sides of the grains (Tg) is not greater than 1 mm or not greater than 800 microns or not greater than 700 microns or not greater than 600 microns or not greater than 500 microns or not greater than 400 microns or not greater than 300 microns.

Embodiment 7. The abrasive article of embodiment 1, wherein the make coat comprises a thickness standard deviation at the sides of the abrasive particles (STDTg) of not greater than 100 microns or not greater than 90 microns or not greater than 85 microns or not greater than 80 microns or not greater than 75 microns or not greater than 70 microns or not greater than 65 microns or not greater than 60 microns or not greater than 55 microns or not greater than 50 microns or not greater than 45 microns or not greater than 40 microns or not greater than 35 microns or not greater than 30 microns.

Embodiment 8. The abrasive article of embodiment 7, wherein the make coat comprises a thickness standard deviation at the sides of the abrasive particles (STDTg) of at least 1 micron or at least 5 microns or at least 10 microns or at least 15 microns or at least 20 microns or at least 25 microns or at least 30 microns.

Embodiment 9. The abrasive article of embodiment 1, wherein the average thickness of the make coat (Ta) is at least 50 microns or at least 60 microns or at least 70 microns or at least 80 microns or at least 90 microns or at least 100 microns or at least 110 microns or at least 120 microns or at least 130 microns or at least 140 microns or at least 150 microns or at least 160 microns.

Embodiment 10. The abrasive article of embodiment 1, wherein the average thickness of the make coat (Ta) is not greater than 1 mm or not greater than 800 microns or not greater than 700 microns or not greater than 600 microns or not greater than 500 microns or not greater than 400 microns or not greater than 300 microns or not greater than 275 microns or not greater than 250 microns or not greater than 225 microns or not greater than 200 microns.

Embodiment 11. The abrasive article of embodiment 1, wherein the make coat comprises a thickness standard deviation (STDT) of not greater than 100 microns or not greater than 90 microns or not greater than 85 microns or not greater than 80 microns or not greater than 75 microns or not greater than 70 microns or not greater than 65 microns or not greater than 60 microns or not greater than 55 microns or not greater than 50 microns or not greater than 45 microns or not greater than 40 microns or not greater than 35 microns or not greater than 30 microns or not greater than 25 microns or not greater than 20 microns or not greater than 15 microns or not greater than 10 microns.

Embodiment 12. The abrasive article of embodiment 11, wherein the make coat comprises a thickness standard deviation (STDT) of at least 1 micron or at least 2 microns or at least 3 microns or at least 4 microns or at least 5 microns or at least 7 microns or at least 10 microns or at least 12 microns or at least 15 microns or at least 18 microns or at least 20 microns or at least 22 microns or at least 25 microns or at least 28 microns or at least 30 microns.

Embodiment 13. The abrasive article of embodiment 1, wherein at least a portion of the abrasive particles comprise a random rotational orientation.

Embodiment 14. The abrasive article of embodiment 13, wherein a portion includes at least 10% of the total number of abrasive particles or at least 20% or at least 30% or at least 40% or at least 50% or at least 60% or at least 70% or at least 80% or at least 90% or essentially all the abrasive particles have a random rotational orientation.

Embodiment 15. The abrasive article of embodiment 1, further comprising a standing portion of abrasive particles have a standing orientation, wherein the standing portion includes at least 10% of the total number of the abrasive particles or at least 20% or at least 30% or at least 40% or at least 50% or at least 55% or at least 57% or at least 60% or at least 62% or at least 65% or at least 67% or at least 70% or at least 72% or at least 75% or at least 77% or at least 80% or at least 82% or at least 85% or at least 87% or at least 90% of the total number of the abrasive particles.

Embodiment 16. The abrasive article of embodiment 15, wherein the standing portion is not greater than 99.9% of the total number of the abrasive particles or not greater than 99% or not greater than 98% or not greater than 97% or not greater than 96% or not greater than 95% of the total number of the abrasive particles.

Embodiment 17. The abrasive article of embodiment 1, further comprising a slanted portion of abrasive particles have a slanted orientation, wherein the slanted portion includes at least 1% of the total number of the abrasive particles or at least 2% or at least 3% or at least 4% or at least 5% or at least 6% or at least 7% or at least 8% or at least 9% or at least 10% or at least 11% or at least 12% or at least 13% or at least 14% or at least 15% or at least 16% or at least 17% or at least 18% or at least 20% or at least 25% of the total number of the abrasive particles.

Embodiment 18. The abrasive article of embodiment 17, wherein the slanted portion is not greater than 90% of the total number of the abrasive particles or not greater than 85% or not greater than 80% or not greater than 75% or not greater than 70% or not greater than 65% or not greater than 60% or not greater than 55% or not greater than 50% or not greater than 45% or not greater than 40% or not greater than 35% or not greater than 30% or not greater than 25% or not greater than 20% or not greater than 18% or not greater than 15% or not greater than 12% or not greater than 10% of the total number of the abrasive particles.

Embodiment 19. The abrasive article of embodiment 1, further comprising a standing portion of abrasive particles (Pst) having a standing orientation and a slanted portion (Psl) of abrasive particles having a slanted orientation, and further comprising a ratio of the standing portion relative to the slanted portion (PSt/Psl) of at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6.

Embodiment 20. The abrasive article of embodiment 19, wherein the ratio of the standing portion relative to the slanted portion (PSt/Psl) is not greater than 100 or not greater than 95 or not greater than 90 or not greater than 80 or not greater than 70 or not greater than 60 or not greater than 50 or not greater than 40 or not greater than 30 or not greater than 20 or not greater than 10.

Embodiment 21. The abrasive article of embodiment 1, further comprising a fallen portion of abrasive particles have a fallen orientation, wherein the fallen portion includes at least 0.1% of the total number of the abrasive particles or at least 0.2% or at least 0.4% or at least 0.6% or at least 0.8% or at least 1% or at least 1.5% or at least 2% or at least 2.5% or at least 3% or at least 3.5% or at least 4% or at least 4.5% or at least 5% of the total number of the abrasive particles.

Embodiment 22. The abrasive article of embodiment 21, wherein the fallen portion is not greater than 20% of the total number of the abrasive particles or not greater than 18% or not greater than 15% or not greater than 12% or not greater than 10% or not greater than 9% or not greater than 8% or not greater than 7% or not greater than 6% or not greater than 5% of the total number of the abrasive particles.

Embodiment 23. The abrasive article of embodiment 1, further comprising a standing portion of abrasive particles (Pst) having a standing orientation and a fallen portion (Pt) of abrasive particles having a fallen orientation, and further comprising a ratio of the standing portion relative to the fallen portion (PSt/Pf) of at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6 or at least 5.8 or at least 6.0 or at least 6.2 or at least 6.4 or at least 6.6 or at least 6.8 or at least 7.0 or at least 7.2 or at least 7.4 or at least 7.6 or at least 7.8 or at least 8.0.

Embodiment 24. The abrasive article of embodiment 23, wherein the ratio of the standing portion relative to the fallen portion (PSt/Pf) is not greater than 1000 or not greater than 800 or not greater than 500 or not greater than 200 or not greater than 100 or not greater than 95.

Embodiment 25. The abrasive article of embodiment 1, further comprising a slanted portion of abrasive particles (Psl) having a slanted orientation and a fallen portion (Pt) of abrasive particles having a fallen orientation, and further comprising a ratio of the slanted portion relative to the fallen portion (PSl/Pf) of at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6.

Embodiment 26. The abrasive article of embodiment 25, wherein the ratio of the slanted portion relative to the fallen portion (PSl/Pf) is not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6.

Embodiment 27. The abrasive article of embodiment 1, further comprising an inverted portion of abrasive particles have an inverted orientation, wherein the inverted portion includes at least 0.1% of the total number of the abrasive particles or at least 0.2% or at least 0.4% or at least 0.6% or at least 0.8% or at least 1% or at least 1.5% or at least 2% or at least 2.5% or at least 3% or at least 3.5% or at least 4% or at least 4.5% or at least 5% of the total number of the abrasive particles.

Embodiment 28. The abrasive article of embodiment 27, wherein the inverted portion is not greater than 20% of the total number of the abrasive particles or not greater than 18% or not greater than 15% or not greater than 12% or not greater than 10% or not greater than 9% or not greater than 8% or not greater than 7% or not greater than 6% or not greater than 5% of the total number of the abrasive particles.

Embodiment 29. The abrasive article of embodiment 1, further comprising a standing portion of abrasive particles (Pst) having a standing orientation and an inverted portion (Pi) of abrasive particles having an inverted orientation, and further comprising a ratio of the standing portion relative to the inverted portion (PSt/Pi) of at least 1 or at least 2.0 or at least 3.0 or at least 4.0 or at least 5.0 or at least 6 or at least 7 or at least 8 or at least 9 or at least 10 or at least 12 or at least 15 or at least 18 or at least 20 or at least 25 or at least 30 or at least 40 or at least 50.

Embodiment 30. The abrasive article of embodiment 29, wherein the ratio of the standing portion to the inverted portion (PSt/Pi) of not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6.

Embodiment 31. The abrasive article of embodiment 1, further comprising a slanted portion of abrasive particles (Psl) having a slanted orientation and an inverted portion (Pi) of abrasive particles having an inverted orientation, and further comprising a ratio of the slanted portion relative to the inverted portion (PSl/Pi) of at least 0.6 or at least 0.7 or at least 0.8 or at least 0.9 or at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0 or at least 5.2 or at least 5.4 or at least 5.6.

Embodiment 32. The abrasive article of embodiment 30, wherein the ratio of the slanted portion relative to the inverted portion (PSl/Pi) of not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6 or not greater than 4 or not greater than 3 or not greater than 2 or not greater than 1.5.

Embodiment 33. The abrasive article of embodiment 1, further comprising a fallen portion of abrasive particles (Pf) having a fallen orientation and an inverted portion (Pi) of abrasive particles having an inverted orientation, and further comprising a ratio of the fallen portion relative to the inverted portion (Pf/Pi) of at least 0.6 or at least 0.7 or at least 0.8 or at least 0.9 or at least 1 or at least 1.2 or at least 1.4 or at least 1.6 or at least 1.8 or at least 2.0 or at least 2.2 or at least 2.4 or at least 2.6 or at least 2.8 or at least 3.0 or at least 3.2 or at least or at least 3.4 or at least 3.6 or at least 3.8 or at least 4.0 or at least 4.2 or at least 4.4 or at least 4.6 or at least 4.8 or at least 5.0.

Embodiment 34. The abrasive article of embodiment 33, wherein the ratio of the fallen portion relative to the inverted portion (Pf/Pi) of not greater than 100 or not greater than 95 or not greater than 90 or not greater than 80 or not greater than 70 or not greater than 60 or not greater than 50 or not greater than 40 or not greater than 30 or not greater than 20 or not greater than 10 or not greater than 8 or not greater than 6 or not greater than 4 or not greater than 3 or not greater than 2 or not greater than 1.5.

Embodiment 35. The abrasive article of embodiment 1, further comprising a standing portion of abrasive particles (Pst) having a standing orientation and a slanted portion (Psl) of abrasive particles having a slanted orientation, and further comprising a well-oriented percentage represented by the sum of the standing portion (%) plus the slanted portion (%) relative to all of the abrasive particles (i.e., 100%), wherein the well-oriented percentage is at least 60% or at least 62% or at least 65% or at least 67% or at least 70% or at least 72% or at least 75% or at least 77% or at least 80% or at least 82% or at least 85% or at least 87% or at least 90% or at least 92% or at least 95%.

Embodiment 36. The abrasive article of embodiment 35, wherein the well-oriented percentage is not greater than 99.9% or not greater than 99% or not greater than 98% or not greater than 97% or not greater than 96% or not greater than 95%.

Embodiment 37. The abrasive article of embodiment 1, further comprising a coating density of well oriented particles of at least 42 grains/$cm^2$ or at least 43 grains/$cm^2$ or at least 44 grains/$cm^2$ or at least 45 grains/$cm^2$ or at least 46 grains/$cm^2$ or at least 47 grains/$cm^2$ or at least 48 grains/$cm^2$ or at least 49 grains/$cm^2$ or at least 50 grains/$cm^2$ or at least 51 grains/$cm^2$ or at least 52 grains/$cm^2$ or at least 53 grains/$cm^2$ or at least 54 grains/$cm^2$.

Embodiment 38. The abrasive article of embodiment 37, comprising a coating density of well oriented particles of not greater than 100 grains/$cm^2$ or not greater than 95 grains/$cm^2$ or not greater than 90 grains/$cm^2$ or not greater than 85 grains/$cm^2$ or not greater than 80 grains/$cm^2$ or not greater than 75 grains/$cm^2$ or not greater than 70 grains/$cm^2$ or not greater than 65 grains/$cm^2$ or not greater than 60 grains/$cm^2$.

Embodiment 39. The abrasive article of embodiment 1, wherein the make coat comprises a make coat add on weight of not greater than 20 lbs./rm or not greater than 19.5 lbs./rm or not greater than 19 lbs./rm or not greater than 18.5 lbs./rm or not greater than 18 lbs./rm or not greater than 17.5 lbs./rm or not greater than 17 lbs./rm.

Embodiment 40. The abrasive article of embodiment 39, wherein the make coat comprises a make coat add on weight of at least than 1 lbs./rm or at least 2 lbs./rm or at least 3 lbs./rm or at least 4 lbs./rm or at least 5 lbs./rm or at least 6 lbs./rm or at least 7 lbs./rm or at least 8 lbs./rm or at least 9 lbs./rm or at least 10 lbs./rm or at least 11 lbs./rm or at least 12 lbs./rm or at least 13 lbs./rm or at least 14 lbs./rm or at least 15 lbs./rm or at least 16 lbs./rm.

Embodiment 41. The abrasive article of embodiment 1, wherein the abrasive particles include shaped abrasive particles or elongated abrasive particles, and where each of the shaped abrasive particles or elongated abrasive particles include a body having a length (l), a width (w) and a thickness (t), wherein the width>thickness and the length>thickness.

Embodiment 42. The abrasive article of embodiment 41, wherein the shaped abrasive particles having a 3-PT star two-dimensional shape as viewed in a plane of a length and width of the body.

Embodiment 43. The abrasive article of embodiment 41, wherein each of the shaped abrasive particles or elongated abrasive particles of the plurality of shaped abrasive particles or elongated abrasive particles comprises a body including a first major surface, a second a major surface opposite the first major surface, and a side surface extending between the first major surface and the second major surface, wherein the body comprises at least 3 exterior corners and wherein the side surface comprises at least 4 side surface sections, or at least 5 side surface sections or at least 6 side surface sections.

Embodiment 44. The abrasive article of embodiment 41, wherein the plurality of shaped abrasive particles or elongated abrasive particles comprises an average side surface angle between the side surface and the first major surface of at least 70 degrees and not greater than 94 degrees or within a range of at least 80 degrees and not greater than 93 degrees or within a range of at least 83 degrees and not greater than 92 degrees or within a range of at least 85 degrees and not greater than 91 degrees.

Embodiment 45. The abrasive article of embodiment 41, wherein the plurality of shaped abrasive particles or elongated abrasive particles comprise an average side surface angle between the side surface and the second major surface of at least 70 degrees and not greater than 94 degrees or within a range of at least 80 degrees and not greater than 93 degrees or within a range of at least 83 degrees and not greater than 92 degrees or within a range of at least 85 degrees and not greater than 91 degrees.

Embodiment 46. The abrasive article of embodiment 41, wherein each of the shaped abrasive particles or elongated abrasive particles of the plurality of shaped abrasive particles or elongated abrasive particles comprises a body having at least 3 exterior corners, wherein the sum of the angles of the exterior corners is less than 180 degrees.

Embodiment 47. The abrasive article of embodiment 46, wherein each of the shaped abrasive particles or elongated abrasive particles of the plurality of shaped abrasive particles or elongated abrasive particles comprises a body having at least 3 exterior corners, wherein each of the exterior corners defines an angle less than 60 degrees or less than 59 degrees or less than 58 degrees or less than 57 degrees or less than 56 degrees or less than 55 degrees.

Embodiment 48. The abrasive article of embodiment 41, wherein each of the shaped abrasive particles or elongated abrasive particles of the plurality of shaped abrasive particles or elongated abrasive particles comprises a body having at least 3 exterior corners and at least 3 interior corners, wherein each of the interior corners have an interior corner angle value greater than any of the exterior corner values of any of the at least 3 exterior corners.

Embodiment 49. The abrasive article of embodiment 41, wherein each of the shaped abrasive particles or elongated abrasive particles of the plurality of shaped abrasive particles or elongated abrasive particles comprises a body having at least 3 interior corners, and wherein not greater than 50% of the total number of a plurality of shaped abrasive particles or elongated abrasive particles have a crack at an interior corner or not greater than 45% or not greater than 40% or not greater than 35% or not greater than 30% or not greater than 25% or not greater than 20% or not greater than 18% or not greater than 16% or not greater than 14% or not greater than 12% or not greater than 10% or not greater than 9% or not greater than 8% or not greater than 7% or not greater than 6% or not greater than 5% or not greater than 4% or not greater than 3% or not greater than 2% or not greater than 1%.

Embodiment 50. The abrasive article of embodiment 49, wherein each of the shaped abrasive particles or elongated abrasive particles of the plurality of shaped abrasive particles or elongated abrasive particles comprises a body having at least 3 interior corners, and wherein at least 0.01% of the total number of a plurality of shaped abrasive particles or elongated abrasive particles have a crack at an interior corner or at least 0.5% or at least 1% or at least 2% or at least 3% or at least 4% or at least 5% or at least 8% or at least 10%.

Embodiment 51. The abrasive article of embodiment 41, wherein the abrasive particles comprise a ceramic material.

Embodiment 52. The abrasive article of embodiment 51, wherein the abrasive particles comprise at least one of a nitride, oxide, carbide, boride, oxynitride, oxyboride, diamond, carbon-containing material, or any combination thereof.

Embodiment 53. The abrasive article of embodiment 51, wherein the abrasive particles comprise an oxide compound or complex, such as aluminum oxide, zirconium oxide, titanium oxide, yttrium oxide, chromium oxide, strontium oxide, silicon oxide, magnesium oxide, rare-earth oxides, or any combination thereof.

Embodiment 54. The abrasive article of embodiment 51, wherein the abrasive particles comprise at least 80 wt. % alumina or at least 90 wt. % alumina or at least 91 wt. % alumina or at least 92 wt. % alumina or at least 93 wt. % alumina or at least 94 wt. % alumina or at least 95 wt. % alumina or at least 96 wt. % alumina or at least 97 wt. % alumina.

Embodiment 55. The abrasive article of embodiment 51, wherein the abrasive particles comprise not greater than 99.5 wt. % alumina or not greater than 99 wt. % alumina or not greater than 98.5 wt. % alumina or not greater than 97.5 wt. % alumina or not greater than 97 wt. % alumina not greater than 96 wt. % alumina or not greater than 94 wt. % alumina.

Embodiment 56. The abrasive article of embodiment 1, wherein the abrasive particles have an average density of at least 95% theoretical density.

Embodiment 57. The abrasive article of embodiment 1, wherein the abrasive particles comprise an average grain (crystallite) size of not greater than 1 micron or not greater than 0.8 microns or not greater than 0.6 microns or not greater than 0.4 microns or not greater than 0.2 microns as measured according to the uncorrected intercept method.

Embodiment 58. The abrasive article of embodiment 57, wherein each shaped abrasive particles or elongated abrasive particles of the plurality of shaped abrasive particles or elongated abrasive particles comprises an average grain (crystallite) size of at least 0.01 microns or at least 0.05 microns.

Embodiment 59. The abrasive article of embodiment 1, wherein an areal density of the abrasive particles per square centimeter of the abrasive article may be not greater than about 70 particles/$cm^2$ or not greater than 65 particles/$cm^2$ or not greater than 60 particles/$cm^2$ or not greater than 55 particles/$cm^2$ or not greater than about 50 particles/$cm^2$.

Embodiment 60. The abrasive article of embodiment 59, wherein the areal density is at least 5 particles/$cm^2$ or at least 10 particles/$cm^2$.

Embodiment 61. The abrasive article of embodiment 1, further comprising an abrasive surface including the abrasive particles and at least one adhesive layer, wherein not greater than 90% of a total surface area of the abrasive surface includes the abrasive particles or not greater than 80% or not greater than 70% or not greater than 60% or not greater than 50% or not greater than 40% or not greater than 30% or not greater than 20%.

Embodiment 62. The abrasive article of embodiment 1, wherein at least 1% of the total surface area of the abrasive surface comprises the abrasive particles or at least 5% or at least 8% or at least 10% or at least 15% or at least 20% or at least 25% or at least 30% or at least 35% or at least 40% or at least 45% or at least 50%.

Embodiment 63. The abrasive article of embodiment 1, wherein the abrasive particles include a first group of abrasive particles and a second group of abrasive particles.

Embodiment 64. The abrasive article of embodiment 63, wherein the first group of abrasive particles includes at least two different types of shaped abrasive particles, wherein the two different types of shaped abrasive particles are different from each other based on at least one characteristic selected from the group of particle size, two-dimensional shape, three-dimensional shape, composition, hardness, toughness, friability, density, grain size, agglomeration state, lateral position, longitudinal position, rotational orientation, or any combination thereof.

Embodiment 65. The abrasive article of embodiment 63, further comprising a second group of abrasive particles different than the first group of abrasive particles.

Embodiment 66. The abrasive article of embodiment 65, wherein the second group of abrasive particles comprises diluent abrasive particles.

Embodiment 67. The abrasive article of embodiment 65, wherein the second group of abrasive particles comprises randomly shaped abrasive particles.

Embodiment 68. The abrasive article of embodiment 65, wherein the second group of abrasive particles are different from the first group of abrasive particles based on at least one characteristic selected from the group of particle size, two-dimensional shape, three-dimensional shape, composition, hardness, toughness, friability, density, grain size, agglomeration state, lateral position, longitudinal position, rotational orientation, or any combination thereof.

Embodiment 69. A coated abrasive article having the features of embodiment 1, including the backing having a major surface and an abrasive layer forming an abrasive surface overlying the major surface of the backing, wherein the abrasive layer forms substantially a single layer of abrasive particles adhered to the major surface of the backing by one or more adhesive layers.

Embodiment 70. An abrasive article comprising:

a backing;

a make coat overlying the backing;

a plurality of abrasive particles overlying the backing and at least partially contained in the make coat; and a thickness standard deviation of the make coat at the sides of the plurality of abrasive particles (STDTg) of at least 1 micron or not greater than 60 microns.

Embodiment 71. The abrasive article of embodiment 66, further comprising any one or a combination of any of the claims or embodiments herein.

Embodiment 72. A process for forming a coated abrasive article comprising:

providing a backing;

forming a make coat overlying the backing;

placing a plurality of abrasive particles overlying the backing and at least partially contained in the make coat; and a thickness standard deviation of the make coat at the sides of the plurality of abrasive particles (STDTg) of at least 1 micron or not greater than 60 microns.

Embodiment 73. The abrasive article of embodiment 1, wherein the make coat comprises wollastonite, PF resin, water, or a combination thereof.

Embodiment 74. The abrasive article of embodiment 1, wherein the make coat comprises a viscosity of at least 3500 cps or at least 3750 cps or at least 4000 cps or at least 4250 cps or at least 4500 cps or at least 4750 cps or at least 5000 cps or at least 5250 cps.

Embodiment 75. The abrasive article of embodiment 1, wherein the make coat comprises a viscosity of no greater than 7000 cps or no greater than 6750 cps or no greater than 6500 cps or no greater than 6250 cps or no greater than 6000 cps or no greater than 5750.

Embodiment 76. The process of embodiment 72 wherein the abrasive article is the abrasive article of embodiment 1+70 or 73-75.

EXAMPLES

Example 1

Sample 1 and Comparative Sample 1 were prepared according to the following procedure having the specifications outlined in table 1. Backings were saturated with 20.5 lbs./rm of the following composition:

Latex: 63.85%

Cab-o-sil: 0.98%

Defoamer: 0.44%

Wetting Agent: 0.24%

Calcium Carbonate: 31.93%

Dye (reddish/pink): 2.56%

The saturated backing was backfilled with 7.1 lbs./rm of the following composition:

PF Resin: 59.13%

Defoamer: 0.3%

Wetting Agent: 0.66%

Solmod Tamol 165A: 2.01%

Wollastonite: 19.71%

Red Dye: 0.21%

Water: 17.98%

A make coat is applied to the saturated and backfilled backing via two roll coating. The make coat thickness is controlled by nip gap to achieve the desired add on weight. Abrasive particles are then applied to the wet make and the backing via electrostatic coating. The backing, make, and grains are then cured in an oven according to the curing schedule in table 1. Size and supersize coats are applied and cured in the same manner as the make coat according to the specifications in Table 1.

TABLE 1

| | Sample 1 | Comparative Sample 1 |
|---|---|---|
| Backing | 1 ply woven PET | 1 ply woven PET |
| | Make Coat | |
| PF resin | 49.34 wt. % | 49.34 wt. % |
| Silane A1100 | 0.44 wt. % | 0.44 wt. % |
| Wetting Agent | 0.15 wt. % | 0.15 wt. % |
| Wollastoinite | 49.34 wt. % | 49.34 wt. % |
| Water | 0.75 wt. % | 0.75 wt. % |
| Black dye | 1 wt. % | 1 wt. % |
| Nip Gap | 0.41 in. | 0.41 in. |
| Add on Weight | 16 lbs./rm | 20 lbs./rm |
| Curing Cycle | 20 min at 170° C. | 20 min at 170° C. |
| | 20 min at 190° C. | 20 min at 190° C. |
| | 20 min at 210° C. | 20 min at 210° C. |
| | 20 min at 235° C. | 20 min at 235° C. |
| | Abrasive Particles | |
| Type | 3-PT star, alumina | 3-PT star, alumina |
| Size | 36 grit | 36 grit |
| Add on Weight | 33 lbs./rm | 33 lbs./rm |
| | Size Coat | |
| PF resin | 46.95 wt. % | 46.95 wt. % |
| PET-3MP PolyThiol (PTM) | 4.69 wt. % | 4.69 wt. % |
| Defoamer | 0.09 wt. % | 0.09 wt. % |
| Solmod Tamol 165A | 2.35 wt. % | 2.35 wt. % |
| Water | 3.54 wt. % | 3.54 wt. % |
| Cryolite | 41.31 wt. % | 41.31 wt. % |
| Add on Weight | 32 lbs./rm | 32 lbs./rm |
| Curing Cycle | 20 min at 180° C. | 20 min at 180° C. |
| | 20 min at 200° C. | 20 min at 200° C. |
| | 20 min at 220° C. | 20 min at 220° C. |
| | 20 min at 235° C. | 20 min at 235° C. |
| | Supersize Coat | |
| PF resin | 23 wt. % | 23 wt. % |
| Defoamer | 0.11 wt. % | 0.11 wt. % |
| Solmod Daxad 11 | 1.69 wt. % | 1.69 wt. % |
| Water | 7.77 wt. % | 7.77 wt. % |
| Orange Pigment | 2.78 wt. % | 2.78 wt. % |
| $KBF_4$ | 64.48 wt. % | 64.48 wt. % |
| Cab-o-sil | 0.17 wt. % | 0.17 wt. % |
| Add on Weight | 30 lbs./rm | 30 lbs./rm |
| Curing Cycle | 20 min at 170° C. | 20 min at 170° C. |
| | 20 min at 190° C. | 20 min at 190° C. |
| | 20 min at 210° C. | 20 min at 210° C. |
| | 20 min at 235° C. | 20 min at 235° C. |

Conventional sample 1 was a 3M™ Cubitron™ II Cloth Belt 984F 36+grit.

Average make coat thickness was measured according to the following procedure. The samples were cut through the middle to reveal a cross section. The samples are then cut into 2-inch segments and mounted on an epoxy puck. Two 2-inch segments are then imaged, and the make layer is identified by coloring in the layer using the imaging software. FIG. 10 includes an example image of an abrasive article include a colored make layer. Image analysis is used to overlay vertical gridlines, and the line segments overlapping the make layer were identified and isolated. Each line segment corresponds to a make coat thickness measurement. The average of all segments was taken. Approximately 150-200 overlapping line segments were made per two-inch sample segment, resulting in over 300 measurements for each sample.

Average make coat thickness near standing grains was measured according to the following procedure. The same cross-sectional images for average make coat thickness were also used for average make coat thickness near standing grains. Only standing grains showing their cross-sectional rectangular area with their short side in contact with the make coat were considered. For example, in FIG. 1, grain 102 would be considered but grain 103 would not. Additionally, only isolated grains were considered. Standing grains in contact with another grain were not considered for average make coat thickness near standing grains measurements. Measurements were made from the highest point of make contacting the grain side down to the lowest point of make contacting the backing on both sides of grain. The line of measurement is made perpendicular to the backing plane. The results for average make coat thickness and average make coat thickness near standing grains measurements can be found below in Table 2.

TABLE 2

| | S1 | Comparative S1 | Conventional S1 |
|---|---|---|---|
| Ta | 155 μm | 157 μm | 128 μm |
| Std Dev of Ta | 84 μm | 86 μm | 75 μm |
| Ta 95% confidence interval | 146-163 μm | 148-166 μm | 124-132 μm |
| Tg | 186 μm | 265 μm | 262 μm |
| Std Dev of Tg | 59 μm | 76 μm | 99 μm |
| Tg 95% confidence interval | 167-206 μm | 233-297 μm | 225-299 μm |
| Tg/Grain height | 0.16 | 0.22 | 0.22 |

Example 2

Samples 2 and 3 and comparative sample 2 were prepared according to the method for Sample 1 above and the specifications in table 3. No size or supersize coats were applied. Sample 2 is essentially the same as sample 1 without a size or supersize coat.

Reclaimed Cubitron grains were reclaimed according to the following procedure. A 3M™ Cubitron™ II Cloth Belt 984F 36+grit was obtained. The belt was burned until only abrasive particles and ash remained. The abrasive particles and burnoff were then allowed to soak in a 400 ml glass beaker filled with hydrochloric acid. Enough acid to just cover the grains burnoff was used. The contents were boiled for 10 minutes and then allowed to cool. The solution was then diluted with DI water and then the liquid was disposed of. The beaker with the abrasive particles was then allowed to dry for 2 hours at 60-70° C. The particles and remaining ash were then transferred to a 250 ml Erlenmeyer flask. 50% hydrofluoric acid was added to the flask so that the abrasive particles were just covered. The particles were allowed to soak for 30 minutes. The acid was then diluted with DI water and the liquid was disposed of. The flask was allowed to dry for 2 hours at 60-70° C. The flask and contents were then cooled to room temperature and the reclaimed and acid washed grains were removed.

Conventional sample 2 was prepared by removing the size and supersize coats from Conventional sample 1 via sand blasting.

TABLE 3

| | Sample 2 | Sample 3 | Comparative sample 2 |
|---|---|---|---|
| Backing | 1 ply woven PET | 1 ply woven PET | 1 ply woven PET |
| | Make Coat | | |
| PF resin | 49.34 wt. % | 49.34 wt. % | 49.34 wt. % |
| Silane A1100 | 0.44 wt. % | 0.44 wt. % | 0.44 wt. % |
| Wetting Agent | 0.15 wt. % | 0.15 wt. % | 0.15 wt. % |
| Wollastoinite | 49.34 wt. % | 49.34 wt. % | 49.34 wt. % |
| Water | 0.75 wt. % | 0.75 wt. % | 0.75 wt. % |
| Black dye | 1 wt. % | 1 wt. % | 1 wt. % |
| Nip Gap | 0.41 in. | 0.41 in. | 0.41 in. |
| Add on Weight | 16 lbs./rm | 16 lbs./rm | 20 lbs./rm |
| Curing Cycle | 20 min at 170° C. | 20 min at 170° C. | 20 min at 170° C. |
| | 20 min at 190° C. | 20 min at 190° C. | 20 min at 190° C. |
| | 20 min at 210° C. | 20 min at 210° C. | 20 min at 210° C. |
| | 20 min at 235° C. | 20 min at 235° C. | 20 min at 235° C. |
| | Abrasive Particles | | |
| Type | 36 grit 3-PT star, alumina | Reclaimed Cubitron | Reclaimed Cubitron |
| Add on Weight | 33 lbs./rm | 43 lbs./rm | 44 lbs./rm |

The orientation of the particles in samples 2 and 3, comparative samples 2, and conventional sample 2 were measured according to the following procedure.

Figure 9A:
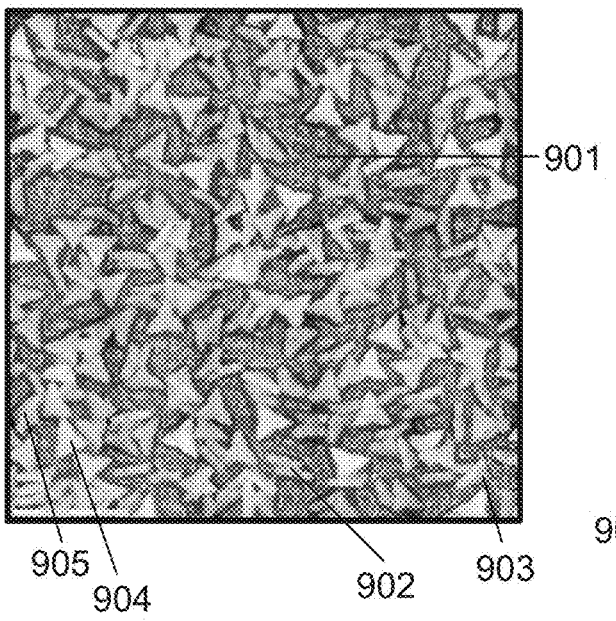
FIG. 9A includes a top-down view of a coated abrasive article.
Figure 9B:
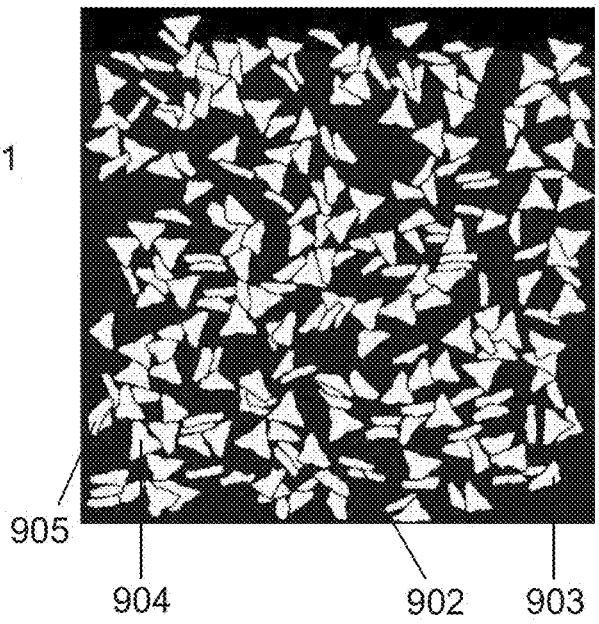
FIG. 9B includes the image of FIG. 9A edited to highlight the abrasive grains.
Figure 9C:
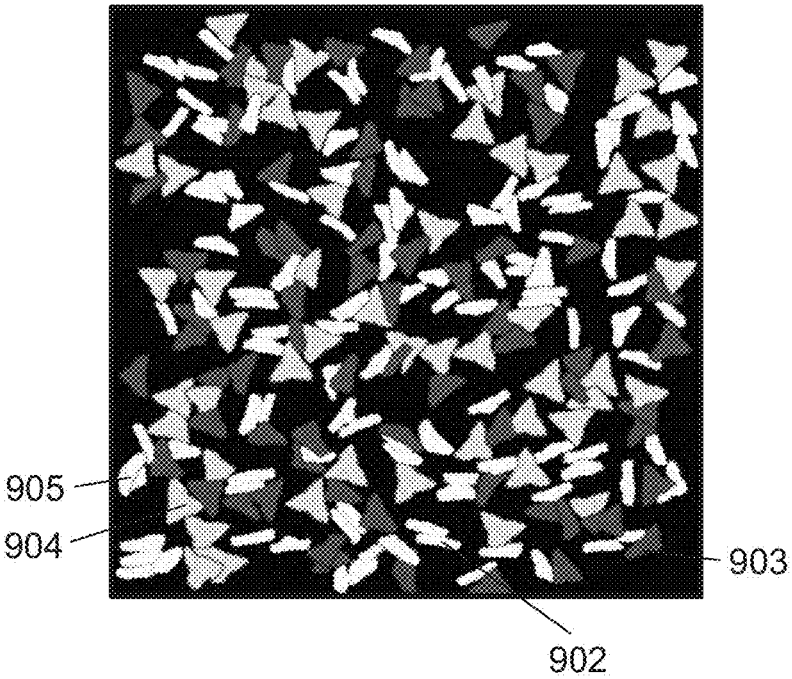
FIG. 9C includes the image of FIG. 9B further edited to color code the grains by orientation.

Images of each sample were taken using a z-stacking microscope. An exemplary image can be found in FIG. 9A. The image of the sample includes a visible make coat 901 and abrasive grains, e.g., 902, 903, 904, 905. ImageJ software was used to threshold and identify the grains, e.g., 902, 903, 904, 905. When necessary, overlapping grains were segmented manually. An exemplary image of the abrasive edited to identify the grains can be found in FIG. 9B. Grains were color-coded and counted by orientation based on the criteria below in table 2. An exemplary image with color coated grains can be found in FIG. 9C. Particle 902 is in a standing orientation; particle 903 is in a slanted orientation; particle 904 is in a fallen orientation; and particle 905 is in an inverted orientation. Grain orientation data can be found below in table 3. Images included a 3.2 $cm^2$ surface area of each sample.

TABLE 4

| | Tilt Angle | Shape |
|---|---|---|
| Standing | 65-90° | Visually rectangular from top-down view |
| Slanted | 5-65° | Visually an isosceles 3-PT star from top-down view |
| Fallen | 0-5° | Visually an equilateral 3-PT star from top-down view |
| Inverse | N/A | Only the tip of the grain is in contact with the make coat |

TABLE 5

| | Standing | Slanted | Well oriented | Fallen | Inverse | Coating density | Well Oriented Coating Density |
|---|---|---|---|---|---|---|---|
| Sample 2 | 73% | 12% | 85% | 6% | 10% | 65 #/cm$^2$ | 57 #/cm$^2$ |
| Sample 3 | 44% | 42% | 86% | 10% | 4% | 66 #/cm$^2$ | 55 #/cm$^2$ |
| Conventional Sample 2 | 35% | 23% | 58% | 40% | 2% | 63 #/cm$^2$ | 37 #/cm$^2$ |
| Comparative Sample 2 | 42% | 17% | 59% | 40% | 1% | 70 #/cm$^2$ | 41 #/cm$^2$ |

As can be seen in Table 5, samples 2 and 3 had a larger percentage of particles in desirable orientations as compared to the comparative and conventional samples. Sample 2 included a significantly larger number of standing particles as compared to all other samples.

The present application represents a departure from the state of the art. While certain publications have disclosed that it is desirable to orient shaped abrasive particles in certain orientations these publications have not enabled the degree of orientation as disclosed in the present application. Notably, it is apparent that conventional coated abrasives have a significant portion of abrasive particles placed in undesirable orientations. The industry continues to desire an enabled system and method for achieving a greater degree of control of orientation of abrasive particles in coated abrasives. The system and methods disclosed herein enable the formation of a coated abrasive articles having greater control over the orientation of particles on a backing for creation of coated abrasive articles. Moreover, the systems and methods herein may facilitate improved fine-tuned control over certain orientations, such as control over standing, slanted, fallen, and inverse orientations of grains.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure.

This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. An abrasive article comprising:

a backing;

a make coat overlying the backing;

a plurality of abrasive particles overlying the backing and at least partially contained in the make coat;

a make coat thickness ratio (Tg/Ta) of not greater than 1.5, wherein Tg is the average thickness of the make coat at the sides of the abrasive particles and the Ta is the average thickness of the make coat;

and wherein at least 60% of the total number of the abrasive particles are well oriented having a tilt angle of 5 to 90 degrees; and wherein the plurality of abrasive particles comprises a plurality of shaped abrasive particles, each of the shaped abrasive particles of the plurality of shaped abrasive particles including at least 3 interior corners, wherein each of the shaped abrasive particles comprises a body including a first major surface, a second major surface opposite the first major surface, and a side surface extending between the first major surface and the second major surface;

and wherein not greater than 50% of the total number of shaped abrasive particles have a crack at an interior corner on the first major surface.

2. The abrasive article of claim 1, wherein the body of each of the shaped abrasive particles comprises at least 3 exterior corners and wherein the side surface comprises at least 4 side surface sections.

3. The abrasive article of claim 1, wherein the shaped abrasive particles have a three-pointed star two-dimensional shape as viewed in a plane of a length and width of the body.

4. The abrasive article of claim 1, wherein the thickness ratio (Tg/Ta) is not greater than 1.5 and at least 0.70.

5. The abrasive article of claim 4, wherein the thickness ratio (Tg/Ta) is not greater than 1.5 and at least 0.80.

6. The abrasive article of claim 5, wherein the thickness ratio (Tg/Ta) is not greater than 1.5 and at least 0.90.

7. The abrasive article of claim 4, wherein the make coat comprises a thickness standard deviation at the sides of the abrasive particles (STDTg) of not greater than 70 microns.

8. The abrasive article of claim 7, wherein the make coat thickness standard deviation at the sides of the abrasive particles (STDTg) is at least 10 microns and not greater than 70 microns.

9. The abrasive article of claim 8, wherein the make coat thickness standard deviation at the sides of the abrasive particles (STDTg) is at least 10 microns and not greater than 65 microns.

10. The abrasive article of claim 7, wherein at least 70% of the total plurality of abrasive particles comprising a plurality of shaped abrasive particles are well oriented.

11. The abrasive article of claim 10, wherein at least 80% of the plurality of abrasive particles comprising a plurality of shaped abrasive particles are well oriented.

12. The abrasive article of claim 7, further comprising a coating density of well oriented particles of at least 42 grains/cm$^2$.

13. The abrasive article of claim 12, further comprising a coating density of well oriented particles of at least 46 grains/cm$^2$.

14. The abrasive article of claim 4, further comprising a standing portion of shaped abrasive particles (Pst) having a standing orientation and a slanted portion (Psl) of shaped abrasive particles having a slanted orientation, and further comprising a ratio of the standing portion relative to the slanted portion (Pst/Psl) of at least 1 and not greater than 100.

15. The abrasive article of claim 4, further comprising a standing portion of shaped abrasive particles (Pst) having a standing orientation and a fallen portion (Pf) of shaped abrasive particles having a fallen orientation, and further comprising a ratio of the standing portion relative to the fallen portion (Pst/Pf) of at least 2.0 and not greater than 1000.

16. The abrasive article of claim 15, further comprising a percentage of fallen shaped abrasive particles having a tilt angle of 0 to 5 degrees of not greater than 20% of the plurality of abrasive particles comprising a plurality of shaped abrasive particles.

17. An abrasive article comprising:

a backing;

a make coat overlying the backing;

a plurality of abrasive particles overlying the backing and at least partially contained in the make coat;

a make coat thickness ratio (Tg/Ta) of at least 0.7 and not greater than 1.5, wherein Tg is the average thickness of the make coat at the sides of the abrasive particles and the Ta is the average thickness of the make coat;

wherein at least 60% of the total number of the abrasive particles are well oriented having a tilt angle of 5 to 90 degrees; and wherein the make coat comprises a thickness standard deviation at the sides of the abrasive particles (STDTg) of at least 10 microns and not greater than 70 microns.

18. The abrasive article of claim 17, wherein the thickness ratio (Tg/Ta) is not greater than 1.5 and at least 1.

19. The abrasive article of claim 18, wherein at least 80% of the total number of the abrasive particles are well oriented having a tilt angle of 5 to 90 degrees.

20. The abrasive article of claim 19, wherein the shaped abrasive particles have a three-pointed star two-dimensional shape as viewed in a plane of a length and width of the body.

21. An abrasive article comprising:

a backing;

a make coat overlying the backing;

a plurality of abrasive particles overlying the backing and at least partially contained in the make coat;

a make coat thickness ratio (Tg/Ta) of at least 0.7 and not greater than 1.5, wherein Tg is the average thickness of the make coat at the sides of the abrasive particles and the Ta is the average thickness of the make coat;

wherein at least 60% of the total number of the abrasive particles are well oriented having a tilt angle of 5 to 90 degrees; and further comprising a standing portion of abrasive particles (Pst) having a standing orientation and a slanted portion (Psl) of abrasive particles having a slanted orientation, and further comprising a ratio of the standing portion relative to the slanted portion (Pst/Psl) of at least 1 and not greater than 100.

22. The abrasive article of claim 21, wherein the thickness ratio (Tg/Ta) is not greater than 1.5 and at least 1.

23. The abrasive article of claim 22, wherein at least 80% of the total number of the abrasive particles are well oriented having a tilt angle of 5 to 90 degrees.

24. The abrasive article of claim 23, wherein the shaped abrasive particles have a three-pointed star two-dimensional shape as viewed in a plane of a length and width of the body.

25. An abrasive article comprising:

a backing;

a make coat overlying the backing;

a plurality of abrasive particles overlying the backing and at least partially contained in the make coat;

a make coat thickness ratio (Tg/Ta) of at least 0.7 and not greater than 1.5, wherein Tg is the average thickness of the make coat at the sides of the abrasive particles and the Ta is the average thickness of the make coat;

wherein at least 60% of the total number of the abrasive particles are well oriented having a tilt angle of 5 to 90 degrees; and further comprising a standing portion of abrasive particles (Pst) having a standing orientation and a fallen portion (Pf) of abrasive particles having a fallen orientation, and further comprising a ratio of the standing portion relative to the fallen portion (Pst/Pf) of at least 2.0 and not greater than 1000.

26. The abrasive article of claim 25, wherein the thickness ratio (Tg/Ta) is not greater than 1.5 and at least 1.

27. The abrasive article of claim 26, wherein at least 80% of the total number of the abrasive particles are well oriented having a tilt angle of 5 to 90 degrees.

28. The abrasive article of claim 27, wherein the shaped abrasive particles have a three-pointed star two-dimensional shape as viewed in a plane of a length and width of the body.

* * * * *